US012721414B2

(12) United States Patent
Ishihara et al.

(10) Patent No.: US 12,721,414 B2
(45) Date of Patent: Sep. 1, 2026

(54) HAIR CARE DEVICE, AND HAIR CARE SYSTEM

(71) Applicant: Panasonic Intellectual Property Management Co., Ltd., Osaka (JP)

(72) Inventors: Aya Ishihara, Osaka (JP); Miei Kinoshita, Shiga (JP); Hiroyuki Inoue, Shiga (JP); Yuki Chikazawa, Nara (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 659 days.

(21) Appl. No.: 18/259,745

(22) PCT Filed: Dec. 24, 2021

(86) PCT No.: PCT/JP2021/048154
§ 371 (c)(1),
(2) Date: Dec. 19, 2023

(87) PCT Pub. No.: WO2022/168497
PCT Pub. Date: Aug. 11, 2022

(65) Prior Publication Data

US 2024/0398087 A1 Dec. 5, 2024

(30) Foreign Application Priority Data

Feb. 5, 2021 (JP) ..... 2021-017484

(51) Int. Cl.
*A45D 20/12* (2006.01)
*A45D 44/00* (2006.01)

(52) U.S. Cl.
CPC ..... *A45D 20/12* (2013.01); *A45D 44/005* (2013.01); *A45D 2044/007* (2013.01)

(58) Field of Classification Search
CPC . A45D 20/12; A45D 11/005; A45D 2044/007
(Continued)

(56) References Cited

U.S. PATENT DOCUMENTS 5,568,691 A * 10/1996 Rubin ..... A45D 20/30 392/380
6,038,786 A * 3/2000 Aisenberg ..... A47K 10/48 34/267
(Continued)

FOREIGN PATENT DOCUMENTS

CN 108433318 A 8/2018
CN 111802779 A 10/2020
(Continued)

OTHER PUBLICATIONS

English Translation of Chinese Search Report dated Jul. 23, 2025 for the related Chinese Patent Application No. 202180092985.3.
(Continued)

*Primary Examiner* — Stephen M Gravini
(74) *Attorney, Agent, or Firm* — Rimon P.C.

(57) ABSTRACT

Controller of a hair dryer as a hair care device includes hair characteristic recognition unit, table generation unit, and application amount calculation unit. Hair characteristic recognition unit classifies a user's hair characteristics based on a hair measurement value or a hair image. Table generation unit sets a component amount of a component generated by component generation unit for each hair characteristic. Application amount calculation unit adjusts the component amount for each user based on the hair characteristics of whole hair classified by hair characteristic recognition unit and the component amount set by table generation unit. Alternatively, application amount calculation unit calculates a component application amount given by component generation unit or a heat application amount given by heat application unit for each part based on the hair characteristics for each part of the hair classified by hair characteristic recognition unit and the component amount set by table generation unit.

25 Claims, 49 Drawing Sheets

(58) Field of Classification Search
USPC ..... 34/95–100
See application file for complete search history.

(56) References Cited

U.S. PATENT DOCUMENTS

| | | | | |
|---|---|---|---|---|
| 8,136,263 | B2 * | 3/2012 | Schmid | A45D 7/02 34/283 |
| 9,826,812 | B2 * | 11/2017 | Sterling | A45D 20/08 |
| 10,021,952 | B2 * | 7/2018 | Goldman | A45D 20/12 |
| 10,786,061 | B2 * | 9/2020 | Thiebaut | A46B 15/0004 |
| 12,070,114 | B2 * | 8/2024 | Lelieveld | A45D 20/10 |
| 12,098,496 | B2 * | 9/2024 | McGrane | D06F 58/30 |
| 12,458,124 | B2 * | 11/2025 | Park | A45D 20/12 |
| 12,465,127 | B2 * | 11/2025 | Ceva | A45D 20/12 |
| 12,480,709 | B2 * | 11/2025 | Gu | A45D 20/12 |
| 2020/0323326 | A1 | 10/2020 | Matsui et al. | |
| 2024/0398086 | A1 * | 12/2024 | Ishihara | A45D 20/12 |
| 2024/0398087 | A1 * | 12/2024 | Ishihara | A45D 20/12 |

FOREIGN PATENT DOCUMENTS

| | | | | | |
|---|---|---|---|---|---|
| CN | 116801766 | A | * | 9/2023 | A45D 44/005 |
| EP | 2564723 | A1 | | 3/2013 | |
| JP | H04-033602 | A | | 2/1992 | |
| JP | 2013-063238 | A | | 4/2013 | |
| JP | 2015-167704 | A | | 9/2015 | |
| JP | 2018-175726 | A | | 11/2018 | |
| JP | 2019-058484 | A | | 4/2019 | |
| JP | 2020-171532 | A | | 10/2020 | |
| JP | 2022120532 | A | * | 8/2022 | A45D 20/10 |
| KR | 10-2019-026951 | A | | 3/2019 | |
| KR | 10-2019-063459 | A | | 6/2019 | |
| KR | 20230137895 | A | * | 10/2023 | A45D 44/005 |
| WO | 2018/023117 | A1 | | 2/2018 | |
| WO | 2018/077708 | A1 | | 5/2018 | |
| WO | WO-2022168497 | A1 | * | 8/2022 | A45D 20/10 |

OTHER PUBLICATIONS

International Search Report issued on Mar. 8, 2022 in International Patent Application No. PCT/JP2021/048154, with English translation.

* cited by examiner

FIG. 13A

| BEAUTY COMPONENT / VOLUME | CHARGED FINE PARTICLE WATER | NEGATIVE ION | AGENT OR ORGANIC SUBSTANCE |
|---|---|---|---|
| MORE | INCREASE | DECREASE | INCREASE |
| NORMAL | NO CHANGE | NO CHANGE | NO CHANGE |
| LESS | DECREASE | INCREASE | DECREASE |

FIG. 13B

| BEAUTY COMPONENT / HARDNESS | CHARGED FINE PARTICLE WATER | NEGATIVE ION | AGENT OR ORGANIC SUBSTANCE |
|---|---|---|---|
| HARD | INCREASE | DECREASE | APPLY MOISTURIZING COMPONENT |
| NORMAL | NO CHANGE | NO CHANGE | NO CHANGE |
| SOFT | DECREASE | INCREASE | APPLY COATING COMPONENT |

FIG. 13C

| BEAUTY COMPONENT / DAMAGE | CHARGED FINE PARTICLE WATER | NEGATIVE ION | AGENT OR ORGANIC SUBSTANCE |
|---|---|---|---|
| MORE | INCREASE | DECREASE | INCREASE REPAIRING COMPONENT INCREASE COATING COMPONENT |
| NORMAL | NO CHANGE | NO CHANGE | NO CHANGE |
| LESS | DECREASE | INCREASE | DECREASE REPAIRING COMPONENT DECREASE COATING COMPONENT |

FIG. 14A

| | DETECTED HAIR CONDITION | HAIR DAMAGE | ALKALINE HAIR | CUTICLE PEELING | INCREASE IN WATER ABSORPTION WHEN WET |
|---|---|---|---|---|---|
| | BEAUTY COMPONENT | REPAIRING AGENT | CHARGED FINE PARTICLE WATER | ZINC FINE PARTICLES | CHARGED FINE PARTICLE WATER |
| HAIR PART | ROOT | DECREASE | DECREASE | DECREASE | NO CHANGE |
| | MIDDLE | NO CHANGE | NO CHANGE | NO CHANGE | INCREASE |
| | TIP | INCREASE | INCREASE | INCREASE | INCREASE |

FIG. 14B

| | DETECTED HAIR CONDITION | DECREASE IN WATER RETENTION AFTER DRYING | | | |
|---|---|---|---|---|---|
| | BEAUTY COMPONENT | TREATMENT AGENT | MOISTURIZING COMPONENT | COATING AGENT | CHARGED FINE PARTICLE WATER |
| HAIR PART | ROOT | DECREASE | NO CHANGE | DECREASE | NO CHANGE |
| | MIDDLE | NO CHANGE | INCREASE | DECREASE | INCREASE |
| | TIP | INCREASE | INCREASE | NO CHANGE | INCREASE |

| | CHARGED FINE PARTICLE WATER | NEGATIVE ION |
|---|---|---|
| 1 | 0% | 0% |
| 2 | 50% | 50% |
| 3 | 75% | 75% |

FIG. 27

| COMPONENT | | CHARGED FINE PARTICLE WATER | | NEGATIVE ION | | AGENT OR ORGANIC SUBSTANCE | |
|---|---|---|---|---|---|---|---|
| CHANGE TIMING | | BEFORE CHANGE | AFTER CHANGE | BEFORE CHANGE | AFTER CHANGE | BEFORE CHANGE | AFTER CHANGE |
| INSTRUCTION LEVELS FOR DIFFERENT HAIR PARTS | ROOT | 2 | 3 | 2 | 2 | 2 | 1 |
| | MIDDLE | 2 | 2 | 3 | 4 | 3 | 3 |
| | TIP | 4 | 5 | 4 | 4 | 4 | 4 |

FIG. 28

| | HAIR IS WET | HAIR IS DRY |
|---|---|---|
| WETTING DETECTION BY LIGHT (CHANGE IN ABSORBANCE) | 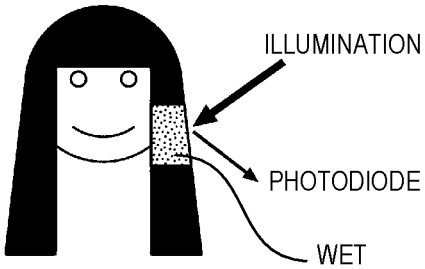 <br>LIGHT IS ABSORBED AND REFLECTED LIGHT DECREASES | 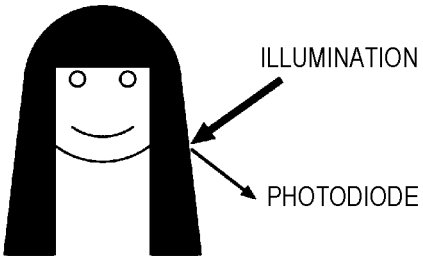 <br>LIGHT IS NOT ABSORBED AND REFLECTED LIGHT DOES NOT DECREASE |
| MACHINE LEARNING OF HAIR BUNDLE STATE | 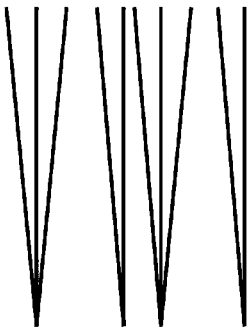 <br>HAIR IS STUCK TOGETHER IN A BUNDLE | 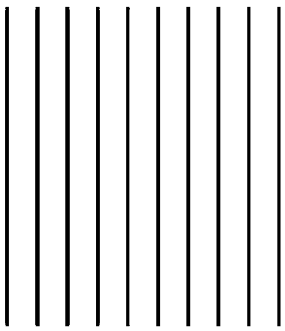 <br>HAIR IS SEPARATED AND INDEPENDENT FROM EACH OTHER |
| WETTING DETECTION BY TEMPERATURE (TEMPERATURE CHANGE) | 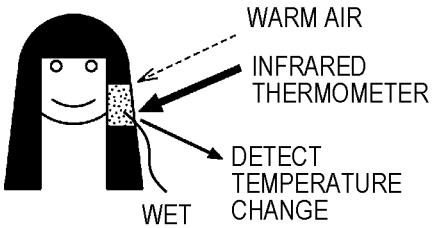 <br>TEMPERATURE CHANGE IS SMALL (TEMPERATURE DOES NOT EASILY RISE AND EASILY COOLS DOWN) | 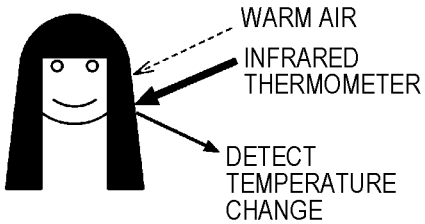 <br>TEMPERATURE CHANGE IS LARGE (TEMPERATURE EASILY RISES AND DOES NOT EASILY COOL DOWN) |

FIG. 29

| | CRITERION FOR DETERMINING THAT "HAIR IS WET" | CRITERION FOR DETERMINING THAT "HAIR IS DRY" |
|---|---|---|
| WETTING DETECTION BY LIGHT (CHANGE IN ABSORBANCE) | 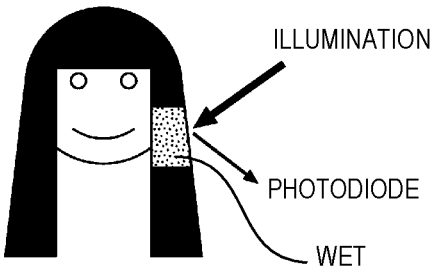  ABSORBANCE IS 70% TO 30% | 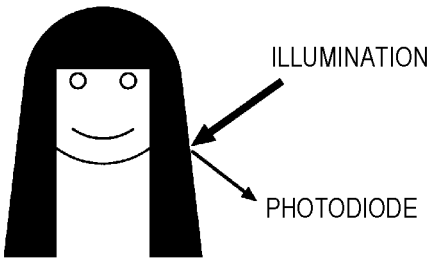  ABSORBANCE IS 29% TO 10% |
| MACHINE LEARNING OF HAIR BUNDLE STATE | 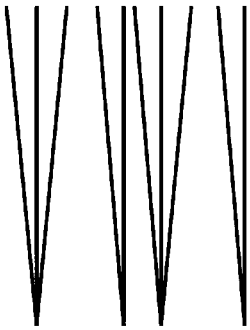 HAIR IS STUCK TOGETHER IN A BUNDLE | 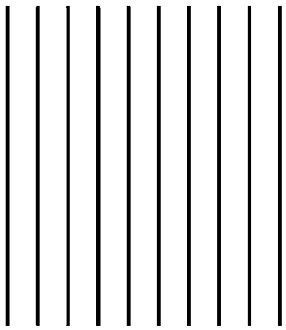 HAIR IS SEPARATED AND INDEPENDENT FROM EACH OTHER |
| WETTING DETECTION BY TEMPERATURE (TEMPERATURE CHANGE) | 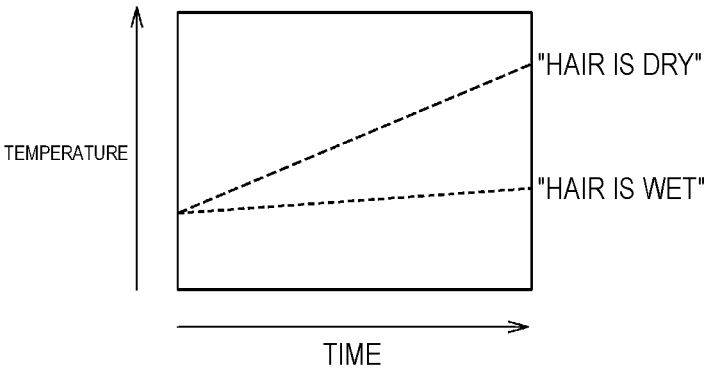  TEMPERATURE CHANGE WHEN WARM AIR IS APPLIED | |

FIG. 30

| SIGNAL STRENGTH OF WETTING DETECTION SENSOR (ABSORBANCE%) | ATMOSPHERE | HAIR | | | SKIN (FACE) | WATER |
|---|---|---|---|---|---|---|
| | | HAIR FLUTTERING STATE | DRY STATE | WET STATE | | |
| | 0 | 0–9 | 10–29 | 30–70 | 71–90 | 100 |
| DELIVERY PARAMETERS TO DRYING ESTIMATION CALCULATION UNIT | NOT CONTRIBUTE TO DRYING OF HAIR | NOT CONTRIBUTE TO DRYING OF HAIR | DRY HAIR | DRY HAIR | NOT CONTRIBUTE TO DRYING OF HAIR | NOT CONTRIBUTE TO DRYING OF HAIR |
| DELIVERY PARAMETERS TO APPLICATION AMOUNT CALCULATION UNIT | ▪ STOP APPLICATION ▪ NOT COUNT AS APPLICATION TIME | ▪ STOP APPLICATION ▪ NOT COUNT AS APPLICATION TIME | INSTRUCT APPLICATION | INSTRUCT APPLICATION | INSTRUCT APPLICATION | ▪ STOP APPLICATION ▪ NOT COUNT AS APPLICATION TIME |

FIG. 34A

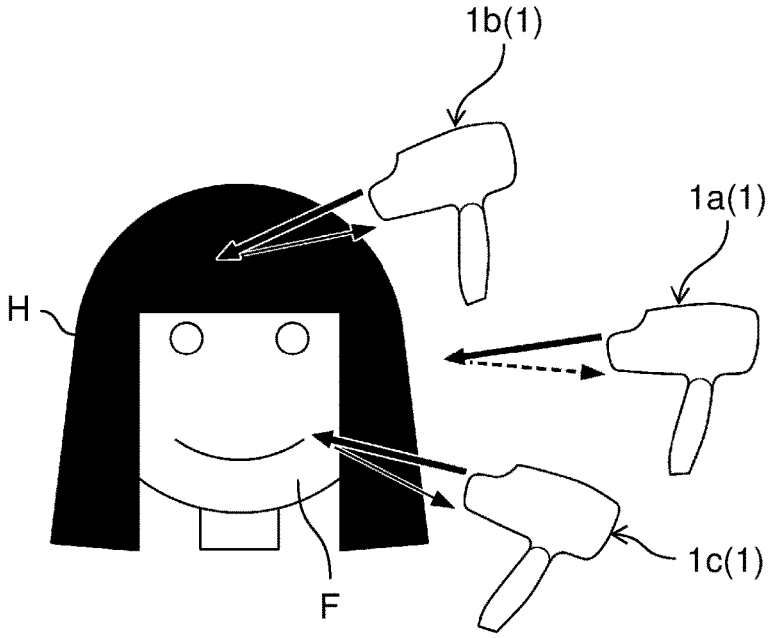

FIG. 34B

| DETERMINATION CONDITION | DETERMINATION | HEAT | HAIR CARE | | | |
|---|---|---|---|---|---|---|
| | | | CHARGED FINE PARTICLE WATER | NEGATIVE ION | AGENT | POLYMER |
| NO SENSOR DETECTION | EQUIVALENT TO ATMOSPHERE | NO CHANGE | NO CHANGE | NO CHANGE | STOP | STOP |
| TARGET PORTION IS MOVED WITH WIND | HAIR | NO CHANGE | NO CHANGE | NO CHANGE | FOR HAIR | FOR HAIR |
| TARGET PORTION IS NOT MOVED WITH WIND | SKIN | TEMPERATURE FALL | NO CHANGE | STOP | FOR SKIN | FOR SKIN |

HAIR CARE DEVICE, AND HAIR CARE SYSTEM

CROSS-REFERENCE OF RELATED APPLICATIONS

This application is the U.S. National Phase under 35 U.S.C. § 371 of International Patent Application No. PCT/JP2021/048154, filed on Dec. 24, 2021, which in turn claims the benefit of Japanese Patent Application No. 2021-017484, filed on Feb. 5, 2021, the entire disclosures of which Applications are incorporated by reference herein.

TECHNICAL FIELD

The present disclosure relates to a hair care device and a hair care system.

BACKGROUND ART

Conventionally, there is a hair care device such as a hair dryer that not only merely dries a user's hair but also applies an effective component for the user's hair. For example, PTL 1 discloses a technique related to a hair dryer in which ions are applied to hair as an effective component, and an amount of the component is adjusted based on usage time in addition to settings by the user.

CITATION LIST

Patent Literature

PTL 1: Unexamined Japanese Patent Publication No. 2019-58484

SUMMARY OF THE INVENTION

Hairstyles and hair quality are different user by user. Therefore, even when an amount of ions as an effective component for hair is adjusted as in the hair dryer disclosed in PTL 1, it may not act effectively depending on the hairstyle and hair quality of the user. In other words, the hair dryer disclosed in PTL 1 does not necessarily achieve a finish of hair desired by the user suitable for the hairstyle and hair quality of the user.

The present disclosure provides a hair care device and a hair care system that easily lead to a finish of hair desired by a user.

A hair care device according to one aspect of the present disclosure includes a heat application unit that applies heat to a user's hair, a component generation unit that generates a component that acts on the hair, and a measurement unit that measures or photographs the hair. Further, the hair care device according to one aspect of the present disclosure includes a controller that controls operations of the heat application unit and the component generation unit based on a hair measurement value or a hair image obtained from the measurement unit. The controller includes a hair characteristic recognition unit, a table generation unit, and an application amount calculation unit. The hair characteristic recognition unit classifies hair characteristics of the user based on the hair measurement value or the hair image. The table generation unit sets a component amount of a component generated by the component generation unit for each hair characteristic classified by the hair characteristic recognition unit. The application amount calculation unit adjusts the component amount for each user based on the hair characteristics of the whole hair classified by the hair characteristic recognition unit and the component amount set by the table generation unit. Alternatively, the application amount calculation unit calculates a component application amount given by the component generation unit or a heat application amount given by the heat application unit for each part based on the hair characteristics for each part of the hair classified by the hair characteristic recognition unit and the component amount set by the table generation unit.

Further, a hair care system according to one aspect of the present disclosure includes the hair care device described above and a portable terminal device, wherein the hair care device described above includes a transmitting and receiving unit, and the portable terminal device includes a terminal communication unit that performs transmission and reception with the transmitting and receiving unit.

According to the present disclosure, it is possible to provide a hair care device and a hair care system that easily provide a finish of hair desired by a user.

BRIEF DESCRIPTION OF THE DRAWINGS

FIG. 13A is a table illustrating component amounts in a case where the hair characteristic is the volume.

FIG. 13B is a table illustrating the component amounts in a case where the hair characteristic is a hardness (the thickness) of hair.

FIG. 13C is a table illustrating the component amounts in a case where the hair characteristic is hair damage (gloss).

FIG. 14A is a table illustrating the amount of a component set for each part of hair and for each hair condition.

FIG. 14B is a table illustrating the amount of a component set for each part of hair and for each hair condition.

FIG. 27 is a table illustrating a setting example when the component amount is changed for each part of hair.

FIG. 28 is a table illustrating a principle for determining whether or not hair is wet.

FIG. 29 is a table illustrating criteria for determining whether or not hair is wet.

FIG. 30 is a table illustrating delivery parameters for each absorbance.

FIG. 34A is a schematic view illustrating target portions blown by warm air.

FIG. 34B is a table illustrating an example of determination conditions of the target portions and adjustments of the temperature and a component for each target portion.

DESCRIPTION OF EMBODIMENT

Hereinafter, a hair care device according to an exemplary embodiment of the present disclosure will be described in detail with reference to the drawings. However, unnecessary detailed description may be omitted. For example, detailed descriptions of already well-known matters or redundant descriptions of substantially the same configuration may be omitted. Note that, the accompanying drawings and the following description are merely presented to help those skilled in the art fully understand the present disclosure, and are not intended to limit the subject matters described in the scope of claims.

First Exemplary Embodiment

Figure 1:
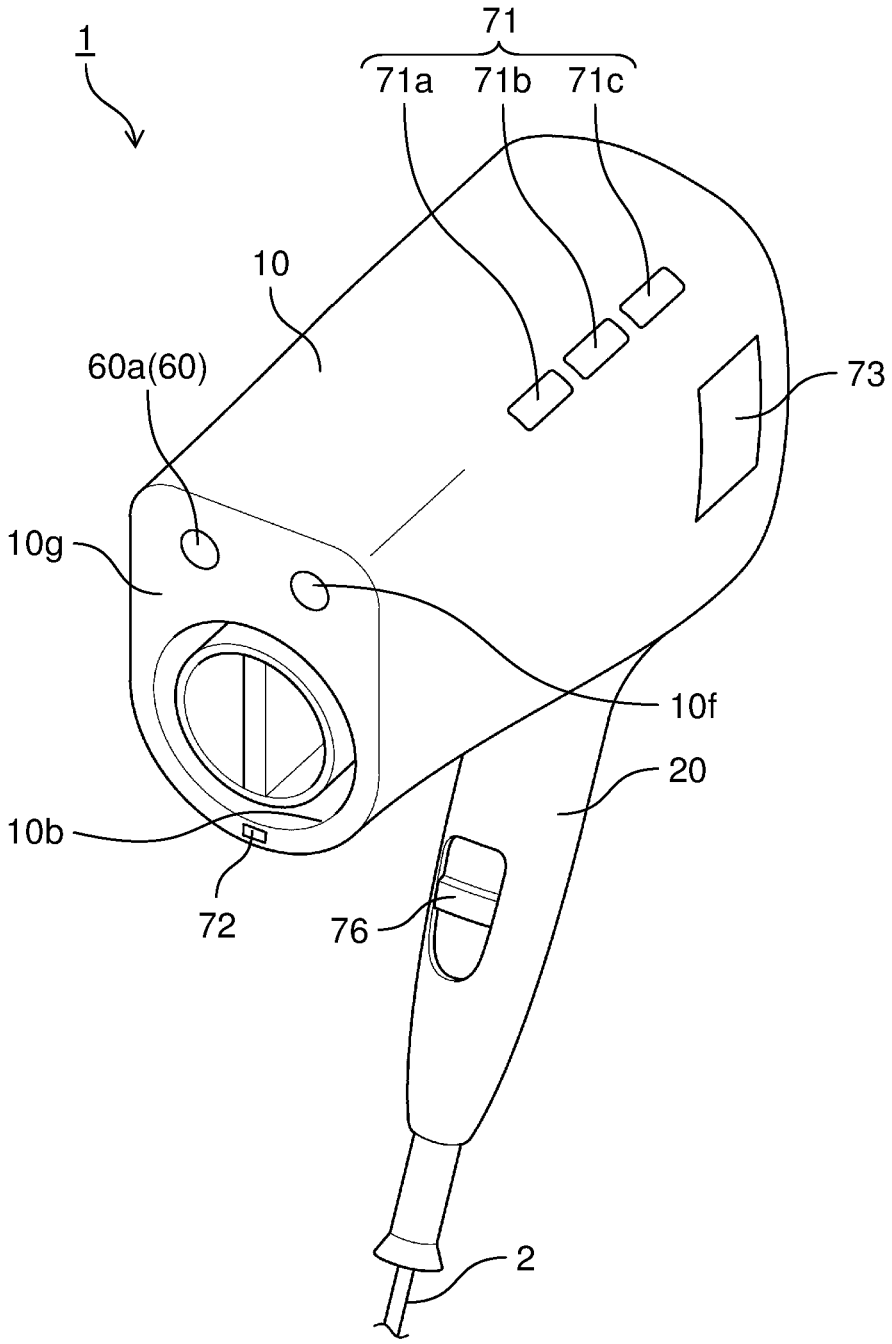
FIG. 1 is a schematic perspective view illustrating a configuration of a hair dryer according to a first exemplary embodiment.
Figure 2:
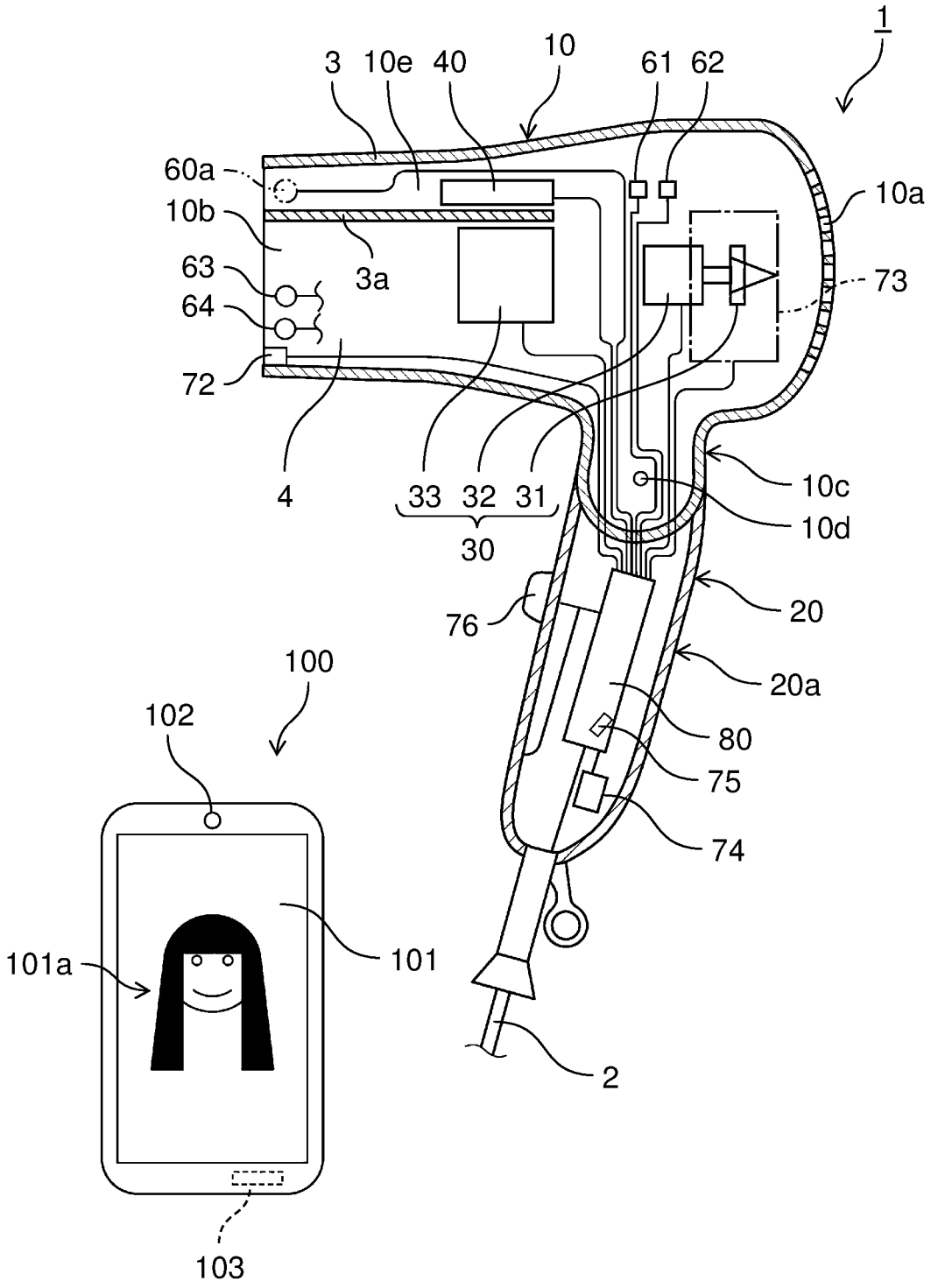
FIG. 2 is a schematic sectional view illustrating the configuration of the hair dryer according to the first exemplary embodiment.

FIG. 1 is a schematic perspective view illustrating a configuration of hair dryer 1 as a hair care device according to the first exemplary embodiment. Hair dryer 1 includes main body 10 that sends warm air toward a user, and grip part 20 as a portion gripped by the user's hand during use. FIG. 2 is a schematic sectional view illustrating the configuration of hair dryer 1 cut along an air blowing direction so as to include main body 10 and grip part 20.

Main body 10 includes housing 3 forming an outer wall in which a plurality of divided bodies are joined together. Inside housing 3, air blowing flow channel 4 is formed from suction port 10*a* provided at one end portion in a longitudinal direction to discharge port 10*b* provided at the other end portion. As shown in FIG. 2, main body 10 and grip part 20 are pivotably connected by connecting part 10*c* with respect to connecting shaft 10*d*. For example, when hair dryer 1 is not in use, grip part 20 is folded against main body 10 so as to be substantially parallel to an axial direction of main body 10 extending in the air blowing direction. In grip part 20, power supply cord 2 is pulled out from an end portion opposite to connecting part 10*c*.

To start with, hair dryer 1 includes heat application unit 30, component generation unit 40, measurement unit 50 (see FIG. 5), input unit 71, and display 73.

Heat application unit 30 applies heat to the user's hair. In the present exemplary embodiment, heat application unit 30 is an air blower that generates warm air to be sent to the user's hair. Heat application unit 30 includes, for example, fan 31, motor 32, and heating unit 33. Fan 31 is disposed on an upstream side in air blowing flow channel 4 and rotates when motor 32 is driven. When fan 31 rotates, an air flow is formed to flow into air blowing flow channel 4 from outside via suction port 10*a*, pass through air blowing flow channel 4, and is discharged from discharge port 10*b* to outside. Heating unit 33 is disposed downstream of fan 31 and heats the air flow sent from fan 31. When heating unit 33 is operated, the air flow formed by fan 31 is heated, and warm air is blown out from discharge port 10*b*. Heating unit 33 may be, for example, a heater in which an electric resistor having a strip shape and a corrugated plate shape is wound along an inner periphery of housing 3.

Component generation unit 40 generates a component that acts on the user's hair. Here, the component that acts on hair refers to a so-called beauty component that can effectively act on at least hair quality of the user. Examples of the component include, for example, an agent or an organic substance, negative ions, metal fine particles, and charged fine particle water. The agent or organic substance is, for example, a moisturizing component (a moisturizing agent), a repairing component (a repairing agent), a coating component (a coating agent), or a treatment component (a treatment agent). The moisturizing component is, for example, 1,3-butylene glycol, glycerin, panthenol, ceramide, hyaluronic acid, honey, or a polysaccharide. The repair component is, for example, hydrolyzed collagen, hydrolyzed keratin, an amino acid, hair protection protein, a polypeptide, cholesterol, a cationic surfactant or an organic acid. The coating component is, for example, silicon, squalane or an oily component. The treatment component is, for example, a cationic surfactant, an amino acid, a polypeptide, panthenol, or ceramide. Further, the charged fine particle water is an electrically charged nano-sized water particle containing OH radicals.

Figure 3A:
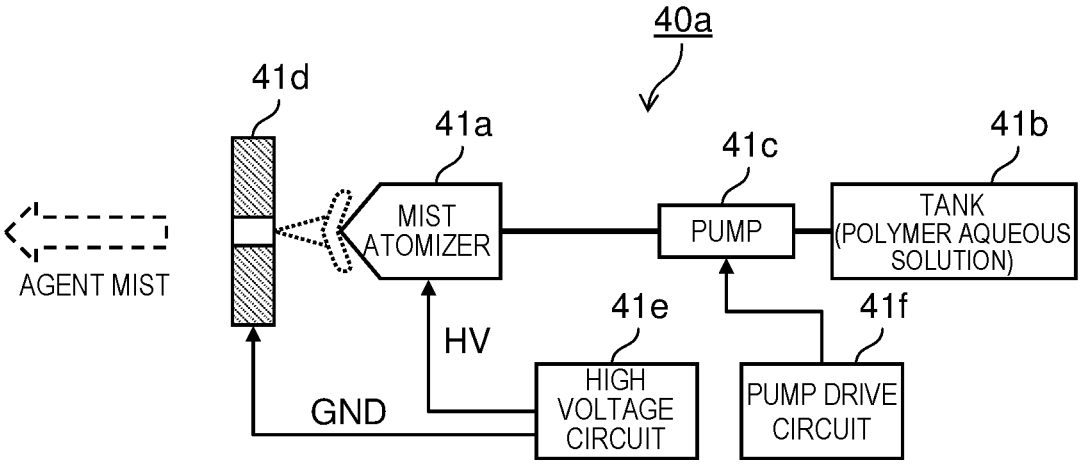
FIG. 3A is a diagram illustrating a configuration of a first electrostatic atomization device as an example of a component generation device that can be adopted as a component generation unit.
Figure 3B:
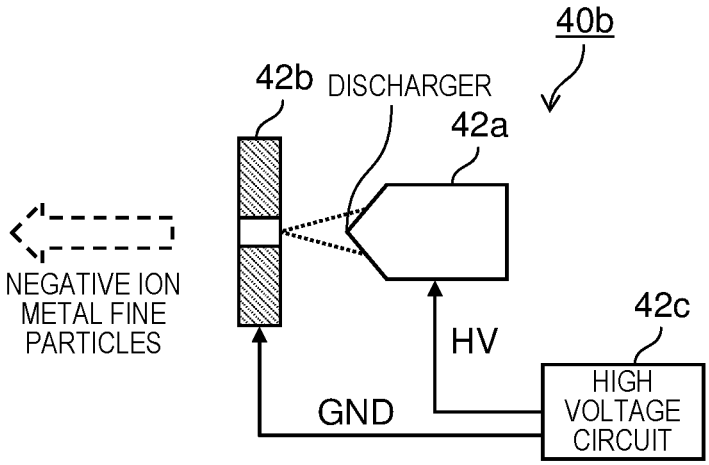
FIG. 3B is a diagram illustrating a configuration of a second electrostatic atomization device as an example of a component generation device that can be adopted as a component generation unit.
Figure 3C:
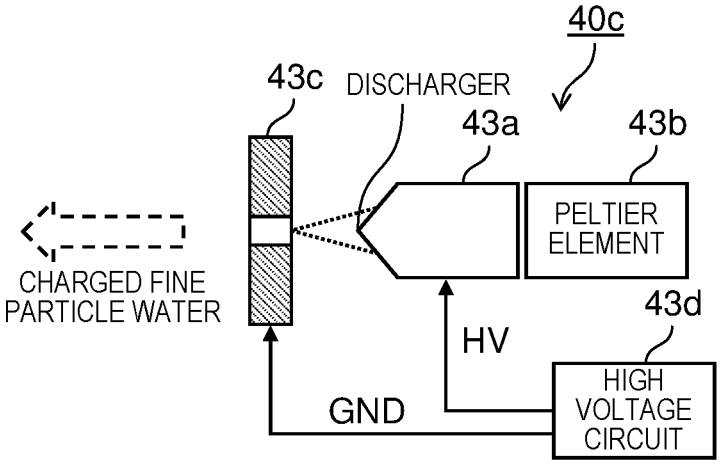
FIG. 3C is a diagram illustrating a configuration of a third electrostatic atomization device as an example of a component generation device that can be adopted as a component generation unit.

FIGS. 3A to 3C are schematic diagrams illustrating configurations of various component generation devices that can be adopted as component generation unit 40. FIG. 3A is a diagram illustrating a configuration of first electrostatic atomization device 40*a* as an example of an agent spraying device that uses an agent or an organic substance as a component acting on hair. First electrostatic atomization device 40*a* includes mist atomizer 41*a*, tank 41*b*, pump 41*c*. GND electrode 41*d*, high-voltage circuit 41*e*, and pump drive circuit 41*f*. Mist atomizer 41*a* is a discharger formed to hold a liquid as an agent or an organic substance. Tank 41*b* stores an aqueous solution containing, for example, a polymer as an agent or an organic substance. Pump 41*c* is installed in a pipe connecting tank 41*b* and mist atomizer 41*a*, and sends a polymer aqueous solution stored in tank 41*b* to mist atomizer 41*a*. High-voltage circuit 41*e* applies a high voltage (HV) to mist atomizer 41*a*. Pump drive circuit 41*f* controls driving of pump 41*c*. High-voltage circuit 41*e* and pump drive circuit 41*f* are controlled by component amount control unit 84 (see FIG. 5) in controller 80 to be described in detail below. When a high voltage is applied between mist atomizer 41*a* and GND electrode 41*d*, corona discharge or the like occurs, and an agent mist containing a polymer is generated by this discharge action. Note that, the agent spraying device that uses an agent or an organic substance as the component acting on hair is not limited to an electrostatic atomization device such as first electrostatic atomization device 40*a*, and may be an ultrasonic atomization device, a centrifugal pump, or the like.

FIG. 3B is a diagram illustrating a configuration of second electrostatic atomization device 40*b* as an example of a component generation device that use negative ions or metal fine particles as a component acting on hair. Second electrostatic atomization device 40*b* includes discharger 42*a*, GND electrode 42*b*, and high-voltage circuit 42*c*. High-voltage circuit 42*c* is controlled by component amount control unit 84 in the same manner as the configuration of first electrostatic atomization device 40*a*. When a high voltage is applied between discharger 42*a* and GND electrode 41*d*, for example, corona discharge or the like occurs, and negative ions negatively charged based on moisture in the air are generated by this discharge action.

FIG. 3C is a diagram illustrating a configuration of third electrostatic atomization device 40*c* as an example of a component generation device that uses charged fine particle water as a component acting on hair. Third electrostatic atomization device 40*c* includes discharger 43*a*, Peltier element 43*b* as a dew condensation unit. GND electrode 43*c*, and high-voltage circuit 43*d*. High-voltage circuit 43*d* is controlled by component amount control unit 84 in the same manner as the configuration of first electrostatic atomization device 40*a*. When a high voltage is applied between discharger 43*a* and GND electrode 43*c*, corona discharge or the like occurs, and charged fine particle water based on moisture in the air are generated by this discharge action.

For example, when component generation unit 40 in the present exemplary embodiment is third electrostatic atomization device 40*c*, as shown in FIG. 2, partition plate 3*a* that forms branch channel 10*e* extending in parallel with air blowing flow channel 4 is installed inside housing 3 of main body 10. Air blowing flow channel 4 allows an air flow passing through heating unit 33 to flow, whereas branch channel 10*e* allows an air flow not passing through heating unit 33 to flow. Then, third electrostatic atomization device 40*c* is installed in branch channel 10*e*. Further, front surface portion 10*g* that is a part of main body 10 and faces hair H during, for example, a drying operation, has component discharge port 10*f*. Component discharge port 10*f* communicates with branch channel 10*e*, and discharges the component generated by component generation unit 40 to outside. Note that, component generation unit 40 may be at least one of first electrostatic atomization device 40*a*, second electrostatic atomization device 40*b*, and third electrostatic atomization device 40*c*. In other words, a plurality of component generation units 40 may be provided for each component to be applied.

Measurement unit 50 (see FIG. 5) measures or photographs the user's hair, and transmits signal-processed information to controller 80. In the present exemplary embodiment, measurement unit 50 adopts a configuration that measures the user's hair. In this case, measurement unit 50 includes wetting detection unit 60, illumination unit 72, and signal processing unit 90 (see FIG. 5).

Wetting detection unit 60 detects the parameters that can be referred to for obtaining information on wetting of the user's hair. In the present exemplary embodiment, wetting detection unit 60 is wetting detection sensor 60*a* having at least an absorption wavelength (for example, 1450 nm) of water as a hair measurement value. Specifically, wetting detection sensor 60*a* may be a photodiode. Illumination unit 72 is a component paired with wetting detection sensor 60*a* that is, for example, a photodiode, and emits light having at least an absorption wavelength of water. Note that, signal processing unit 90 will be described in conjunction with the following matters related to controller 80.

Figure 4A:
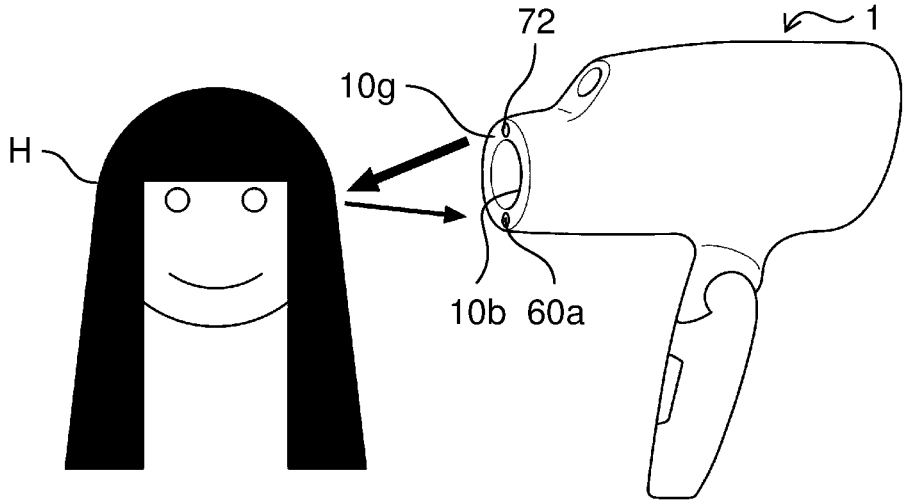
FIG. 4A is a view related to a first installation position example of a wetting detection sensor and an illumination unit.
Figure 4B:
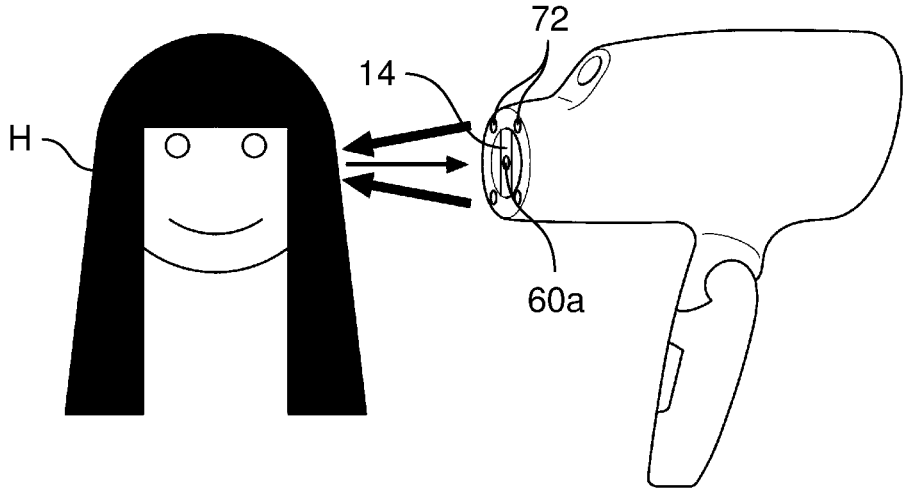
FIG. 4B is a view related to a second installation position example of the wetting detection sensor and the illumination unit.
Figure 4C:
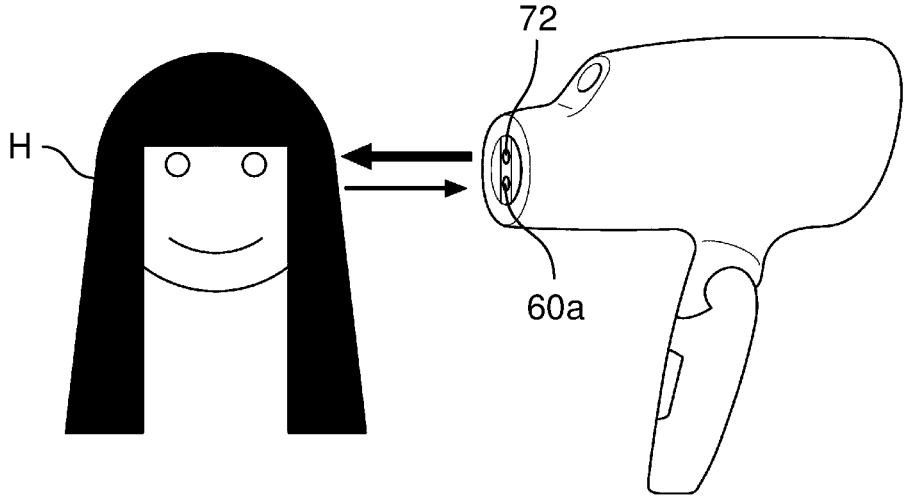
FIG. 4C is a view related to a third installation position example of the wetting detection sensor and the illumination unit.

FIGS. 4A to 4C are schematic diagrams for explaining a relationship between each installation position of wetting detection sensor 60*a* and illumination unit 72. Each installation position of wetting detection sensor 60*a* and illumination unit 72 is an example in the case shown in FIGS. 1 and 2, and specifically, a plurality of examples as shown in FIGS. 4A to 4C are conceivable. While illumination unit 72 is a light irradiation unit, wetting detection sensor 60*a* is a light receiving unit that receives light emitted from illumination unit 72 and then reflected by the hair H of the user. Wetting detection sensor 60*a* and illumination unit 72 are installed on front surface portion 10*g* or nozzle part 14 (see FIGS. 4B and 4C) attached to discharge port 10*b*.

FIG. 4A is a diagram related to a first installation position example of wetting detection sensor 60*a* and illumination unit 72. In the first installation example, there is one wetting detection sensor 60*a* and one illumination unit 72. Wetting detection sensor 60*a* is installed on a part of front surface portion 10*g*. Illumination unit 72 is installed on a part of front surface portion 10*g* opposite to wetting detection sensor 60*a* across discharge port 10*b*. In this case, since wetting detection sensor 60*a* and illumination unit 72 are separated from each other in a distance larger than or equal to an opening diameter of discharge port 10*b*, an incident angle and a reflection angle of light are large.

FIG. 4B is a diagram related to a second installation position example of wetting detection sensor 60*a* and illumination unit 72. In the second installation example, there is one wetting detection sensor 60*a*, but there are a plurality of illumination units 72. Wetting detection sensor 60*a* is installed on nozzle part 14 so as to be positioned approximately at a center of discharge port 10*b*. There are, for example, four illumination units 72, installed at equal intervals from each other on front surface portion 10*g*. In this case, since wetting detection sensor 60*a* and illumination unit 72 are separated from each other to a certain extent, it is possible to increase an irradiation amount of light while ensuring the incident angle and the reflection angle of light at a certain size.

FIG. 4C is a diagram related to a third installation position example of wetting detection sensor 60*a* and illumination unit 72. In the third installation example, wetting detection sensor 60*a* and illumination unit 72 are installed one by one on nozzle part 14. In this case, since wetting detection sensor 60*a* and illumination unit 72 are relatively close to each other, the incident angle and the reflection angle of light are small.

Hereinafter, in the present exemplary embodiment, as an example, a description will be given on an assumption that wetting detection sensor 60*a* and illumination unit 72 are installed based on the second installation example shown in FIG. 4B.

Input unit 71 is, for example, a button for the user to input information on characteristics of the user's hair (hereinafter, referred to as "hair characteristics"). Here, the hair characteristics refer to at least one of a hairstyle of a user, a length of hair, a volume of hair (hair amount), and hair quality related to the thickness or gloss of hair. In the example shown in FIG. 1, input unit 71 includes three input buttons, that is, hair quality input unit 71*a*, hair length input unit 71*b*, and hair volume input unit 71*c*, installed in housing 3, respectively. Note that, input unit 71 may also include a button for simply switching an air volume, an air temperature, and the like according to the user's preference.

Display 73 is, for example, a touch panel type display screen installed in housing 3, and functions as an input screen on which a user inputs information or an output screen that displays information to the user. Note that, a state of functioning as an input screen or an output screen will be described in detail below. Further, in a case where display 73 functions as an input screen, display 73 substitutes the function performed by input unit 71, so that input unit 71 may be unnecessary in some cases.

Further, as shown in FIG. 2, hair dryer 1 includes room temperature sensor 61, humidity sensor 62, hair detection unit 63, and part detection unit 64.

Room temperature sensor 61 is a sensor for measuring a temperature in a room where hair dryer 1 is used. Room temperature sensor 61 is installed inside housing 3. An output signal from room temperature sensor 61 is transmitted to controller 80.

Humidity sensor 62 is a sensor for measuring humidity in a room where hair dryer 1 is used. Room temperature sensor 61 is installed inside housing 3. An output signal from humidity sensor 62 is transmitted to controller 80.

Hair detection unit 63 detects whether the user has hair. Hair detection unit 63 is, for example, a laser range finder or a time of flight (ToF) camera, and is installed in a part of front surface portion 10*g*. An output signal from hair detection unit 63 is transmitted to controller 80.

Part detection unit 64 detects a part where heat is applied to the user's hair or a part where the component described above is applied to the user's hair. Part detection unit 64 may be an orientation detection unit (an orientation sensor) with at least one axis that detects a position or an orientation of hair dryer 1, or a distance measurement unit (a distance sensor) that measures a distance to the use's hair or skin (face). Here, when part detection unit 64 is a distance measurement unit, it is installed on a part of front surface portion 10*g*. On the other hand, when part detection unit 64 is an orientation detection unit, it is not limited to be installed on front surface portion 10*g*, and may be installed inside housing 3. An output signal from part detection unit 64 is transmitted to controller 80.

Figure 5:
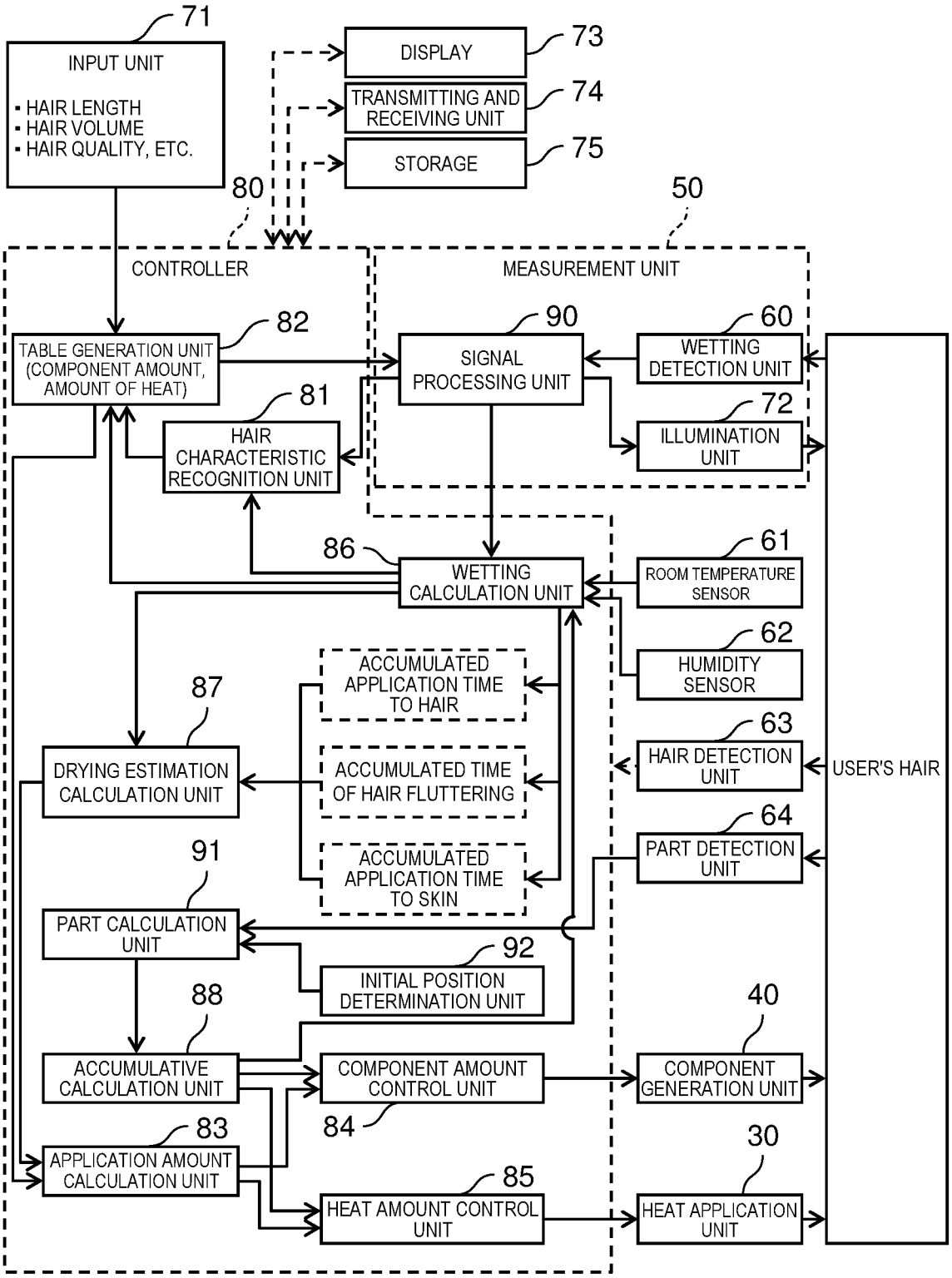
FIG. 5 is a block diagram illustrating a configuration of a controller of the hair dryer according to the first exemplary embodiment.

FIG. 5 is a block diagram showing a configuration of controller 80 of hair dryer 1. Controller 80 controls overall operations of hair dryer 1, and at least controls operations of heat application unit 30 and component generation unit 40 based on the hair measurement value obtained from measurement unit 50. Controller 80 is installed, for example, inside housing 20*a* of grip part 20. Note that, controller 80 includes a computer system including a processor and a memory. Then, when the processor executes programs stored in the memory, the computer system functions as controller 80. Here, the programs executed by the processor is recorded in advance in the memory of the computer system, but may be provided by being recorded in a non-transitory recording medium such as a memory card, or may be provided through a telecommunication line such as the Internet.

To start with, controller 80 includes hair characteristic recognition unit 81, table generation unit 82, application amount calculation unit 83, component amount control unit 84, and heat amount control unit 85. Hair characteristic recognition unit 81, table generation unit 82, application amount calculation unit 83, component amount control unit 84, and heat amount control unit 85 are a block group for determining a component application amount and a heat application amount based on the hair characteristics of the user.

Hair characteristic recognition unit 81 classifies the hair characteristics of the user based on the hair measurement value obtained from measurement unit 50.

Table generation unit 82 sets the component amount of the component generated by component generation unit 40 and the amount of heat applied from heat application unit 30, and manages these set values as a table. In table generation unit 82, the component amount and the amount of heat are set for each hair characteristic classified by hair characteristic recognition unit 81.

Based on the component amount or the amount of heat set by table generation unit 82, application amount calculation unit 83 calculates the component application amount applied to hair by component generation unit 40 or the heat application amount applied to hair by heat application unit 30. In the present exemplary embodiment, application amount calculation unit 83 can execute the following two types of calculations. First, application amount calculation unit 83 calculates the component application amount for each user based on the hair characteristics of the whole hair classified by hair characteristic recognition unit 81 and the component amount set by table generation unit 82. Second, application amount calculation unit 83 calculates the component application amount or the heat application amount for each part of the hair based on the hair characteristics for each part of the hair classified by hair characteristic recognition unit 81 and the component amount set by table generation unit 82.

Component amount control unit 84 controls the operation of component generation unit 40, that is, the component amount of the component generated by component generation unit 40, based on the component application amount transmitted from application amount calculation unit 83.

Heat amount control unit 85 controls the operation of heat application unit 30, that is, the amount of heat applied from heat application unit 30 based on the heat application amount transmitted from application amount calculation unit 83.

Further, controller 80 includes wetting calculation unit 86 and drying estimation calculation unit 87. Wetting calculation unit 86 and drying estimation calculation unit 87 are a block group for reflecting a dry state of the user's hair in the component application amount and the beat application amount.

Wetting calculation unit 86 calculates wetting information about wetting of the user's hair based on the hair measurement value obtained from measurement unit 50. Here, for example, in a case where wetting detection unit 60 in measurement unit 50 is wetting detection sensor 60*a*, the wetting information is absorbance calculated based on signal intensity from wetting detection sensor 60*a*.

Drying estimation calculation unit 87 estimates the degree of dryness of the user's hair based on the wetting information calculated by wetting calculation unit 86. When the wetting information is the absorbance, drying estimation calculation unit 87 estimates the degree of dryness based on a change in absorbance. In drying estimation calculation unit 87, for example, an accumulated time (time subtraction) in which a component or heat is applied to the hair, an accumulated time (time addition) in which the hair is in a fluttering state, an accumulated time (time addition) in which a component or heat is applied to the skin (face), or the like is appropriately referred to according to the change in absorbance. The degree of dryness estimated by drying estimation calculation unit 87 is reflected in the component application amount by component amount control unit 84 or the heat application amount by heat amount control unit 85 via application amount calculation unit 83. In other words, the component application amount or the heat application amount is corrected for each degree of dryness reflecting various accumulated times.

Further, controller 80 includes part calculation unit 91, initial position determination unit 92, and accumulative calculation unit 88. Part calculation unit 91, initial position determination unit 92, and accumulative calculation unit 88 are a block group for specifying a part of the user's hair to which the component and heat are applied.

Based on the information detected by part detection unit 64 and an initial position determined by initial position determination unit 92, part calculation unit 91 estimates a part of the hair or the skin to which the heat from heat application unit 30 is applied or to which the component from component generation unit 40 is applied.

Initial position determination unit 92 determines an initial position of hair dryer 1, and transmits the initial position to part calculation unit 91.

Accumulative calculation unit 88 calculates, for each part detected by part detection unit 64, an accumulative amount of heat applied by heat application unit 30 and accumulated in the hair or an accumulative component amount applied by component generation unit 40 and accumulated in the hair. In this case, heat amount control unit 85 causes heat application unit 30 to adjust the amount of heat based on the accumulative amount of heat calculated by accumulative calculation unit 88. Specifically, heat amount control unit 85 corrects the heat application amount using data related to the accumulative amount of heat calculated by accumulative calculation unit 88, and controls the operation of heat application unit 30. On the other hand, component amount control unit 84 causes component generation unit 40 to adjust the component amount based on the accumulative component amount calculated by accumulative calculation unit 88. Specifically, component amount control unit 84 corrects the component application amount using data related to the accumulative component amount calculated by accumulative calculation unit 88, and controls the operation of component generation unit 40.

Furthermore, controller 80 is electrically connected to signal processing unit 90 included in measurement unit 50. Signal processing unit 90 controls light irradiation by illumination unit 72, processes an output of wetting detection unit 60 that is wetting detection sensor 60*a*, and transmits the processed output to wetting calculation unit 86 as signal intensity. Further, signal processing unit 90 may transmit the output of wetting detection unit 60 to hair characteristic recognition unit 81 as signal intensity. In this case, hair characteristic recognition unit 81 can classify the hair characteristics of the user based on the signal intensity transmitted from signal processing unit 90.

Further, as shown in FIG. 2, hair dryer 1 includes power supply switch 76. Power supply switch 76 is installed, for example, in housing 20*a* of grip part 20. When a user operates power supply switch 76 to turn a power supply ON, power is supplied to each part of hair dryer 1 via power supply cord 2 extending from an end portion of grip 20. Further, power supply switch 76 can also operate switching between warm air and cold air by heat application unit 30, switching of the air volume, and the like.

Furthermore, hair dryer 1 may include transmitting and receiving unit 74 and storage 75.

Transmitting and receiving unit 74 transmits signals to a communication device outside hair dryer 1 or receives signals transmitted from the communication device outside hair dryer 1 in accordance with a command from controller 80. Here, the communication device outside may be, for example, portable terminal device 100 as shown in FIG. 2. Portable terminal device 100 includes terminal display unit 101, terminal photographing unit 102, and terminal communication unit 103. Terminal display unit 101 is a touch panel screen that displays image 101*a*. Terminal display unit 101 is an output screen that displays information to the user, and is an input screen on which the user instructs or inputs information by touching. Terminal communication unit 103 performs transmission and reception with at least transmitting and receiving unit 74 of hair dryer 1.

Storage 75 is an information storage medium that passes various data with controller 80 and stores these data. The type of the information storage medium is not particularly limited.

Next, an operation of hair dryer 1 will be described.

As a basic operation of hair dryer 1, when the user turns the power supply ON by operating power supply switch 76 while gripping grip part 20, heat application unit 30 starts to operate. Specifically, when motor 32 is driven by electric power supply and fan 31 rotates, air is taken into air blowing flow channel 4 from suction port 10*a*. At the same time, when heating unit 33 generates heat, the air sent from fan 31 is heated. The heated air becomes warm air and is discharged from discharge port 10*b*. Further, when the user appropriately operates input unit 71, hair dryer 1 causes component generation unit 40 to generate an effective component for hair and discharge it from component discharge port 10*f*.

Furthermore, hair dryer 1 automatically optimizes a component application amount to be applied to the hair in accordance with the hair characteristics of the user. Hereinafter, optimization of the component application amount will be specifically described.

To start with, an example of hair characteristics assumed in the present exemplary embodiment will be described.

Figure 6A:
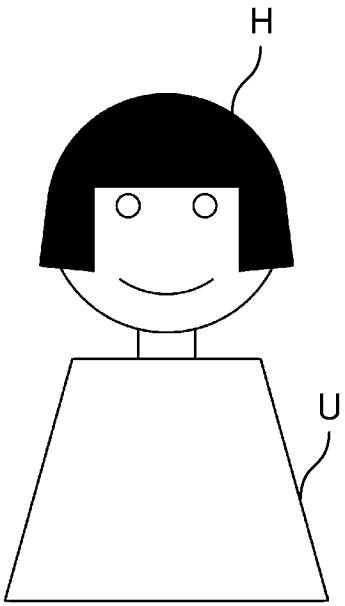
FIG. 6A is a schematic view illustrating hair in a case where a hair characteristic is a length of hair.
Figure 6B:
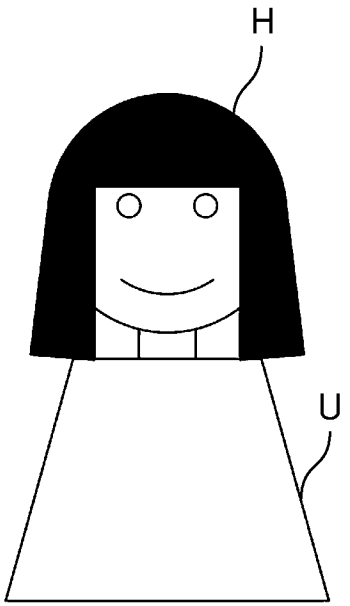
FIG. 6B is a schematic view illustrating hair in a case where the hair characteristic is the length of hair.
Figure 6C:
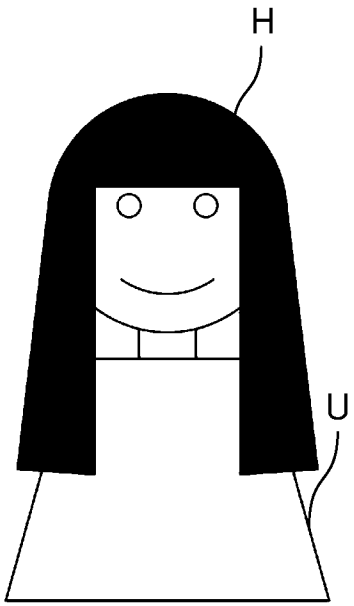
FIG. 6C is a schematic view illustrating hair in a case where the hair characteristic is the length of hair.

FIGS. 6A to 6C are schematic views illustrating the hair H in a case where the hair characteristic of the user U is the length of the hair H. FIG. 6A shows the hair H in a case where the length of the hair H is short. "Short" means, for example, a length in a case where a tip of the hair does not reach the bottom of the chin. FIG. 6B shows the hair H in a case where the length of the hair H is medium. "Medium" means, for example, a length in a case where the tip of the hair is in a range from the shoulder to the clavicle. FIG. 6C shows the hair H in a case where the length of the hair H of the user U is long. "Long" means, for example, a length in a case where the tip of the hair extends longer than the clavicle.

Figure 7A:
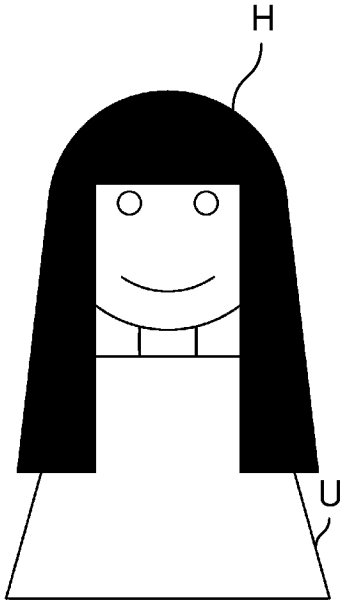
FIG. 7A is a schematic view illustrating hair in a case where the hair characteristic is a hairstyle.
Figure 7B:
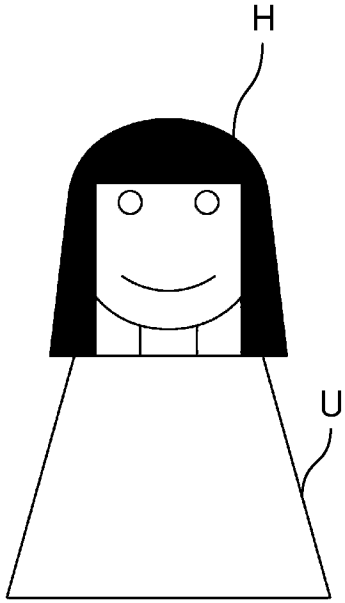
FIG. 7B is a schematic view illustrating hair in a case where the hair characteristic is the hairstyle.
Figure 7C:
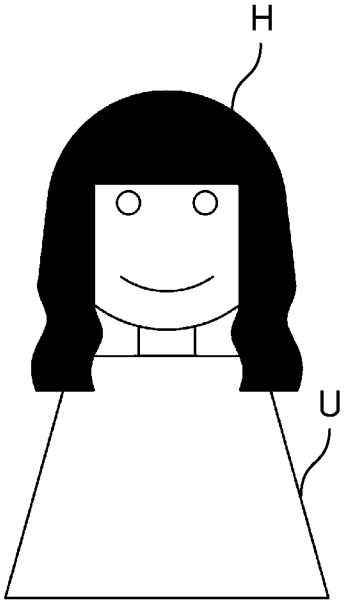
FIG. 7C is a schematic view illustrating hair in a case where the hair characteristic is the hairstyle.
Figure 7D:
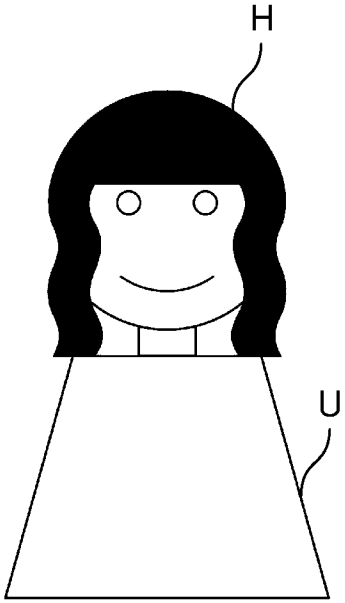
FIG. 7D is a schematic view illustrating hair in a case where the hair characteristic is the hairstyle.

FIGS. 7A to 7D are schematic views illustrating the hair H in a case where the hair characteristic of the user U is a hairstyle. FIG. 7A shows the hair H in a case where the hairstyle is long and straight. FIG. 7B shows the hair H in a case where the hairstyle is short and straight. FIG. 7C shows the hair H in a case where the hairstyle is a perm at the tip of the hair. FIG. 7D shows the hair H in a case where the hairstyle is a perm as a whole.

Figure 8A:
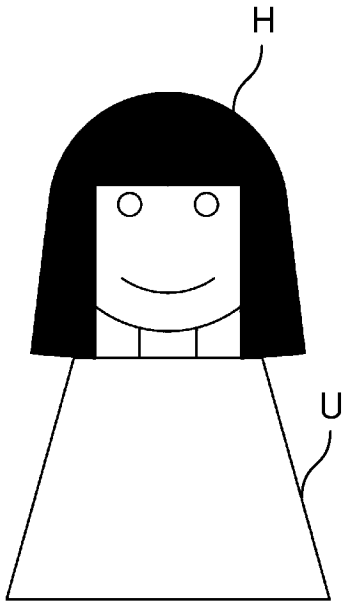
FIG. 8A is a schematic view illustrating hair in a case where the hair characteristic is a volume of hair.
Figure 8B:
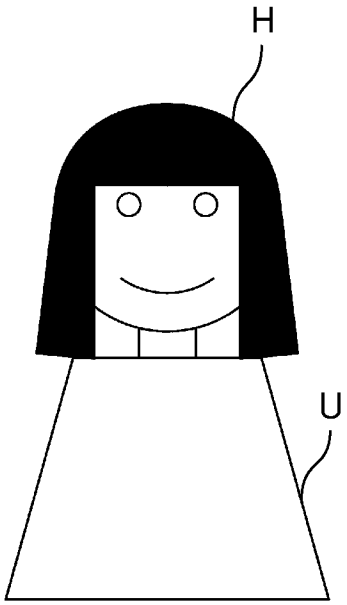
FIG. 8B is a schematic view illustrating hair in a case where the hair characteristic is the volume of hair.
Figure 8C:
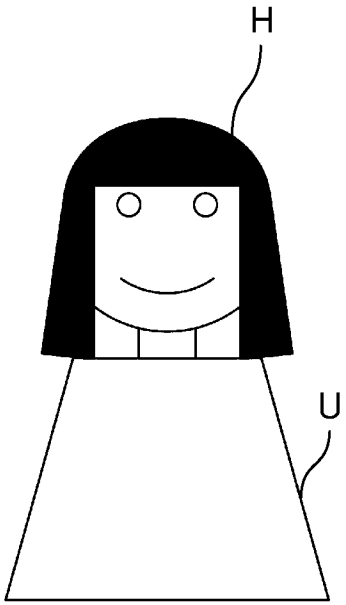
FIG. 8C is a schematic view illustrating hair in a case where the hair characteristic is the volume of hair.

FIGS. 8A to 8C are schematic views illustrating the hair H in a case where the hair characteristic of the user U is the volume of the hair H. FIG. 8A shows the hair H in a case where the volume of the hair H is large. FIG. 8B shows the hair H in a case where the volume of the hair H is normal. FIG. 8C shows the hair H in a case where the volume of the hair H is small.

Figure 9A:
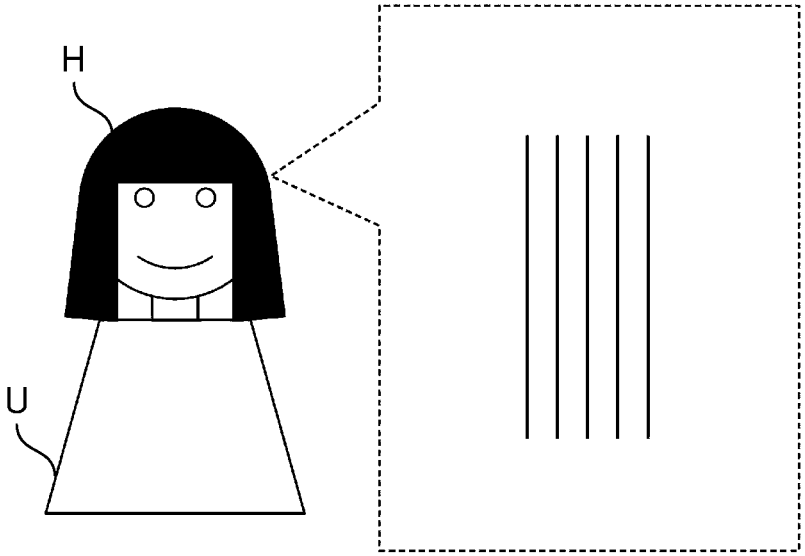
FIG. 9A is a schematic view illustrating hair in a case where the hair characteristic is a thickness of hair.
Figure 9B:
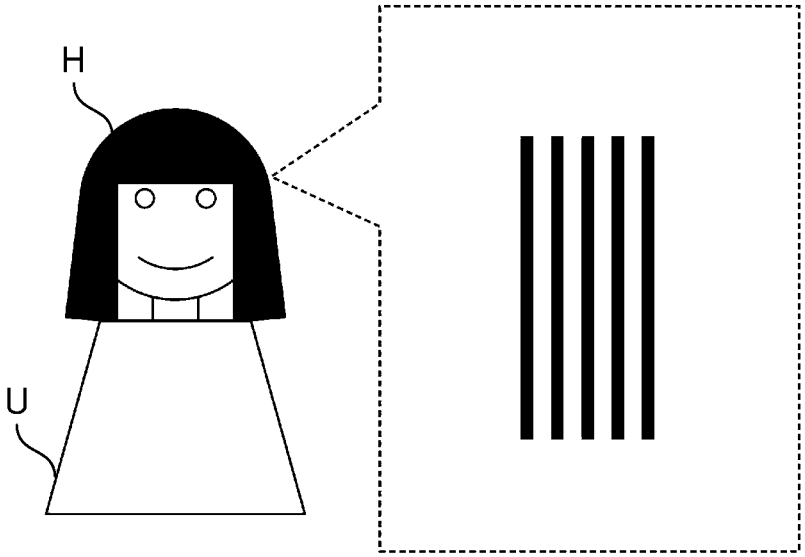
FIG. 9B is a schematic view illustrating hair in a case where the hair characteristic is the thickness of hair.

FIGS. 9A and 9B are schematic views illustrating the hair H in a case where the hair characteristic of the user U is the thickness of the hair H. FIG. 9A shows the hair H in a case where the thickness of the hair H is thin. In a case where the hair H is thin, the hardness of the hair H is generally soft. FIG. 9B shows the hair H in a case where the thickness of the hair H is thick. In a case where the hair H is thick, the hardness of the hair H is generally hard.

Figure 10A:
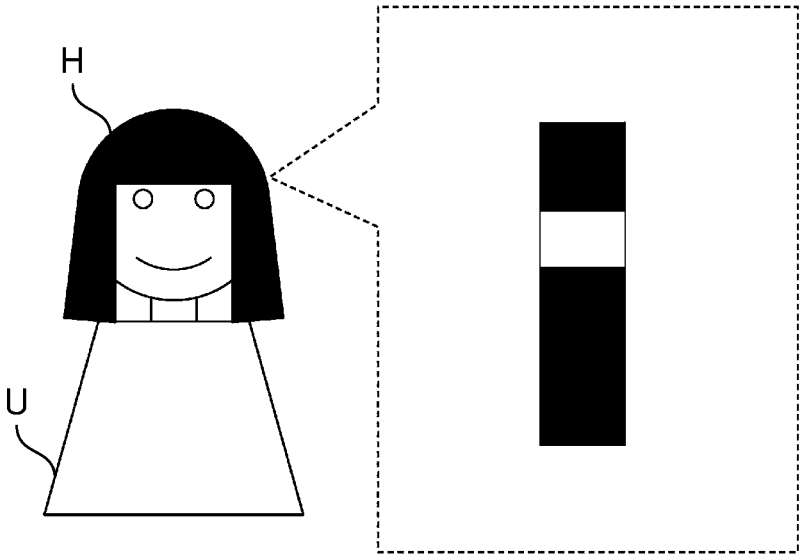
FIG. 10A is a schematic view illustrating hair in a case where the hair characteristic is gloss of hair.
Figure 10B:
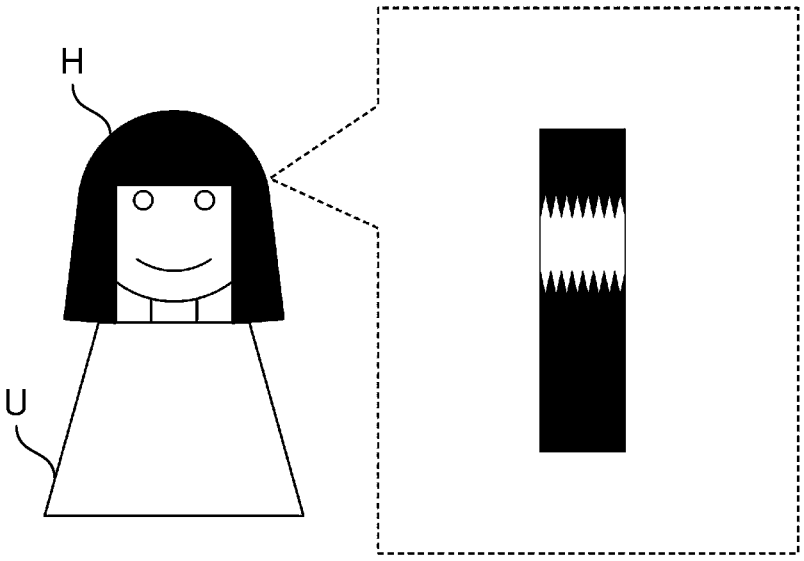
FIG. 10B is a schematic view illustrating hair in a case where the hair characteristic is the gloss of hair.

FIGS. 10A and 9B are schematic views illustrating the hair H in a case where the hair characteristic of the user U is gloss of the hair H. FIG. 10A shows the hair H in a case where the hair H is glossy. In a case where the hair H is glossy, the hair H is generally less damaged. FIG. 10B shows the hair H in a case where the hair H is less glossy. In a case where the hair H is less glossy, the hair H is generally damaged a lot.

Figure 11A:
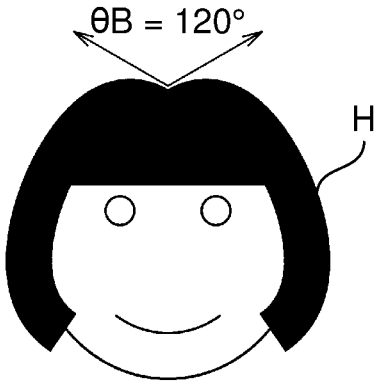
FIG. 11A is a schematic view illustrating a first example of a determination item for a level of the volume of hair.
Figure 11B:
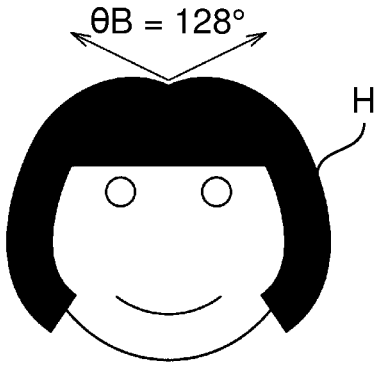
FIG. 11B is a schematic view illustrating the first example of the determination item for the level of the volume of hair.
Figure 11C:
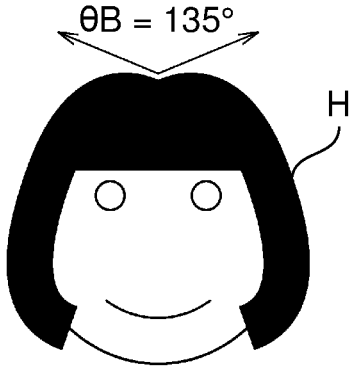
FIG. 11C is a schematic view illustrating the first example of the determination item for the level of the volume of hair.
Figure 11D:
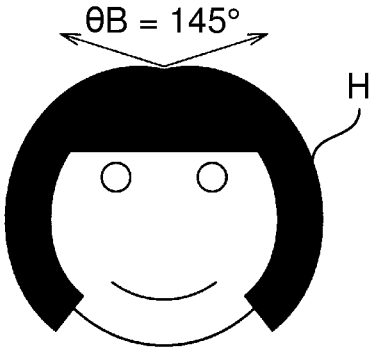
FIG. 11D is a schematic view illustrating the first example of the determination item for the level of the volume of hair.

FIGS. 11A to 11D are schematic views illustrating a first example of a determination item used in determining the level of the volume of the hair H. The determination item in the first example is the angle $\theta_B$ of the part of the hair H. FIG. 11A shows the hair H in a case where the angle $\theta_B$ is for example 120°. FIG. 11B shows the hair H in a case where the angle $\theta_B$ is for example 128°. FIG. 11C shows the hair H in a case where the angle $\theta_B$ is for example 135°. FIG. 11D shows the hair H in a case where the angle $\theta_B$ is for example 145°. When the hair H shown in each of FIGS. 11A to 11D is compared with each other, for the hair H shown in FIG. 11A having the narrowest angle $\theta_B$, the part clearly appears, and thus it may be determined that the volume is large. For each hair H shown in FIGS. 11B and 11C having a medium angle $\theta_B$, it may be determined that the volume is normal. For the hair H shown in FIG. 11D having the widest angle $\theta_B$, since the part does not clearly appear, it may be determined that the volume is small.

Figure 12A:
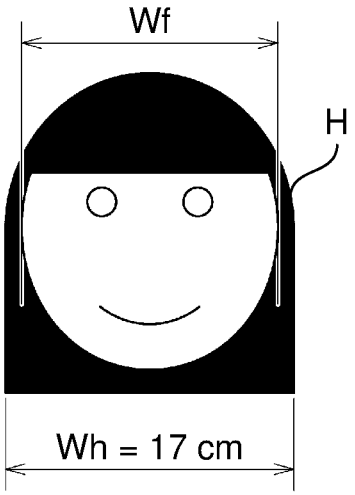
FIG. 12A is a schematic view illustrating a second example of the determination item for the level of the volume of hair.
Figure 12B:
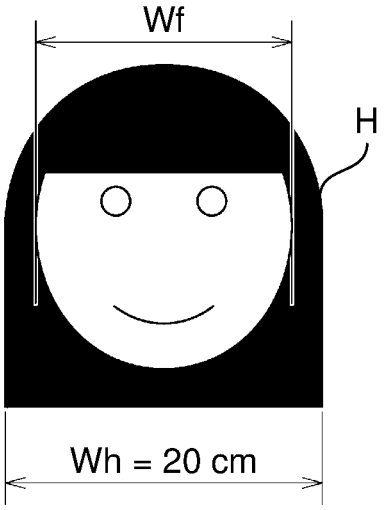
FIG. 12B is a schematic view illustrating the second example of the determination item for the level of the volume of hair.
Figure 12C:
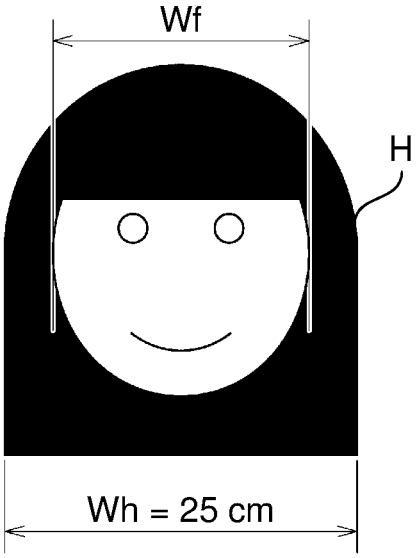
FIG. 12C is a schematic view illustrating the second example of the determination item for the level of the volume of hair.

FIGS. 12A to 12C are schematic views illustrating a second example of the determination item used in determining the level of the volume of the hair H. The determination item in the second example is the ratio of the whole width $W_h$ of the hair H and the width $W_f$ of the face. Here, the width $W_f$ of the face is assumed to be constant, for example, at 15 cm. FIG. 12A shows the hair H in a case where the whole width $W_h$ is 17 cm. In this case, the ratio is 1.13. FIG. 12B shows the hair H in a case where the whole width $W_h$ is 20 cm. In this case, the ratio is 1.33. FIG. 12C shows the hair H in a case where the whole width $W_h$ is 25 cm. In this case, the ratio is 1.66. When the hair H shown in each of FIGS. 12A to 12C is compared with each other, it may be determined that the volume is small for the hair H shown in FIG. 12A having the smallest ratio. For the hair H shown in FIG. 12B having a medium ratio, it may be determined that the volume is normal. For the hair H shown in FIG. 12C having the largest ratio, it may be determined that the volume is large.

For example, hair characteristic recognition unit 81 can classify the hair characteristics of the user U by discriminating each level illustrated in FIGS. 6A to 12C using wetting detection unit 60 in measurement unit 50.

Next, an example of the component amount set by table generation unit 82 for each hair characteristic classified by hair characteristic recognition unit 81 will be described.

FIGS. 13A to 13C are tables illustrating an example of the component amount set for each hair characteristic of each user, that is, for each hair characteristic for the whole hair of the user.

FIG. 13A is a table illustrating a case where the hair characteristic is the volume of hair. For example, a case is considered where the component (a beauty component) acting on hair is charged fine particle water. First, the user selects the volume of hair as the hair characteristic from hair volume input unit 71*c*. For example, controller 80 causes measurement unit 50 to perform measurement necessary for determining the volume of the user's hair via table generation unit 82. Then, hair characteristic recognition unit 81 receives signals from signal processing unit 90, and classifies the current volume of the user's hair. Here, in a case where hair characteristic recognition unit 81 determines that the volume of the hair is normal, table generation unit 82 may not change the component amount set as the default. In a case where hair characteristic recognition unit 81 determines that the volume of the hair is large, table generation unit 82 may increase the component amount to be larger than the default amount. In a case where hair characteristic recognition unit 81 determines that the volume of the hair is small, table generation unit 82 may decrease the component amount to be smaller than the default amount.

On the other hand, when the component acting on hair is negative ions or the like, or when the component acting on hair is an agent or an organic substance, the amount of the component is adjusted based on the same idea. Assuming that the component acting on hair is negative ions, in a case where the volume of hair is normal, table generation unit 82 may not change the default component amount. In a case where the volume of the hair is large, table generation unit 82 may decrease the component amount to be smaller than the default amount. In a case where the volume of the hair is small, table generation unit 82 may increase the component amount to be larger than the default amount. Further, assuming that the component acting on hair is an agent or an organic substance, in a case where the volume of the hair is normal, table generation unit 82 may not apply the component. In a case where the volume of the hair is large, table generation unit 82 may increase the component amount to be larger than the default amount. In a case where the volume of the hair is small, table generation unit 82 may decrease the component amount to be smaller than the default amount.

FIG. 13B is a table illustrating a case where the hair characteristic is the hardness (the thickness) of hair. For example, a case is considered where the component acting on hair is charged fine particle water. First, the user selects the hardness of hair as the hair characteristic from hair quality input unit 71*a*. For example, controller 80 causes measurement unit 50 to perform measurement necessary for determining the hardness of the user's hair via table generation unit 82. Then, hair characteristic recognition unit 81 receives signals from signal processing unit 90, and classifies the current hardness of the user's hair. Here, in a case where hair characteristic recognition unit 81 determines that the hardness or thickness of the hair is normal, table generation unit 82 may not change the component amount set as the default. In a case where hair characteristic recognition unit 81 determines that the hardness of the hair is hard or the thickness of the hair is thick, table generation unit 82 may increase the component amount to be larger than the default amount. In a case where hair characteristic recognition unit 81 determines that the hardness of the hair is soft or the thickness of the hair is thin, table generation unit 82 may decrease the component amount to be smaller than the default amount.

On the other hand, when the component acting on hair is negative ions or the like, or when the component acting on hair is an agent or an organic substance, the amount of the component is adjusted based on the same idea. Assuming that the component acting on hair is negative ions, in a case where the hardness or thickness of the hair is normal, table generation unit 82 may not change the default component amount. In a case where the hardness of the hair is hard or the thickness of the hair is thick, table generation unit 82 may decrease the component amount to be smaller than the default amount. In a case where the hardness of the hair is soft or the thickness of the hair is thin, table generation unit 82 may increase the component amount to be larger than the default amount. Further, assuming that the component acting on hair is an agent or an organic substance, in a case where the hardness or thickness of the hair is normal, table generation unit 82 may not apply the component. In a case where the hardness of the hair is hard or the thickness of the hair is thick, table generation unit 82 may further apply a moisturizing component. In a case where the hardness of the hair is soft or the thickness of the hair is thin, table generation unit 82 may further apply a coating component.

FIG. 13C is a table illustrating a case where the hair characteristic is hair damage (gloss). For example, a case is considered where the component acting on hair is charged fine particle water. First, the user selects hair damage as the hair characteristic from hair quality input unit 71*a*. For example, controller 80 causes measurement unit 50 to perform measurement necessary for determining damage to the user's hair via table generation unit 82. Then, hair characteristic recognition unit 81 receives signals from signal processing unit 90, and classifies the current damage to the user's hair. Here, in a case where hair characteristic recognition unit 81 determines that the hair damage or gloss is normal, table generation unit 82 may not change the component amount set as the default. In a case where hair characteristic recognition unit 81 determines that the hair is greatly damaged or the hair is less glossy, table generation unit 82 may increase the component amount to be larger than the default amount. In a case where hair characteristic recognition unit 81 determines that the hair is less damaged or the hair is glossy, table generation unit 82 may decrease the component amount to be small than the default amount.

On the other hand, when the component acting on hair is negative ions or the like, or when the component acting on hair is an agent or an organic substance, the amount of the component is adjusted based on the same idea. Assuming that the component acting on hair is negative ions, in a case where the hair damage or gloss is normal, table generation unit 82 may not change the default component amount. In a case where the hair is greatly damaged or the hair is less glossy, table generation unit 82 may decrease the component amount to be small than the default amount. In a case where the hair is less damaged or the hair is glossy, table generation unit 82 may increase the component amount to be larger than the default amount. Further, assuming that the component acting on hair is an agent or an organic substance, in a case where the hair damage or gloss is normal, table generation unit 82 may not change the component such as a repair component and a coating component set as the default. In the case where the hair is greatly damaged or the hair is less glossy, table generation unit 82 may increase the default component. In the case where the hair is less damaged or the hair is glossy, table generation unit 82 may decrease the default component.

FIGS. 14A and 14B are tables illustrating an example of the amount of a component set for each part of the user's hair and for each hair condition. Here, the part of the user's hair shall be classified into three parts of the root, the middle, and the tip, as an example. Further, the hair condition is the hair quality as a state detected for each part of the hair, and specifically, is hair damage, alkaline hair, cuticle peeling, an increase in water absorption when the hair is wet, and a decrease in water retention after the hair is dried.

FIG. 14A is a table illustrating a case where the hair condition is hair damage, alkaline hair, cuticle peeling, or an increase in water absorption when wet. First, a case is assumed that hair dryer 1 can apply a repair agent as a component for repairing damage to the user's hair, and controller 80 determines that the hair is greatly damaged. At this time, controller 80 controls component generation unit 40 to apply the repair agent to the root of the hair in an amount smaller than the default component amount. Further, controller 80 controls component generation unit 40 to apply the repair agent to the middle of the hair without changing the default component amount. Furthermore, controller 80 controls component generation unit 40 to apply the repair agent to the tip of the hair in an amount larger than the default component amount.

Further, a case is assumed that hair dryer 1 can apply charged fine particle water as a component for repairing alkaline hair of the user, and controller 80 determines that the user's hair is alkaline hair. At this time, controller 80 controls component generation unit 40 to apply the charged fine particle water to the root of the hair in an amount smaller than the default component amount. Further, controller 80 controls component generation unit 40 to apply the charged fine particle water to the middle of the hair without changing the default component amount. Furthermore, controller 80 controls component generation unit 40 to apply the charged fine particle water to the tip of the hair in an amount larger than the default component amount.

Further, a case is assumed where hair dryer 1 can apply zinc fine particles (metal fine particles) as a component for repairing cuticle peeling occurring in the user's hair, and controller 80 determines that cuticle peeling has occurred. At this time, controller 80 controls component generation unit 40 to apply the zinc fine particles to the root of the hair in an amount smaller than the default component amount. Further, controller 80 controls component generation unit 40 to apply zinc fine particles to the middle of the hair without changing the default component amount. Furthermore, controller 80 controls component generation unit 40 to apply zinc fine particles to the tip of the hair in an amount larger than the default component amount.

Furthermore, a case is assumed that hair dryer 1 can apply charged fine particle water, and controller 80 determines that the amount of water absorption when the user's hair is wet has increased. At this time, controller 80 controls component generation unit 40 to apply the charged fine particle water to the root of the hair without changing the default component amount. Further, controller 80 controls component generation unit 40 to apply the charged fine particle water to the middle and the tip of the hair in an amount larger than the default component amount.

FIG. 14B is a table illustrating a case where the hair condition is a decrease in water retention after the hair is dried. First, a case is assumed that hair dryer 1 can apply a treatment agent as a component for compensating for a decrease in water retention, and controller 80 determines that the water retention after the hair is dried has decreased. At this time, controller 80 controls component generation unit 40 to apply the treatment agent to the root of the hair in an amount smaller than the default component amount. Further, controller 80 controls component generation unit 40 to apply the treatment agent to the middle of the hair without changing the default component amount. Furthermore, controller 80 controls component generation unit 40 to apply the treatment agent to the tip of the hair in an amount larger than the default component amount.

Further, a case is assumed that hair dryer 1 can apply a moisturizing component as a component for compensating for a decrease in water retention, and controller 80 determines that the amount of water retention after the hair is dried has decreased. At this time, controller 80 controls component generation unit 40 to apply the moisturizing component to the root of the hair without changing the default component amount. Further, controller 80 controls component generation unit 40 to apply the moisturizing component to the middle and the tip of the hair in an amount larger than the default component amount.

Further, a case is assumed that hair dryer 1 can apply a coating agent as a component for compensating for a decrease in water retention, and controller 80 determines that the amount of water retention after the hair is dried has decreased. At this time, controller 80 controls component generation unit 40 to apply the coating agent to the root and the middle of the hair in an amount smaller than the default component amount. Further, controller 80 controls component generation unit 40 to apply the coating agent to the tip of the hair without changing the default component amount.

Furthermore, a case is assumed that hair dryer 1 can apply charged fine particle water as a component for compensating for a decrease in the amount of water retention, and controller 80 determines that the amount of water retention after the hair is dried has decreased. At this time, controller 80 controls component generation unit 40 to apply the charged fine particle water to the root of the hair without changing the default component amount. Further, controller 80 controls component generation unit 40 to apply the charged fine particle water to the middle and the tip of the hair in an amount larger than the default component amount.

Next, an example of timing related to the component applied by component generation unit 40 or the heat applied by heat application unit 30 with the drying time as a time series, will be described.

Figure 15:
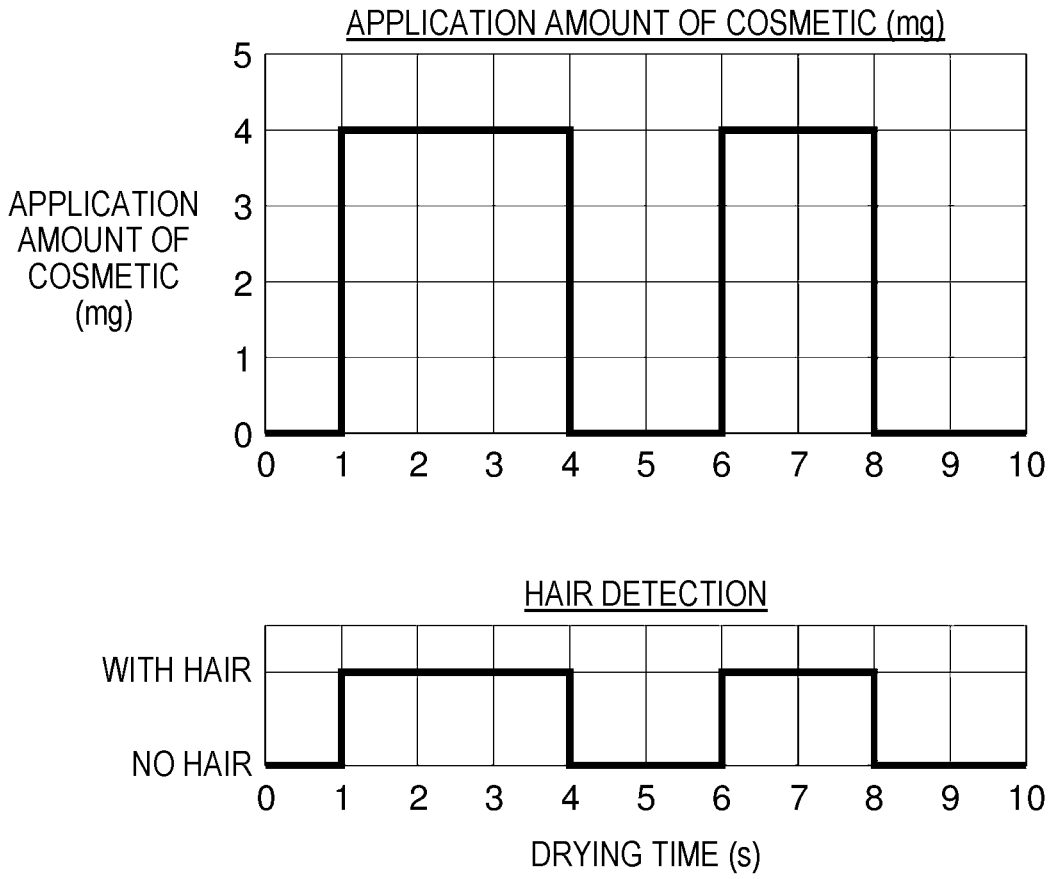
FIG. 15 is a timing chart illustrating an example of a relationship between an application amount of a cosmetic and hair detection.

FIG. 15 is a timing chart illustrating an example of a relationship between an application amount of a cosmetic and detection of the user's hair. An upper diagram shows the application amount (mg) of the cosmetic relative to the drying time (seconds). Hereinafter, the cosmetic is collectively referred to as various components illustrated above as an agent and an organic substance. Here, as an example, the application amount when the cosmetic is applied is constant at 4 mg. A lower diagram shows whether or not hair is detected relative to the drying time (seconds). In FIG. 15, the drying time, being a horizontal axe in the upper diagram and the lower diagram, corresponds to each other. Controller 80 determines existence or non-existence of hair based on, for example, the output signal of hair detection unit 63. Here, when hair is present, it means a case where air blown from hair dryer 1 blows against the user's hair. On the other hand, when there is no hair, it means a case where air blown from hair dryer 1 does not blow against the user's hair. In other words, as shown in FIG. 15, controller 80 may cause component generation unit 40 to apply the cosmetic only when determining that hair is present.

Figure 16:
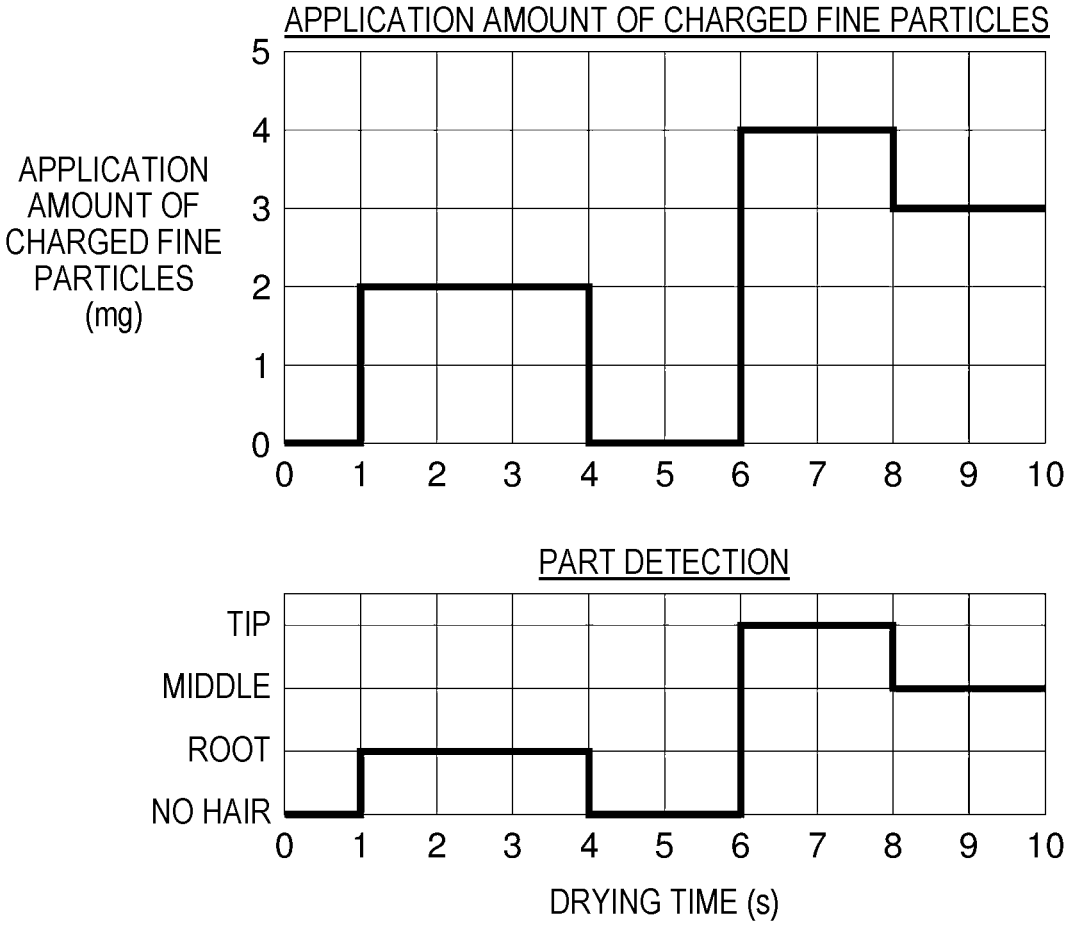
FIG. 16 is a timing chart illustrating an example of the relationship between the application amount of charged fine particles and part detection.

FIG. 16 is a timing chart illustrating an example of a relationship between the application amount of charged fine particles and part detection of the user's hair. The upper diagram shows the application amount (mg) of the charged fine particles relative to the drying time (seconds). The lower diagram shows part detection of the hair relative to the drying time (seconds). In FIG. 16, the drying times, which are the horizontal axe in the upper diagram and the lower diagram, correspond to each other. Controller 80 determines a part in contact with charged fine particle water discharged from hair dryer 1 based on, for example, the output signal of part detection unit 64. Here, as shown in FIG. 16, controller 80 does not cause component generation unit 40 to generate charged fine particle water while determining that there is no hair. On the other hand, controller 80 causes component generation unit 40 to apply charged fine particle water containing, for example, 2 mg of charged fine particles, while air is blown against the root of the hair to dry the hair. Further, controller 80 causes component generation unit 40 to apply charged fine particle water containing, for example, 3 mg of charged fine particles, while air is blown against the middle of the hair to dry the hair. Furthermore, controller 80 causes component generation unit 40 to apply charged fine particle water containing, for example, 4 mg of charged fine particles, while air is blown against the tip of the hair to dry the hair. In other words, controller 80 may decrease the application amount of the charged fine particle water to the root side of the hair and increase the application amount of the charged fine particle water to the tip side of the hair.

Figure 17:
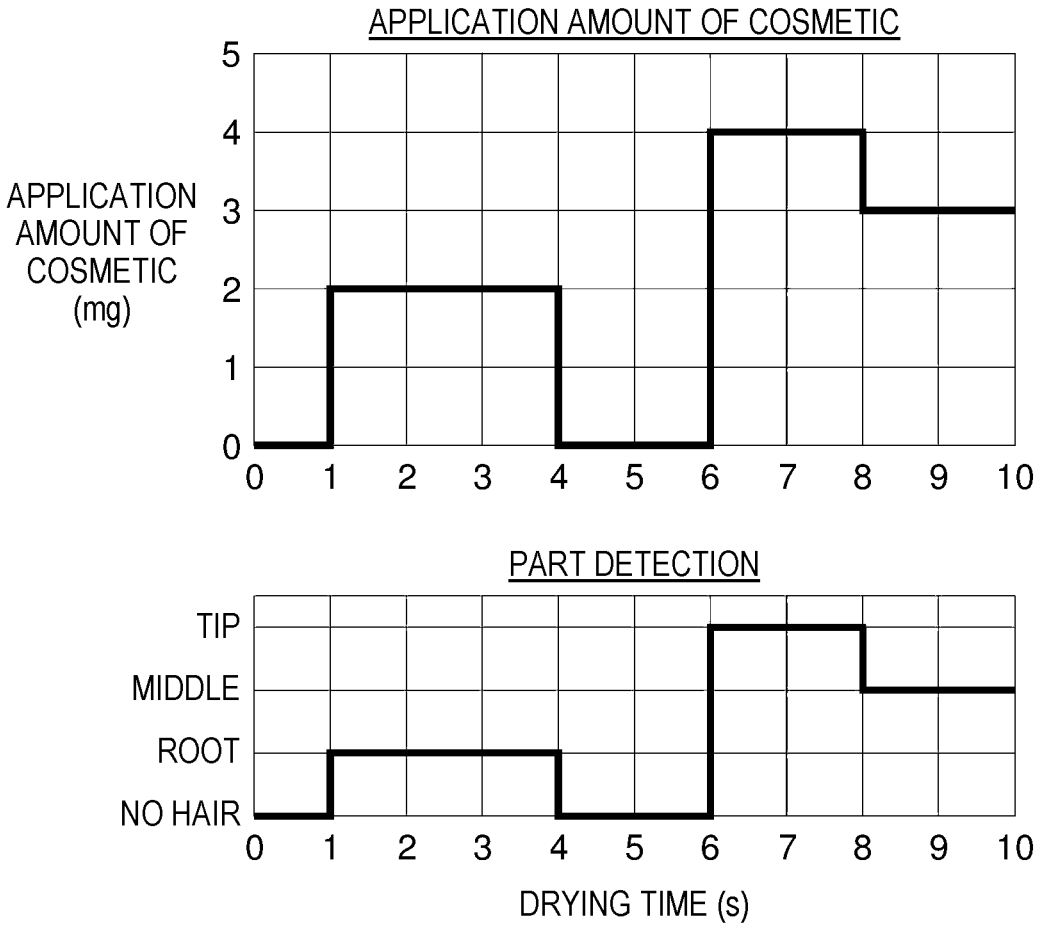
FIG. 17 is a timing chart illustrating an example of the relationship between the application amount of the cosmetic and part detection.

FIG. 17 is a timing chart illustrating an example of a relationship between the application amount of a cosmetic and part detection of the user's hair. An upper diagram shows the application amount (mg) of the cosmetic relative to the drying time (seconds). The lower diagram shows part detection of the hair relative to the drying time (seconds). In FIG. 17, the drying times, which are the horizontal axe in the upper diagram and the lower diagram, correspond to each other. Controller 80 determines a part in contact with the cosmetic discharged from hair dryer 1 based on, for example, the output signal of part detection unit 64. Here, as shown in FIG. 17, controller 80 does not cause component generation unit 40 to generate the cosmetic while determining that there is no hair. On the other hand, controller 80 causes component generation unit 40 to apply, for example, 2 mg of the cosmetic, while air is blown against the root of the hair to dry the hair. Further, controller 80 causes component generation unit 40 to apply, for example, 3 mg of the cosmetic, while air is blown against the middle of the hair to dry the hair. Furthermore, controller 80 causes component generation unit 40 to apply, for example, 4 mg of the cosmetic, while air is blown against the tip of the hair to dry the hair. In other words, controller 80 may decrease the application amount of the cosmetic to the root side of the hair and increase the application amount of the cosmetic to the tip side of the hair.

Figure 18:
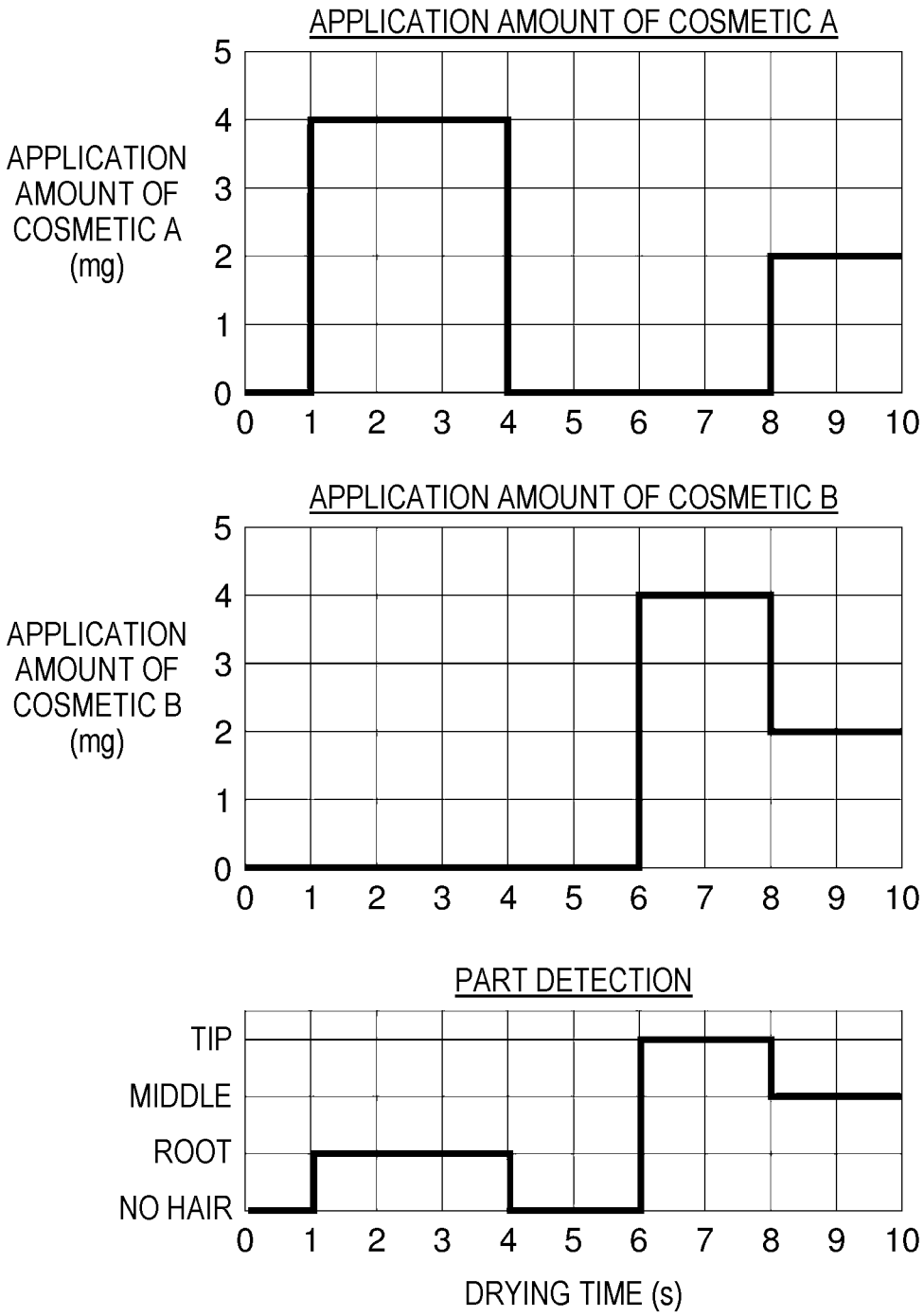
FIG. 18 is a timing chart illustrating an example of the relationship between application amounts of two kinds of cosmetics and part detection.

FIG. 18 is a timing chart illustrating an example of a relationship between the application amounts of two kinds of cosmetics A and B and part detection of the user's hair. The upper diagram shows the application amount (mg) of the cosmetic A relative to the drying time (seconds). The middle diagram shows the application amount (mg) of the cosmetic B relative to the drying time (seconds). The cosmetic A and the cosmetic B are components different from each other. The cosmetic A is a component that effectively acts on hair characteristics, especially at the root of hair. The cosmetic B is a component that effectively acts on hair characteristics, especially at the tip of hair. The lower diagram shows part detection of the hair relative to the drying time (seconds). In FIG. 18, the drying times, which are the horizontal axe in the upper diagram, the middle diagram, and the lower diagram, correspond to one another. Controller 80 determines a part in contact with the cosmetic A or cosmetic B discharged from hair dryer 1 based on, for example, the output signal of part detection unit 64. Here, as shown in FIG. 18, controller 80 does not cause component generation unit 40 to generate either cosmetic A or cosmetic B while determining that there is no hair. On the other hand, controller 80 causes component generation unit 40 to apply, for example, only 4 mg of the cosmetic A, while air is blown against the root of the hair to dry the hair. Further, controller 80 causes component generation unit 40 to apply, for example, 2 mg of the cosmetic A and 2 mg of the cosmetic B, while air is blown against the middle of the hair to dry the hair. Furthermore, controller 80 causes component generation unit 40 to apply, for example, 4 mg of the cosmetic B, while air is blown against the tip of the hair to dry the hair. In other words, controller 80 may particularly apply the cosmetic A effective for the root to the root of the hair, and particularly apply the cosmetic B effective for the tip to the tip of the hair.

Figure 19:
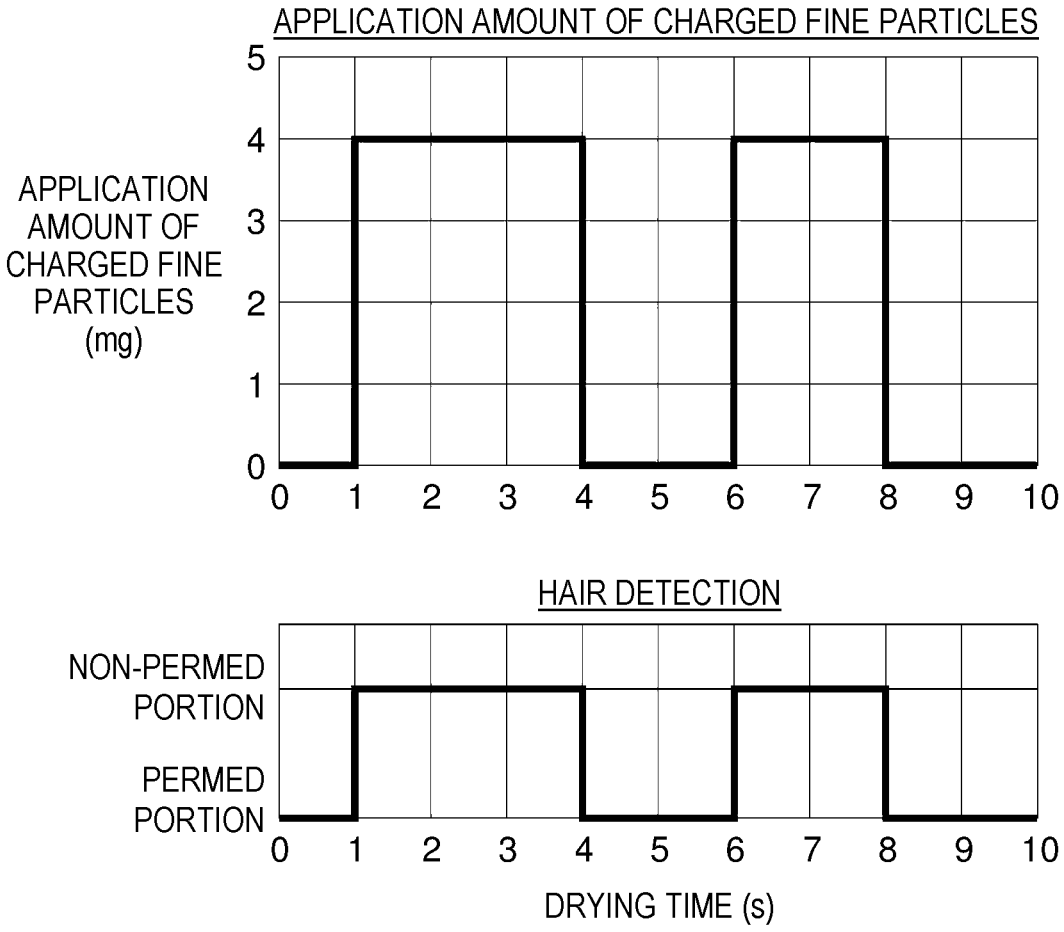
FIG. 19 is a timing chart illustrating an example of the relationship between the application amount of charged fine particles and detection of a permed portion.

FIG. 19 is a timing chart illustrating an example of the relationship between the application amount of charged fine particles and detection of a permed portion, which is adopted in a case where the user's hairstyle is a partial perm. The upper diagram shows the application amount (mg) of the charged fine particles relative to the drying time (seconds). Here, as an example, the application amount when charged fine particle water is applied is constant at 4 mg. The lower diagram shows whether the hair is a permed portion or a non-permed portion as a result of hair detection relative to a drying time (seconds). In FIG. 19, the drying times, which are the horizontal axe in the upper diagram and the lower diagram, correspond to each other. Controller 80 determines whether a part of the hair to be blown is a permed portion or a non-permed portion based on, for example, the output signal of wetting detection unit 60. As shown in FIG. 19, controller 80 may cause component generation unit 40 to apply the charged fine particle water only when determining that a part of the hair to be blown is a non-permed portion. As a result, hair dryer 1 can suppress elongation of the permed portion caused by moisture in advance.

Figure 20:
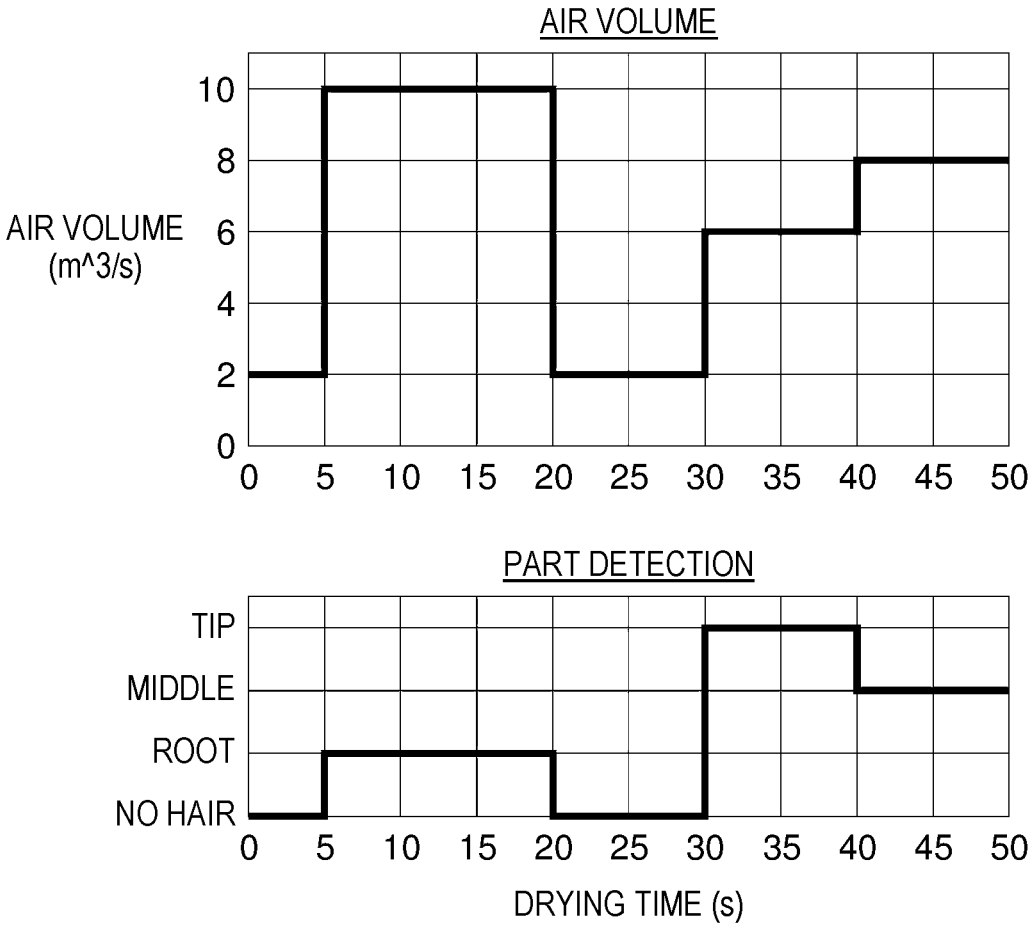
FIG. 20 is a timing chart illustrating an example of the relationship between an air volume and part detection.

FIG. 20 is a timing chart illustrating an example of a relationship between the air volume and part detection of the user's hair. The upper diagram shows the air volume ($m^3/s$) relative to the drying time (seconds). The lower diagram shows part detection of the hair relative to the drying time (seconds). In FIG. 20, the drying times, which are the horizontal axe in the upper diagram and the lower diagram, correspond to each other. Controller 80 determines a part that is blown by air from hair dryer 1 based on, for example, the output signal of part detection unit 64. Here, as shown in FIG. 20, controller 80 causes heat application unit 30 to blow air at an air volume of, for example, 2 ($m^3/s$) while determining that there is no hair. On the other hand, controller 80 causes heat application unit 30 to blow air at an air volume of, for example, 10 ($m^3/s$), while air is blown against the roots of the hair to dry the hair. Further, controller 80 causes heat application unit 30 to blow air at an air volume of, for example, 8 ($m^3/s$) while air is blown against the middle of the hair to dry the hair. Furthermore, controller 80 causes heat application unit 30 to blow air at an air volume of, for example, 6 ($m^3/s$), while air is blown against the tip of the hair to dry the hair. In other words, controller 80 may increase the air volume toward the root side of the hair and decrease the air volume toward the tip side of the hair. Note that, controller 80 may cause heat application unit 30 not to blow air while determining that there is no hair.

Next, an input screen on which a user inputs information and an output screen that displays information to the user will be described. In the present exemplary embodiment, display 73 is installed in housing 3 of main body 10. Therefore, an input screen and an output screen may be displayed on display 73. On the other hand, in a case where hair dryer 1 includes transmitting and receiving unit 74 that performs transmission and reception of various types of information with portable terminal device 100, an input screen and an output screen may be displayed on terminal display unit 101 of portable terminal device 100 instead of display 73. In other words, as long as hair dryer 1 includes transmitting and receiving unit 74, display 73 may not be included. In the following description, a case where an input screen and an output screen are displayed on terminal display unit 101 of portable terminal device 100 will be illustrated.

Figure 21A:
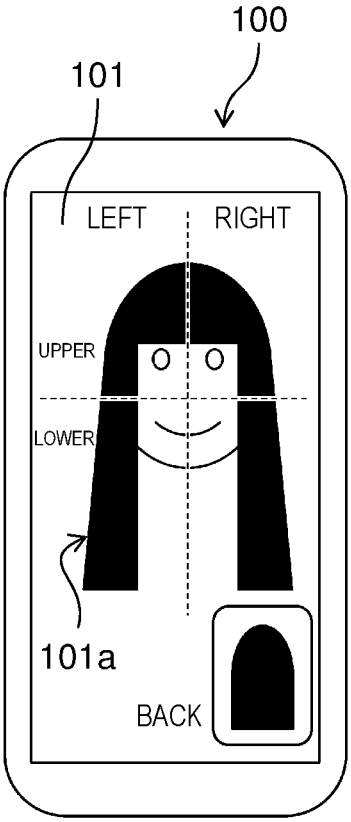
FIG. 21A is a view illustrating a first input screen of a first example of an input screen.
Figure 21B:
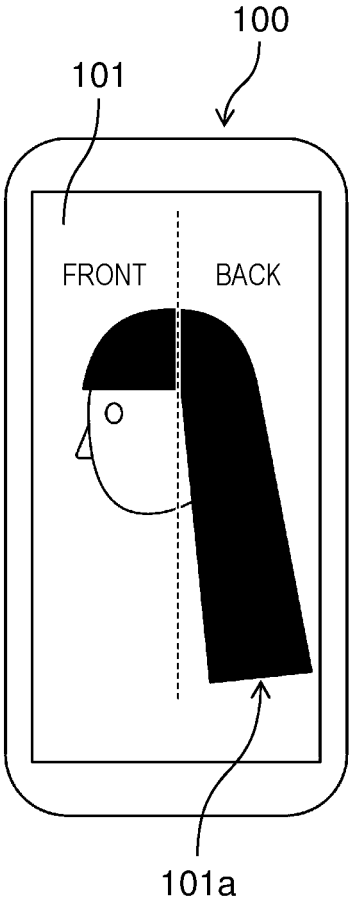
FIG. 21B is a view illustrating a second input screen of the first example of the input screen.
Figure 21C:
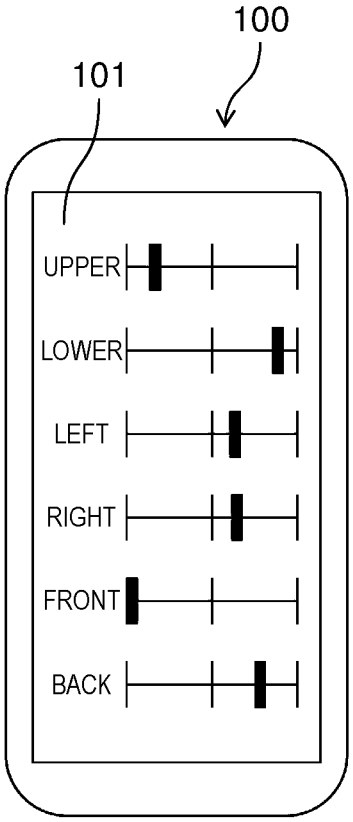
FIG. 21C is a view illustrating a third input screen of the first example of the input screen.

FIGS. 21A to 21C are schematic views illustrating a first example of the input screen displayed on the terminal display unit 101 (or display 73). FIG. 21A shows a first input screen according to the first example. Image 101*a* displayed on the first input screen is a schematic view of the user's front hairstyle, and is a divided image divided into upper, lower, left, and right. On the first input screen, a schematic drawing of the user's rear hairstyle is also displayed. FIG. 21B illustrates a second input screen of the first example. Image 101*a* displayed on the second input screen is a schematic view of the user's side hairstyle, and is a divided image divided into front and rear. FIG. 21C shows a third input screen of the first example. On the third input screen, a level adjustment screen for the user to change the setting of a certain item is displayed for each area of the divided screens displayed on the first input screen and the second input screen.

Figure 22A:
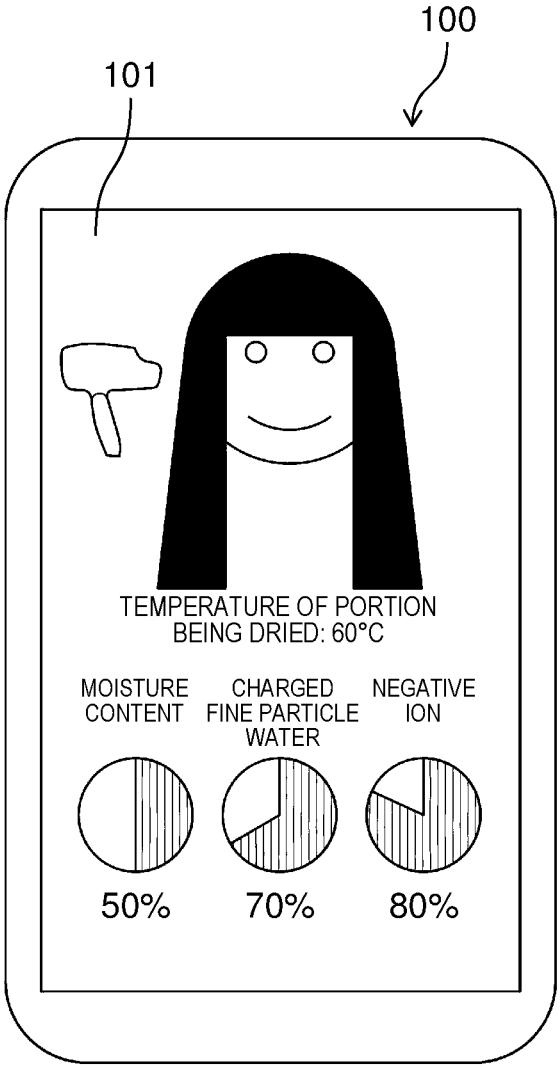
FIG. 22A is a view illustrating a first example of an output screen at the time when the middle of hair is dried.
Figure 22B:
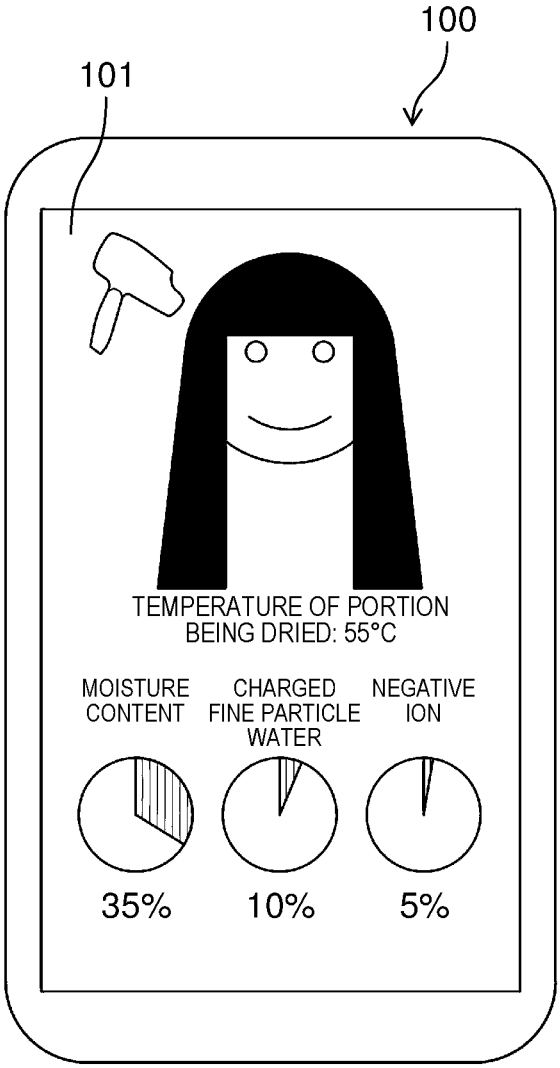
FIG. 22B is a view illustrating a first example of the output screen at the time when the root of hair is dried.

FIGS. 22A and 22B are schematic views illustrating a first example of the output screen displayed on terminal display unit 101 (or display 73). The output screen of the first example displays various states in real time related to a period in which hair dryer 1 is drying hair or a period in which hair dryer 1 is applying a component to hair. FIG. 22A is an output screen at the time when the middle of the hair is dried. FIG. 22B is an output screen at the time when the root of the hair is dried. Display items on the output screen of the first example are, for example, a part of the hair being dried, a temperature of the part being dried (a temperature of a portion being dried), the moisture content in the hair, and the amount of the component being applied, respectively, at the present time. In this example, the component amounts of charged fine particle water and negative ions are displayed as the amount of a component. As shown in FIGS. 22A and 22B, the part of the hair being dried may be visually indicated to the user by displaying a schematic drawing of a hair dryer relative to the schematic drawing of the hair. Similarly, the moisture content and the amount of a component may be visually indicated to the user by displaying a pie chart, for example, in addition to numerical values.

Figure 23:
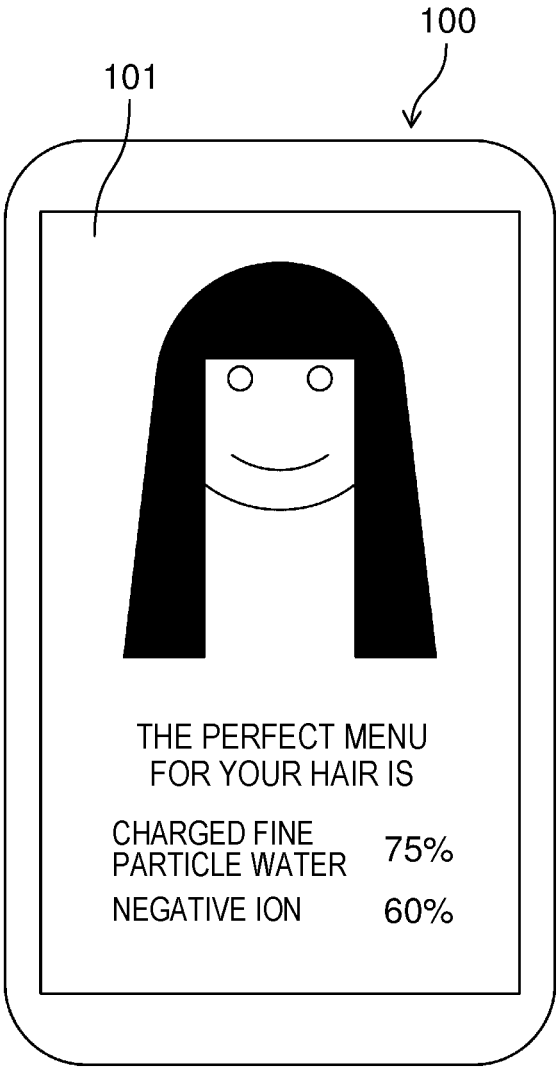
FIG. 23 is a view illustrating a second example of the output screen.

FIG. 23 is a schematic view illustrating a second example of the output screen displayed on terminal display unit 101 (or display 73). The output screen of the second example displays various states in non-real time after hair dryer 1 dries at least a part of the hair or applies a component to at least a part of the hair. As shown in FIG. 23, as a result of using hair dryer 1 by the user, the amount of a component effective for the hair of the user may be displayed. In this example, the component amounts of charged fine particle water and negative ions are displayed.

Figure 24A:
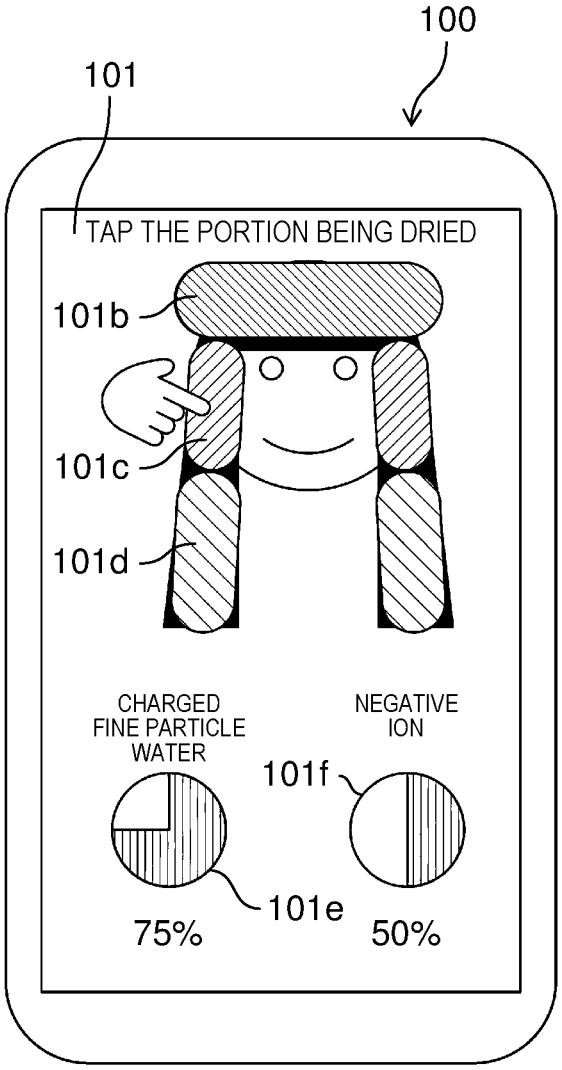
FIG. 24A is a view illustrating a third example of the output screen.
Figure 24B:
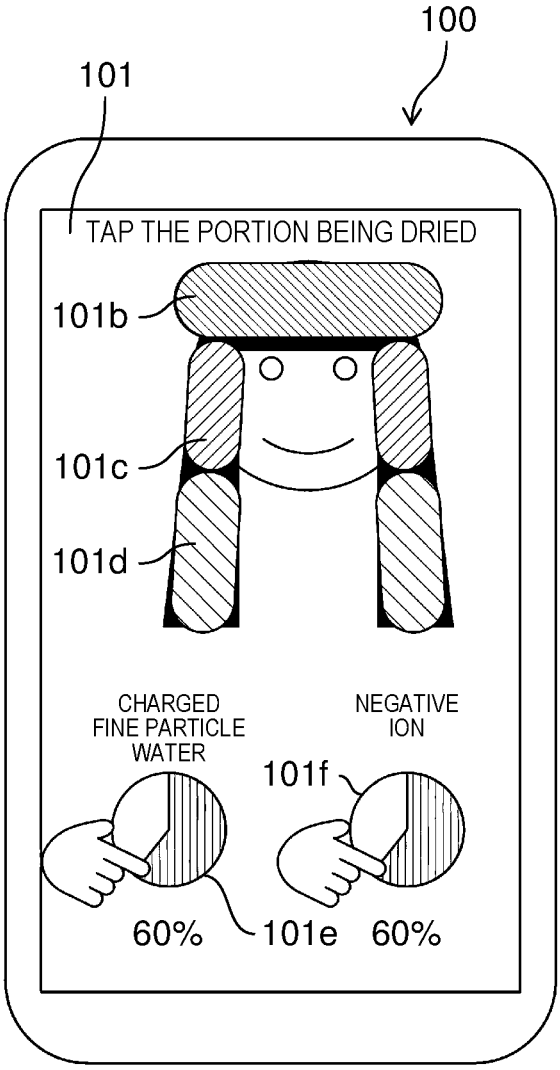
FIG. 24B is a view illustrating a third example of the output screen.

FIGS. 24A and 24B are schematic views illustrating a third example of the output screen displayed on terminal display unit 101 (or display 73). The output screen of the third example displays various states in non-real time, similarly to the output screen of the second example. Further, the output screen of the third example displays the component amount for each part of the user's hair, and displays the part of the hair and the component amount for each part such that the user can change them. First, on the output screen of the third example, a schematic drawing of the user's hair with three types of tap areas is displayed. First tap area 101*b* corresponds to a part at the root of the hair. Second tap area 101*c* corresponds to a part at the middle of the hair. Third tap area 101*d* corresponds to a part at the tip of the hair. Further, on the output screen of the third example, the component amount at the present time is displayed in a pie chart, for example, in addition to numerical values. For example, first pie chart 101*e* indicates the component amount of charged fine particle water. Second pie chart 101*f* indicates the component amount of negative ions. FIG. 24A shows, as an example, a state in which the user selects the middle as the part of the hair for which the amount of a component is desired to be changed by the subsequent operation of hair dryer 1. In this case, the user can select the middle by tapping second tap area 101*c* on the third output screen. FIG. 24B shows, as an example, a state in which the user inputs a component amount to be newly set when the user wants to change the component amount by the subsequent operation of hair dryer 1. The user can set a desired component amount by changing the display value while tapping first pie chart 101*e* and second pie chart 101*f* on the third output screen.

Figure 25:
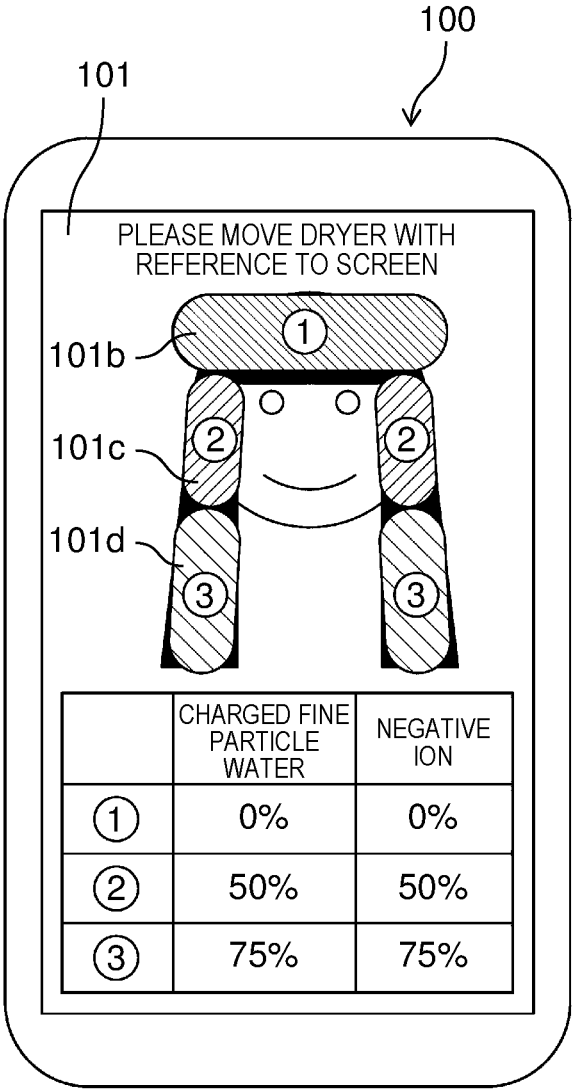
FIG. 25 is a view illustrating a fourth example of the output screen.

FIG. 25 is a schematic view illustrating a fourth example of the output screen displayed on terminal display unit 101 (or display 73). The output screen of the fourth example displays various states in non-real time, similarly to the output screen of the third example. On the output screen of the third example shown in FIG. 24A, when any one of first tap area 101*b*, second tap area 101*c*, and third tap area 101*d* is tapped, the component amount at the part corresponding to that area is displayed. On the other hand, on the output screen of the fourth example, the component amount for each part of the hair are collectively displayed, and the order of the parts to which the user should apply heat or a component by hair dryer 1 is displayed with numerals. The user can efficiently apply a desired component by moving hair dryer 1 so as to apply heat or a component in the order of the numbers attached to each of first tap area 101*b*, second tap area 101*c*, and third tap area 101*d*.

Figure 26A:
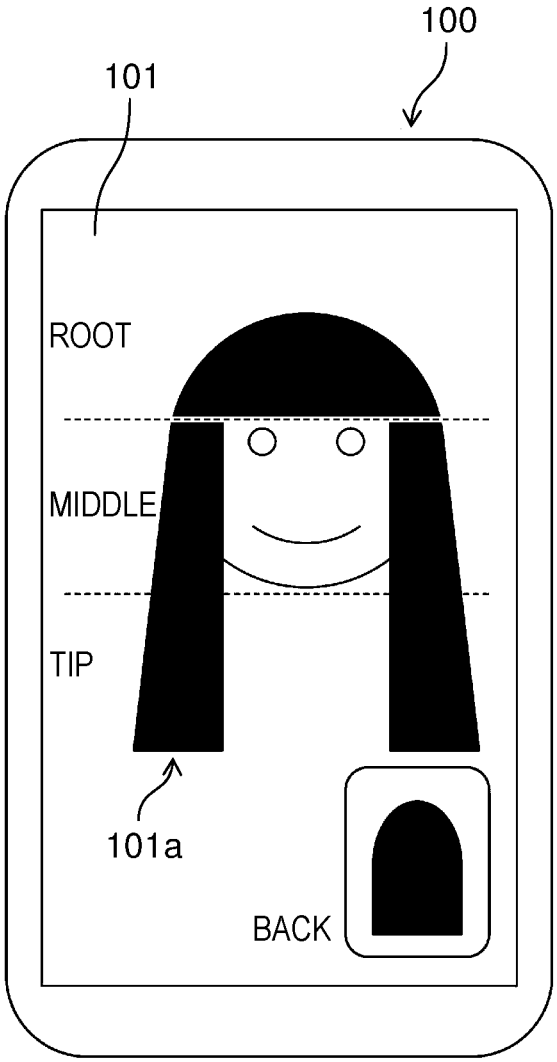
FIG. 26A is a view illustrating a first input screen of a second example of the input screen.
Figure 26B:
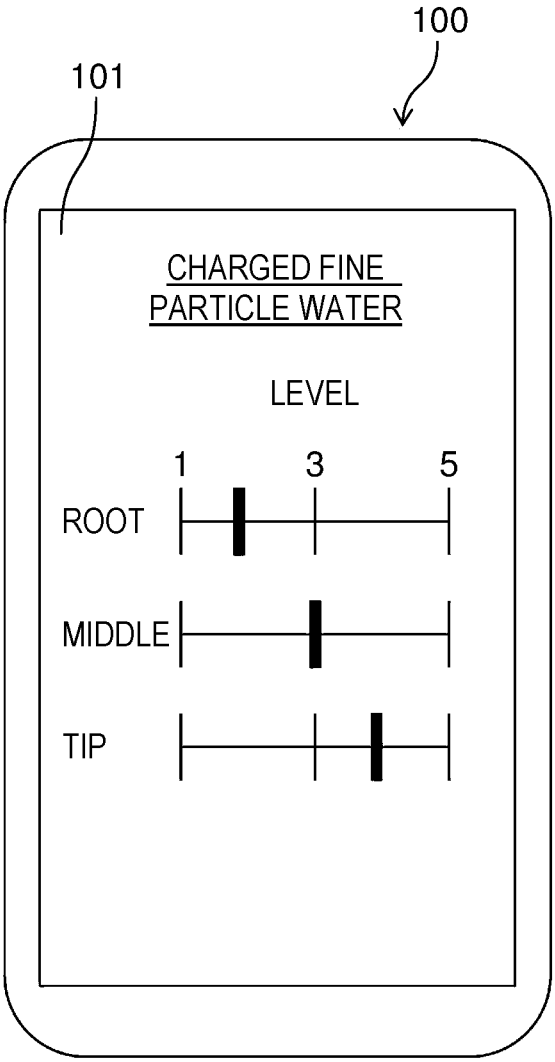
FIG. 26B is a view illustrating a second input screen of the second example of the input screen.

FIGS. 26A and 26B are schematic views illustrating a second example of the input screen displayed on terminal display unit 101 (or display 73). The input screen of the second example corresponds to a case where the user changes the component to be applied to each part of the hair. FIG. 26A illustrates a first input screen of the second example. Image 101*a* displayed on the first input screen is a schematic view of the user's front hairstyle, and is a divided image divided into three parts of the root, the middle, and the tip in the vertical direction. On the first input screen, a schematic drawing of the user's rear hairstyle is also displayed. FIG. 26B shows a second input screen of the second example. On the second input screen, a level adjustment screen for the user to change the setting of charged fine particle water is displayed for each area of the divided screen displayed on the first input screen. In a case where the user wants to change charged fine particle water to his or her desired component amount instead of the component amount set by controller 80, first, on the first input screen, three parts in which the amount of the component can be changed in the hair are presented as image 101*a*. Next, the user can display the second input screen and change the component amount of the charged fine particle water at a plurality of levels so that the component amount of the charged fine water particles becomes a desired component amount for each part.

FIG. 27 is a table illustrating a setting example in a case where the component amount is changed for each part of the hair using the input screen of the second example shown in FIG. 26B. In a case where the component to be changed is charged fine particle water as illustrated in FIG. 26B, for example, when the level of the charged fine water particles applied to the roots of the hair before the change is "2," the user may increase the level to "3" by using the input screen of the second example according to his or her preference. The user can change the component amount of the charged fine particle water to a desired component amount by changing the level in the same way in the middle or the tip of the hair, which are other parts of the hair. Further, the user can change the component amount of not only the charged fine particle water but also other components such as negative ions, an agent, and an organic matter, using the input screen of the second example in the same way.

Next, how controller 80 estimates the degree of dryness of the hair when the user's hair is being dried will be described.

FIG. 28 is a chart illustrating several principles that can be used to determine whether the hair is wet or dry. To start with, in the present exemplary embodiment, the degree of dryness of the hair is estimated by drying estimation calculation unit 87 based on the wetting information calculated by wetting calculation unit 86. Further, in the present exemplary embodiment, wetting detection unit 60 is specifically wetting detection sensor 60*a* that is a photodiode. The wetting information is the absorbance calculated by wetting calculation unit 86 based on the signal intensity from wetting detection sensor 60*a*. As shown in the upper column of FIG. 28, in a case where the hair is wet, a large amount of light is absorbed by the hair when the hair is irradiated with light from illumination unit 72, so that reflected light received by wetting detection sensor 60*a* is decreased. On the other hand, in a case where the hair is dry, the amount of light absorbed by the hair is small when the hair is irradiated with light from illumination unit 72, so that the reflected light received by wetting detection sensor 60*a* does not decrease. That is, drying estimation calculation unit 87 can estimate the degree of dryness, in other words, whether the hair is wet or dry, based on the change in absorbance.

Further, as another principle, the degree of dryness of the hair may be calculated by machine learning using a bundle state of the hair as wetting information. In this case, wetting detection unit 60 is a photographing unit such as a camera that photographs hair. Wetting calculation unit 86 is a machine learning calculation unit that discriminates the bundle state of the hair based on a hair image photographed by wetting detection unit 60. As shown in the middle column of FIG. 28, in a case where the hair is wet, the hair is stuck together and bundled. On the other hand, in a case where the hair is dry, the hair is separated and independent from each other. In other words, drying estimation calculation unit 87 can estimate the degree of dryness based on the bundle state of the hair discriminated by machine learning calculation unit.

Furthermore, the degree of dryness of the hair may be calculated by wetting calculation unit 86 using the temperature of the hair as wetting information. In this case, wetting detection unit 60 is a temperature sensor. The temperature sensor may be, for example, an infrared thermometer (an infrared sensor). Wetting calculation unit 86 calculates a temperature as wetting information based on the hair measurement value measured by wetting detection unit 60. As shown in the lower column of FIG. 28, in a case where the hair is wet, when warm air is sent from discharge port 10*b* toward the hair, the temperature of the surface of the hair is less likely to rises and easily cools down, so that a temperature change is small. On the other hand, in a case where the hair is dry, when warm air is sent from discharge port 10*b* toward the hair, the temperature of the surface of the hair easily rises and is less likely to cool down, so that the temperature change is large. In other words, drying estimation calculation unit 87 can estimate the degree of dryness based on the change in the temperature of the hair.

FIG. 29 is a table illustrating specific criteria for determining whether hair is wet or dry, corresponding to FIG. 28. To start with, when a determination is made based on the change in absorbance as in the present exemplary embodiment, as shown in the upper column of FIG. 29, it may be determined that the hair is wet when the absorbance is 70% to 30%, while it may be determined that the hair is dry when the absorbance is 29% to 10%. Further, when the determination is made based on the bundle state of the hair, the determination may be made according to the result of the machine learning as shown in the middle columns of FIGS. 28 and 29. Furthermore, in a case where the determination is made based on the change in temperature, as shown in the lower column of FIG. 29, it may be determined that the hair is wet when a gradient of the change in temperature when warm air is blown against the hair is gentle, and it may be determined that the hair is dry when the gradient of the change in temperature is steep.

FIG. 30 is a table illustrating the parameters delivered to drying estimation calculation unit 87 and application amount calculation unit 83 for each absorbance calculated based on the signal intensity from wetting detection sensor 60*a* in wetting calculation unit 86.

To start with, in a case where the absorbance is 0%, it is considered that hair dryer 1 is so far away from the hair that warm air does not reach the hair (a so-called atmosphere level where warm air is only in contact with the atmosphere). In this case, the parameters delivered from wetting calculation unit 86 to drying estimation calculation unit 87 are information indicating that warm air at the present time does not contribute to the drying of the hair. On the other hand, the parameters delivered from wetting calculation unit 86 to application amount calculation unit 83 are information indicating that the application of the component is stopped or is not counted as application time of the component.

Further, in a case where the absorbance is 0% to 9%, it is considered that warm air has reached the hair and the hair is fluttering in a substantially dry state. In this case, the parameters delivered from wetting calculation unit 86 to drying estimation calculation unit 87 are information indicating that warm hot air at the present time does not contribute to the drying of the hair. On the other hand, the parameters delivered from wetting calculation unit 86 to application amount calculation unit 83 are information indicating that the application of the component is stopped or is not counted as the application time of the component.

Further, in a case where the absorbance is 10% to 29%, it is considered that warm air has reached the hair and the hair is dry. In this case, the parameters delivered from wetting calculation unit 86 to drying estimation calculation unit 87 are information indicating that warm air at the present time is drying the hair. On the other hand, the parameters delivered from wetting calculation unit 86 to application amount calculation unit 83 are information indicating that a component is to be applied.

Further, in a case where the absorbance is 30% to 70%, it is considered that warm air has reached the hair but the hair is still wet. In this case, the parameters delivered from wetting calculation unit 86 to drying estimation calculation unit 87 are information indicating that warm air at the present time is drying the hair. On the other hand, the parameters delivered from wetting calculation unit 86 to application amount calculation unit 83 are information indicating that a component is to be applied.

Further, in a case where the absorbance is 71% to 90%, it is considered that warm air has reached the skin (face) instead of the hair (skin level). In this case, the parameters delivered from wetting calculation unit 86 to drying estimation calculation unit 87 are information indicating that warm hot air at the present time does not contribute to the drying of the hair. On the other hand, the parameters delivered from wetting calculation unit 86 to application amount calculation unit 83 are information indicating that a component is to be applied.

Furthermore, in a case where the absorbance is 100%, it is considered that although warm air has reached the hair, the whole hair is significantly wet (warm air is almost in contact with water). In this case, the parameters delivered from wetting calculation unit 86 to drying estimation calculation unit 87 are information indicating that warm hot air at the present time does not contribute to the drying of the hair. On the other hand, the parameters delivered from wetting calculation unit 86 to application amount calculation unit 83 are information indicating that the application of the component is stopped or is not counted as the application time of the component.

Next, a method for determining an end of drying in a case where the absorbance is used as a criterion will be described.

Figure 31:
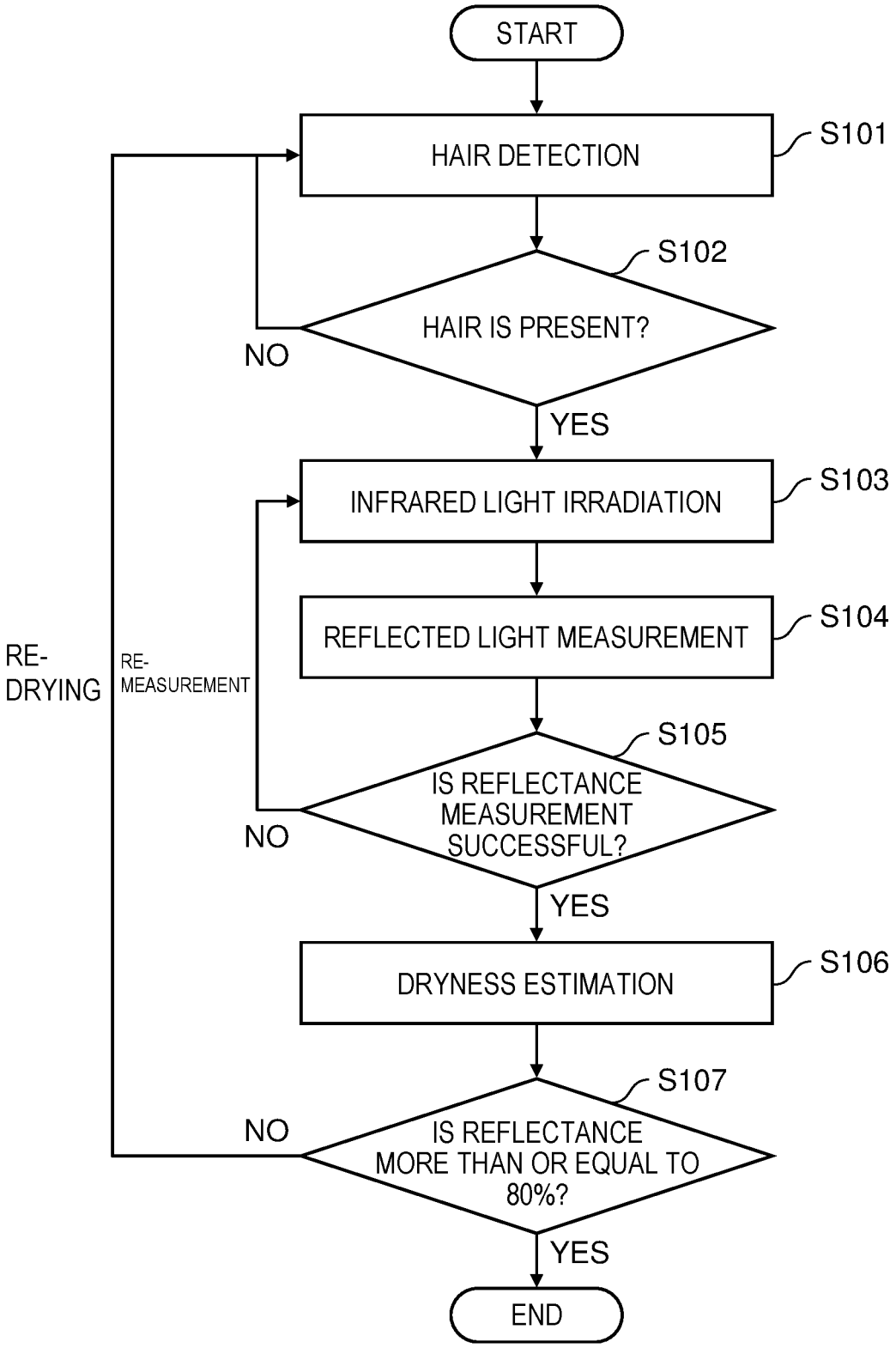
FIG. 31 is a flowchart illustrating a step of determining an end of drying based on the absorbance.

FIG. 31 is a flowchart illustrating a step of determining the end of drying in a case where the absorbance is used as a criterion. First, controller 80 causes hair detection unit 63 to detect the user's hair (step S101). Next, controller 80 determines whether hair is present based on a result of detection by hair detection unit 63 (step S102). Here, when determining that there is no hair (step S102: NO), controller 80 returns to step S101 and repeats the detection of hair. On the other hand, when determining that hair is present (step S102: YES), then controller 80 causes illumination unit 72 to irradiate the hair with infrared light (step S103). Next, controller 80 causes wetting detection sensor 60*a* to measure reflected light reflected by the hair in association with irradiation of the infrared light (step S104). Next, controller 80 determines whether or not a reflectance measurement has succeeded (step S105). Here, when determining that the reflectance measurement is not successful (step S105: NO), controller 80 returns to step S103 and causes the reflected light to be measured again. On the other hand, when determining that the reflectance measurement has succeeded (step S105: YES), then controller 80 causes drying estimation calculation unit 87 to estimate the degree of dryness (step S106). Next, controller 80 determines whether the reflectance specified based on the result of the reflected light measurement in step S104 is more than or equal to 80% (step S107). Here, when determining that the reflectance is less than 80% (step S107: NO), controller 80 returns to step S101 and repeats the drying again. On the other hand, when determining that the reflectance is more than or equal to 80% (step S107: YES), controller 80 terminates the drying.

Next, a description will be given of a case where a point in which the shape of the user's head is considered when the degree of dryness is estimated based on the absorbance.

Figure 32A:
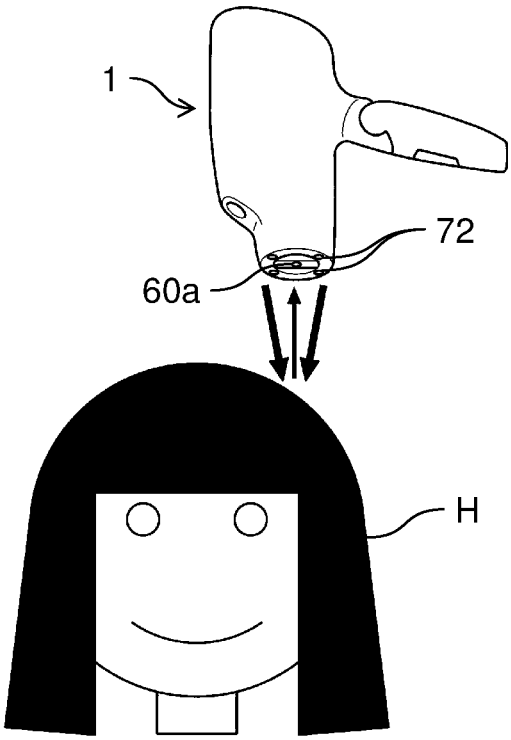
FIG. 32A is a schematic view illustrating a degree of reflection of light on a user's head.
Figure 32B:
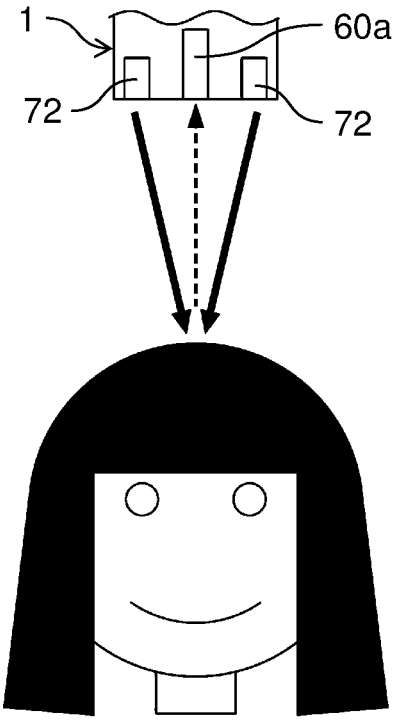
FIG. 32B is a schematic view illustrating the degree of reflection of light on the user's head.
Figure 32C:
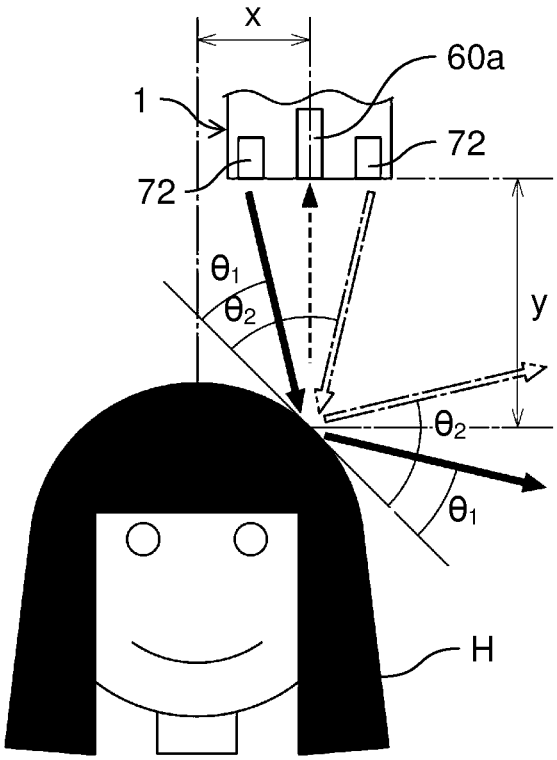
FIG. 32C is a schematic view illustrating the degree of reflection of light on the user's head.

FIGS. 32A to 32C are schematic views illustrating a degree of reflection of light on the user's head measured using measurement unit 50. FIG. 32A is a schematic view illustrating a state where hair H of a user is measured using measurement unit 50. In the present exemplary embodiment, measurement unit 50 includes wetting detection sensor 60*a* (a photodiode) as wetting detection unit 60 and illumination unit 72. FIG. 32B is a schematic view illustrating a case where measurement unit 50 measures a parietal region of the user's head. On the other hand, FIG. 32C is a schematic view illustrating a case where measurement unit 50 measures a temporal region of the user's head. Here, as an example, two illumination units 72 are disposed at positions facing each other with wetting detection sensor 60*a* interposed therebetween along an x direction (see FIG. 32C). For example, it is assumed that hair dryer 1 is moved from the position shown in FIG. 32B to the position shown in FIG. 32C along the x direction. At this time, as hair dryer 1 moves from the parietal region side toward the temporal region side, a distance y from the hair H to wetting detection sensor 60*a* increases. Further, light emitted from the two illumination units 72 diverges at reflection angles θ1 and θ2 to a tangent on the hair H to be irradiated. In other words, as the measurement position moves from the parietal region side toward the temporal region side, the degree of reflection of light changes, and the reflectance decreases.

Figure 33A:
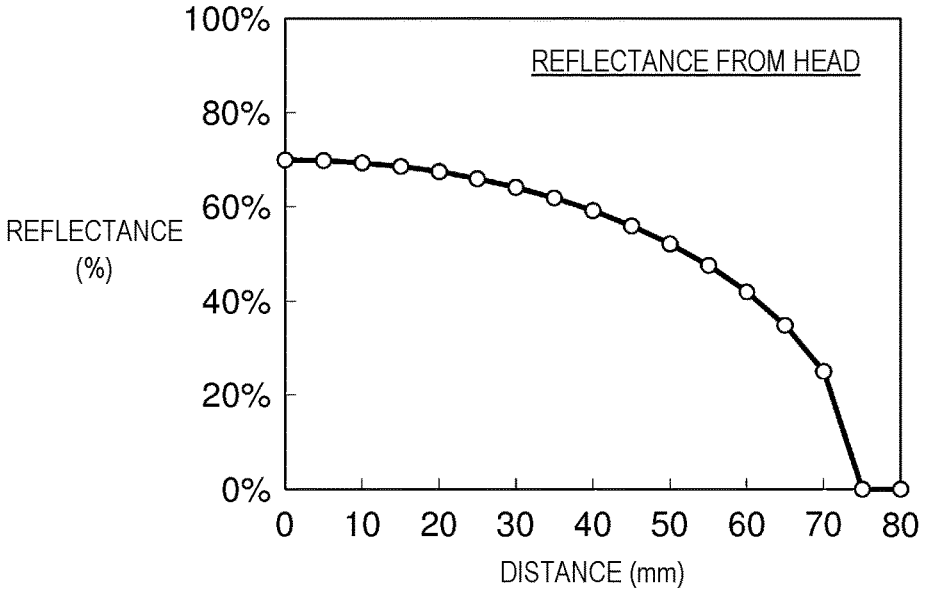
FIG. 33A is a graph illustrating changes in reflectance relative to a distance from the user's head to a wetting detection sensor.
Figure 33B:
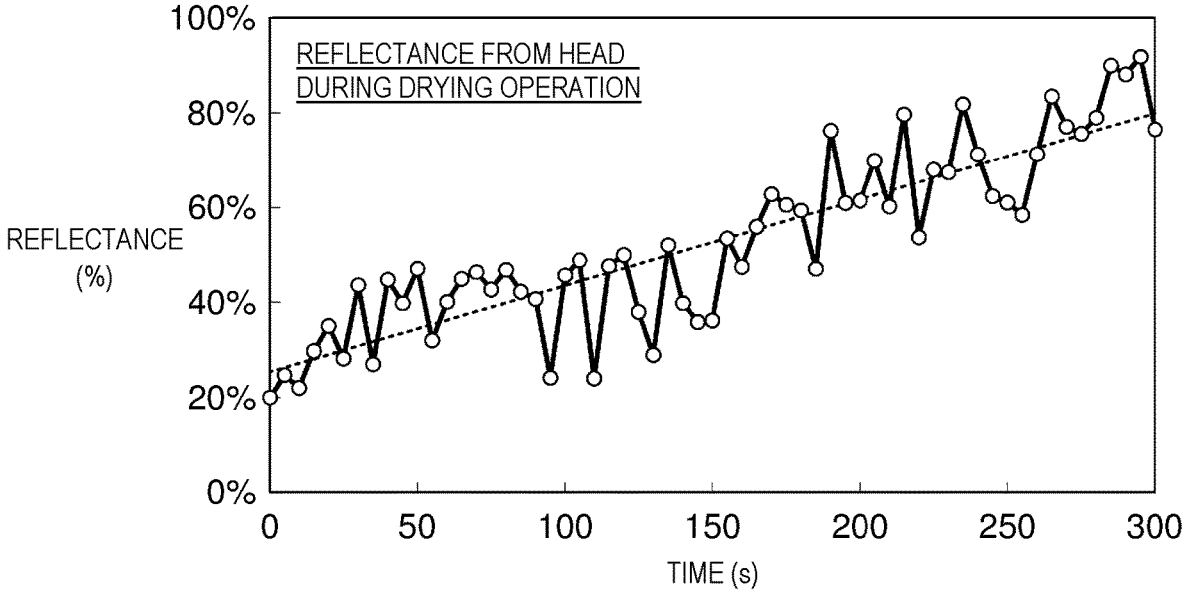
FIG. 33B is a graph illustrating changes in reflectance relative to drying time.

FIGS. 33A and 33B are graphs illustrating a change in reflectance when the user's head is measured as shown in FIG. 32. FIG. 33A is a graph illustrating reflectance (%) from the user's head relative to the distance y (mm) from the user's head (the hair H) to wetting detection sensor 60*a*. As described above, the reflectance decreases as the user's head moves away from wetting detection sensor 60*a*. FIG. 33B is a graph illustrating reflectance (%) from the head during the drying operation relative to the drying time (seconds). During the drying operation, since hair dryer 1 moves in small increments, the reflectance also fluctuates in small increments, but the reflectance also tends to increase as the drying time progresses.

As described above, in consideration of the change in reflectance described with reference to FIGS. 32A to 33B, drying estimation calculation unit 87 may estimate the degree of dryness by equalizing the degree of reflection of light from illumination unit 72 in accordance with a bent shape of the user's head.

Next, adjustments of the temperature and a component for each target portion blown by warm air will be described.

FIGS. 34A and 34B are drawings illustrating adjustments of the temperature and a component for each target portion blown by warm air. FIG. 34A is a schematic view illustrating a target portion. The target portion assumed here is the atmosphere, hair, or skin (face). Among three hair driers 1 shown in FIG. 34A, since first hair drier 1*a* is so far away from the hair H that warm air does not reach the hair, it can be considered that warm air treats the atmosphere as the target portion. For second hair dryer 1*b*, the hair is the target portion blown by warm air. For third hair dryer 1*c*, the skin F is the target portion blown by warm air.

FIG. 34B is a table illustrating an example of a condition for determining which target portion is, and setting of the temperature and adjustment of a component for each target portion.

To start with, for example, in a case where it is determined that wetting detection sensor 60*a* does not detect any light even though illumination unit 72 emits light, wetting calculation unit 86 may determine that the target portion is equivalent to the atmosphere (the atmosphere level). In this case, heat amount control unit 85 does not cause heat application unit 30 to change the temperature. In a case where component generation unit 40 generates charged fine particle water or negative ions, component amount control unit 84 does not cause component generation unit 40 to change the component amount. In a case where component generation unit 40 generates an agent or a polymer, component amount control unit 84 causes component generation unit 40 to stop the application of the component.

Further, for example, in a case where it is determined that the target portion moves with the wind from the measurement by wetting detection sensor 60*a*, wetting calculation unit 86 may determine that the target portion is hair. In this case, heat amount control unit 85 does not cause heat application unit 30 to change the temperature. In a case where component generation unit 40 generates charged fine particle water or negative ions, component amount control unit 84 does not cause component generation unit 40 to change the component amount. In a case where component generation unit 40 generates an agent or a polymer, component amount control unit 84 causes component generation unit 40 to apply a component for hair.

Furthermore, for example, in a case where it is determined that the target portion does not move with the wind from the measurement by wetting detection sensor 60*a*, wetting calculation unit 86 may determine that the target portion is the skin. In this case, heat amount control unit 85 causes heat application unit 30 to lower the temperature. In a case where component generation unit 40 generates charged fine particle water, component amount control unit 84 does not cause component generation unit 40 to change the component amount. In a case where component generation unit 40 generates negative ions, component amount control unit 84 causes component generation unit 40 to stop the application of the component. In a case where component generation unit 40 generates an agent or a polymer, component amount control unit 84 causes component generation unit 40 to apply a component for the skin.

Figure 35:
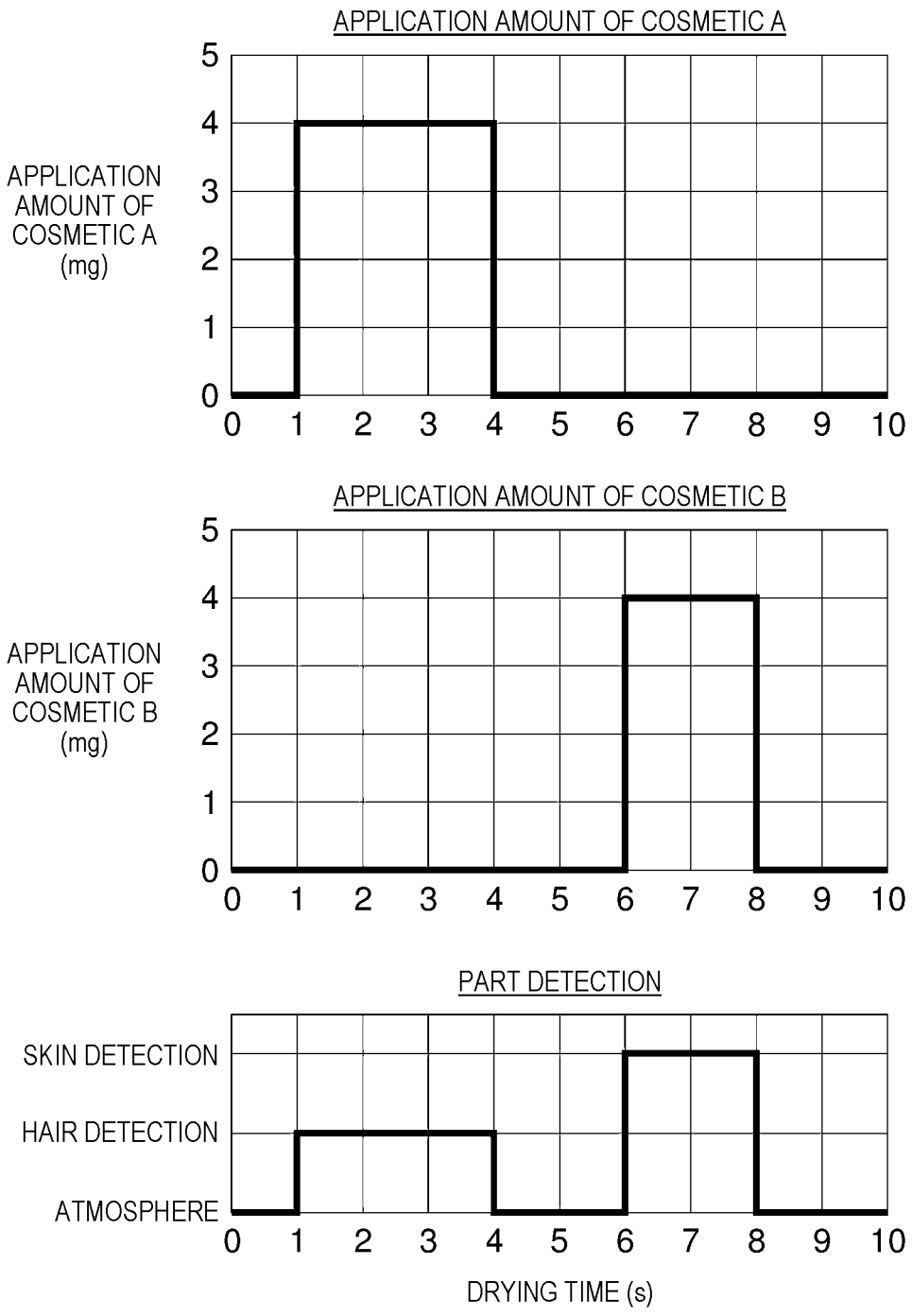
FIG. 35 is a timing chart illustrating an example of a relationship between the application amounts of two kinds of cosmetics and detection of the target portion.

FIG. 35 is a timing chart illustrating an example of a relationship between the application amounts of two kinds of cosmetics A and B and part detection of the target portion. The upper diagram shows the application amount (mg) of the cosmetic A relative to the drying time (seconds). The middle diagram shows the application amount (mg) of the cosmetic B relative to the drying time (seconds). The cosmetic A and the cosmetic B are components different from each other. The cosmetic A is a component that particularly effectively acts on hair. The cosmetic B is a component that particularly effectively acts on the skin. The lower diagram shows part detection of the target portion relative to the drying time (seconds). In FIG. 35, the drying times, which are the horizontal axe in the upper diagram, the middle diagram, and the lower diagram, correspond to one another. Here, controller 80 does not cause component generation unit 40 to generate either the cosmetic A or the cosmetic B while determining that the target portion is equivalent to the atmosphere. On the other hand, while determining that the target portion is hair, controller 80 causes component generation unit 40 to apply, for example, only 4 mg of the cosmetic A. Further, while determining that the target portion is the skin, controller 80 causes component generation unit 40 to apply, for example, only 4 mg of the cosmetic B. In other words, as shown in FIG. 35, controller 80 may particularly apply to the hair the cosmetic A that is effective on hair, and may particularly apply to the skin the cosmetic B that is effective on the skin.

Next, a description will be given of an example of timing related to the degree of dryness of the hair and the component applied by component generation unit 40 or the heat applied by heat application unit 30 with the drying time as a time series.

Figure 36:
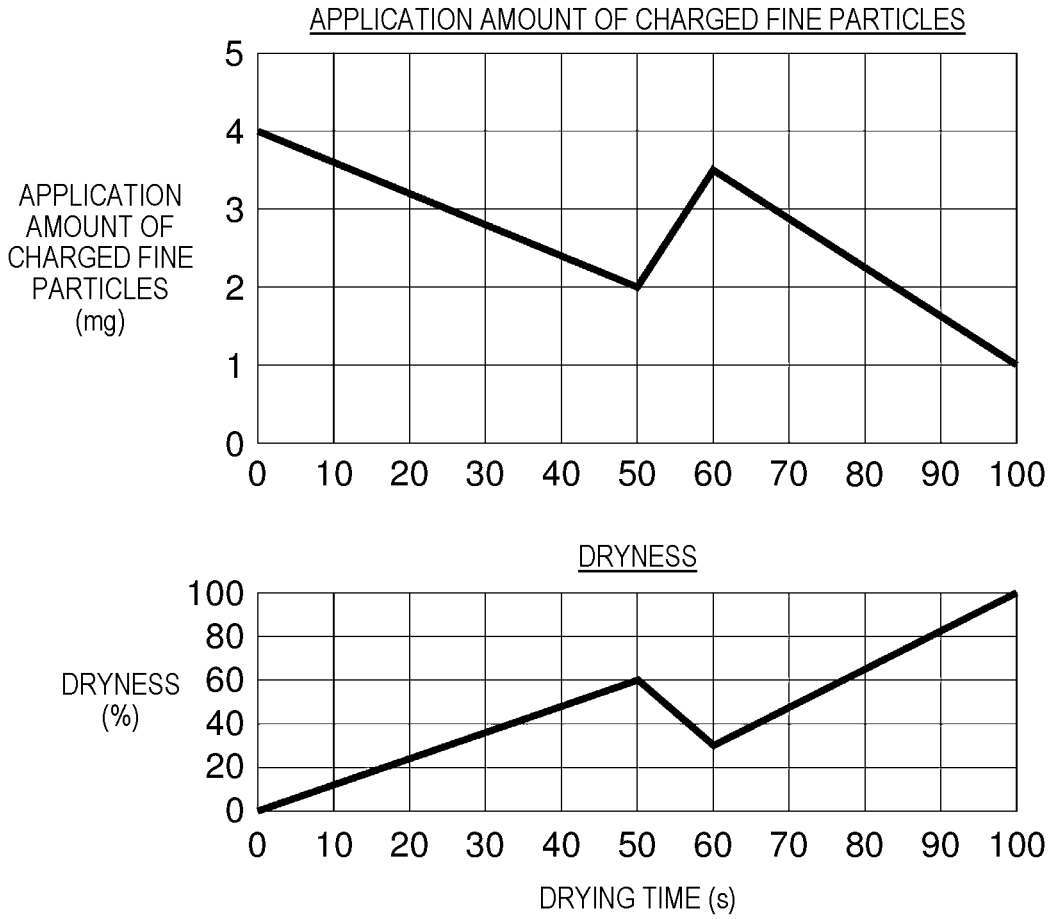
FIG. 36 is a timing chart illustrating an example of a relationship between the application amount of charged fine particles and a degree of dryness.

FIG. 36 is a timing chart illustrating an example of the relationship between the application amount of charged fine particles and a degree of dryness of hair. The upper diagram shows the application amount (mg) of the charged fine particles relative to the drying time (seconds). The lower diagram shows the degree of dryness (%) relative to the drying time (seconds). In FIG. 36, the drying times, which are the horizontal axe in the upper diagram and the lower diagram, correspond to each other. Controller 80 may adjust the application amount of charged fine particle water in accordance with the degree of dryness of the hair. Specifically, controller 80 may increase the application amount of the charged fine particle water when the hair is wet, that is, when the degree of dryness is low, and may decrease the application amount of the charged fine particle water when the hair is dry, that is, when the degree of dryness is high.

Figure 37:
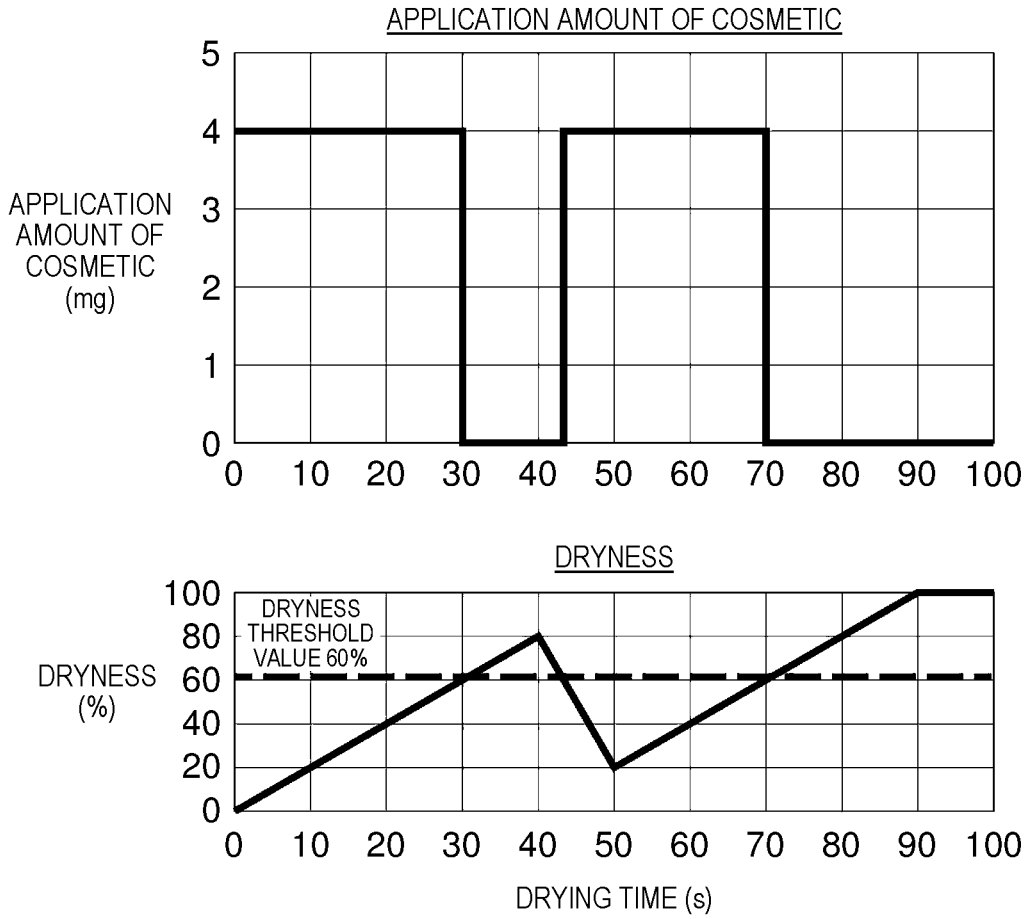
FIG. 37 is a timing chart illustrating an example of a relationship between the application amount of a cosmetic and the degree of dryness.

FIG. 37 is a timing chart illustrating an example of the relationship between the application amount of a cosmetic and a degree of dryness of hair. An upper diagram shows the application amount (mg) of the cosmetic relative to the drying time (seconds). The lower diagram shows the degree of dryness (%) relative to the drying time (seconds). In FIG. 37, the drying times, which are the horizontal axe in the upper diagram and the lower diagram, correspond to each other. Controller 80 may adjust the application amount of the cosmetic such that the cosmetic is applied only when the degree of dryness does not exceed a preset threshold value. In the example shown in FIG. 37, controller 80 causes component generation unit 40 to apply, for example, 4 mg of the cosmetic while the degree of dryness does not exceed 60% of the threshold value. In other words, when the degree of dryness exceeds 60% of the threshold value, controller 80 causes component generation unit 40 to stop the application of the cosmetic. In other words, controller 80 may apply the cosmetic only when the hair is relatively wet.

Figure 38:
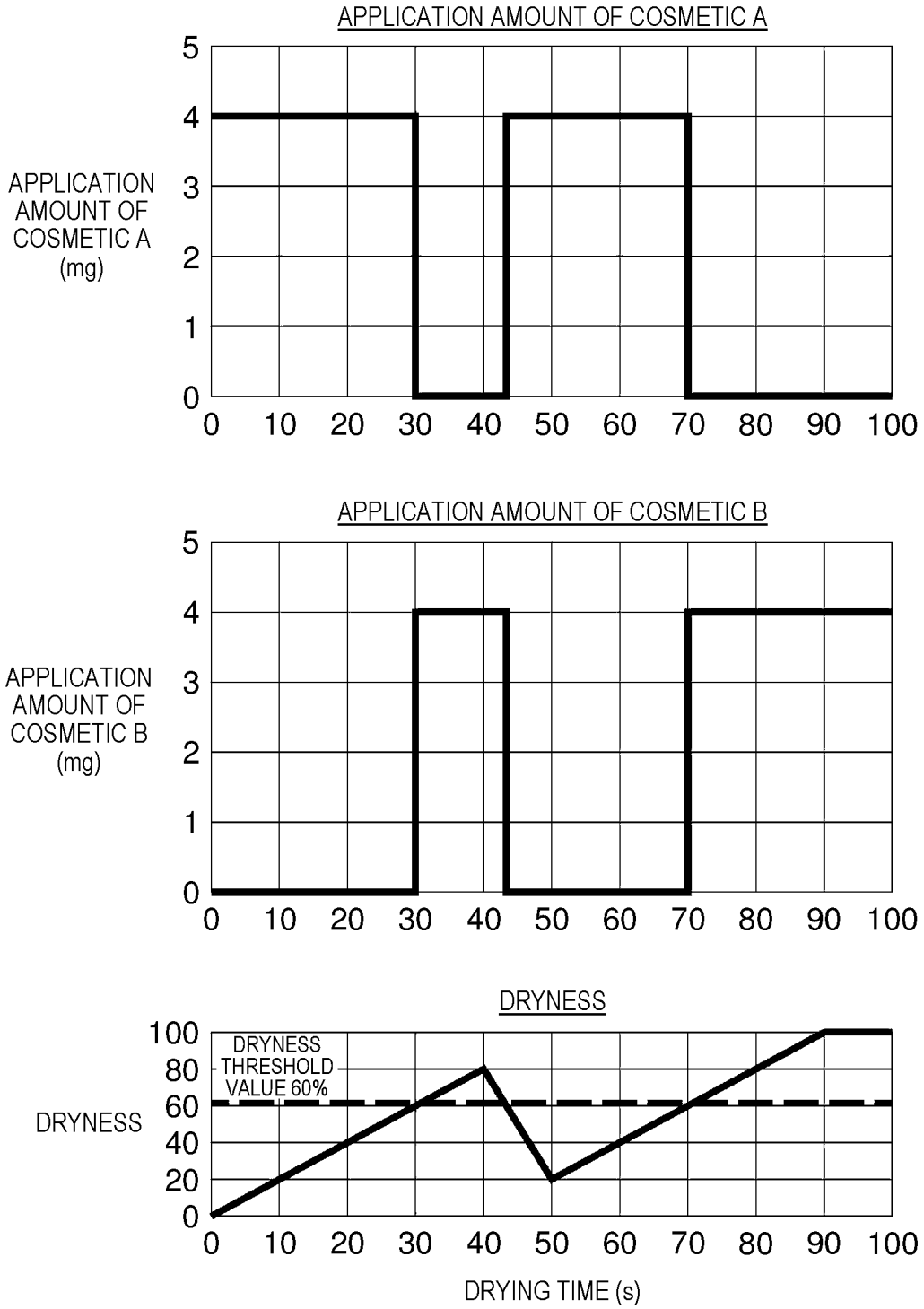
FIG. 38 is a timing chart illustrating an example of a relationship between the application amounts of two kinds of cosmetics and the degree of dryness.

FIG. 38 is a timing chart illustrating an example of the relationship between the application amounts of two kinds of cosmetics A and B and the degree of dryness of hair. The upper diagram shows the application amount (mg) of the cosmetic A relative to the drying time (seconds). The middle diagram shows the application amount (mg) of the cosmetic B relative to the drying time (seconds). The cosmetic A and the cosmetic B are components different from each other. The cosmetic A is an agent desired to be permeated into hair. The cosmetic B is a coating agent. The lower diagram shows the degree of dryness (%) relative to the drying time (seconds). In FIG. 38, the drying time, being the horizontal axe in the upper diagram, the middle diagram, and the lower diagram, corresponds to each other. Controller 80 causes component generation unit 40 to apply, for example, only 4 mg of the cosmetic A only when the degree of dryness does not exceed a preset threshold value, that is, while the hair is relatively wet. On the other hand, controller 80 causes component generation unit 40 to apply, for example, only 4 mg of the cosmetic B only when the degree of dryness exceeds the preset threshold value, that is, when the hair is relatively dry. In other words, controller 80 may particularly apply the cosmetic A that is an agent desired to be permeated while the hair is wet, and may particularly apply the cosmetic B that is a coating agent while the hair is dry.

Figure 39:
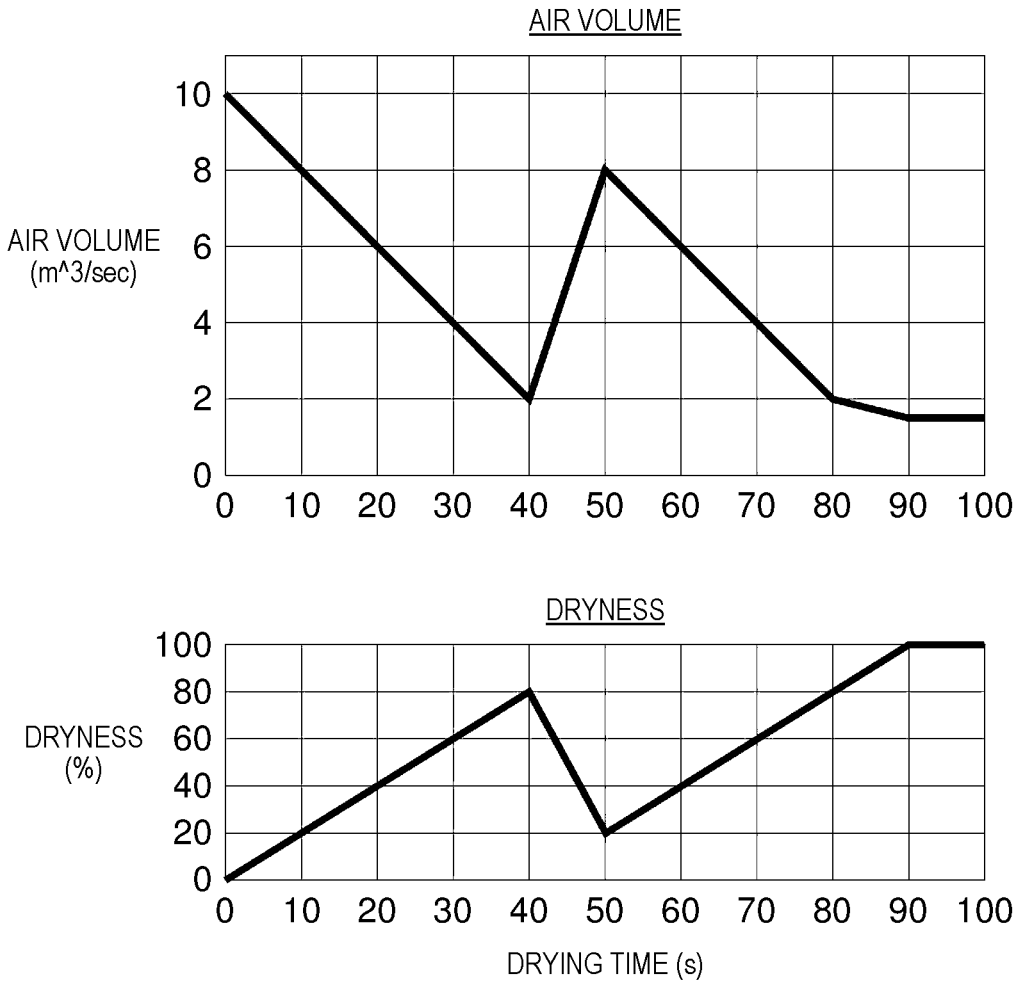
FIG. 39 is a timing chart illustrating an example of a relationship between the air volume and the degree of dryness.

FIG. 39 is a timing chart illustrating an example of a relationship between the air volume and the degree of dryness of hair. The upper diagram shows the air volume ($m^3/s$) relative to the drying time (seconds). The lower diagram shows the degree of dryness relative to the drying time (seconds). In FIG. 39, the drying time, being the horizontal axe in the upper diagram and the lower diagram, corresponds to each other. Controller 80 may adjust the air volume in accordance with the degree of dryness of the hair. Specifically, when the hair becomes dry, controller 80 may decrease the air volume, on the other hand, increase the temperature. As the hair is dried, the glass transition point rises. Therefore, reducing the air volume in association with the drying of the hair allows a curl of the hair to be extended.

Next, the relationship between the drying time and the degree of dryness for each part of the hair will be described.

Figure 40A:
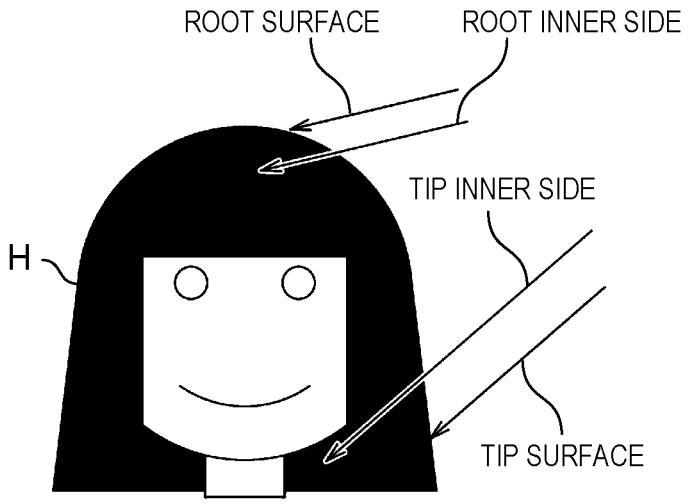
FIG. 40A is a schematic view illustrating four parts in hair (a root surface, a root inner side, a tip surface, and a tip inner side).
Figure 40B:
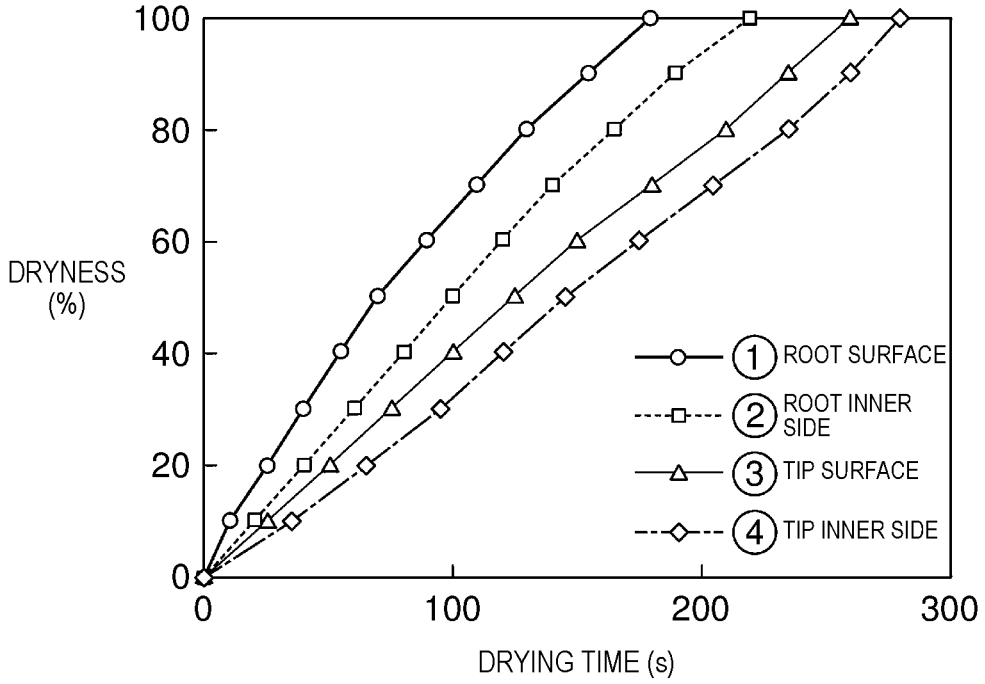
FIG. 40B is a graph illustrating the degree of dryness for each part of hair relative to the drying time.

FIGS. 40A and 40B are drawings illustrating a relationship between the drying time and the degree of dryness for each part of the hair H. FIG. 40A is a schematic view showing parts in the hair H illustrated in the following FIG. 40B. Here, four parts of a root surface, a root inner side, a tip surface, and a tip inner side are compared FIG. 40B is a graph illustrating the degree of dryness (%) for each part of the hair H relative to the drying time (seconds). It can be seen that the hair H is easily dried in the order of the root surface, the root inner side, the tip surface, and the tip inner side.

Next, effects of hair dryer 1 will be described.

Hair dryer 1 as a hair care device according to the present exemplary embodiment, includes heat application unit 30 that applies heat to a user's hair, component generation unit 40 that generates a component acting on the hair, and measurement unit 50 that measures the hair. Further, hair dryer 1 also includes controller 80 that controls operations of heat application unit 30 and component generation unit 40 based on the hair measurement value obtained from measurement unit 50. Controller 80 includes hair characteristic recognition unit 81, table generation unit 82, and application amount calculation unit 83. Hair characteristic recognition unit 81 classifies the hair characteristics of the user based on the hair measurement value. Table generation unit 82 sets the component amount of the component generated by component generation unit 40 for each hair characteristic classified by hair characteristic recognition unit 81. Application amount calculation unit 83 adjusts the component amount for each user based on the hair characteristics of the whole hair classified by hair characteristic recognition unit 81 and the component amount set by table generation unit 82. Alternatively, application amount calculation unit 83 calculates the component application amount given by component generation unit 40 or the heat application amount given by heat application unit 30 for each part based on the hair characteristics for each part of the hair classified by hair characteristic recognition unit 81 and the component amount set by table generation unit 82.

In the present exemplary embodiment, controller 80 refers to the hair characteristics of the user when heat or a component is applied to the user's hair. Then, controller 80 controls heat application unit 30 or component generation unit 40 by reflecting the hair characteristics of the user for each user or for each part of the user's hair. Specifically, first, for each user using the whole hair as a unit, the component amount suitable for the hair characteristics of the user is set in advance, and component generation unit 40 can apply the component to the hair in a set optimum component amount. Second, for each part of a certain user, the component or heat can be applied to the hair with an optimum component application amount or heat application amount obtained by further adjusting the component amount or the amount of heat set in table generation unit 82 for each part. In other words, controller 80 can execute fine control optimal for a user using hair dryer 1.

As described above, according to the present exemplary embodiment, it is possible to provide a hair care device that easily leads to a finish of hair desired by a user.

Further, in hair dryer 1, the hair characteristics may be at least one of a hairstyle of the user, a length of the hair, a volume of the hair, and hair quality related to a thickness or gloss of the hair.

According to such hair dryer 1, it is possible to give many variations to the hair characteristics that can be referred to by controller 80, and as a result, it can be easier to lead to a finish of hair desired by the user.

Further, hair dryer 1 also includes display 73 that displays at least a divided image divided into at least two in a front-back direction, a left-right direction, or an up-down direction of hair. Controller 80 may change the component amount to a user's desired amount based on the divided portion selected by the user in the divided image of display 73.

According to such hair dryer 1, the component amount set by controller 80 can be changed to the component amount desired by the user using a split screen, so that it can be easier to lead to a finish of hair desired by the user.

Further, in hair dryer 1, controller 80 includes wetting calculation unit 86 that calculates wetting information on wetting of hair based on the hair measurement value. In a case where it is determined that the user has not washed the hair or the hair is not wet, wetting calculation unit 86 may cause hair characteristic recognition unit 81 to execute a classification of the hair characteristics. On the other hand, in a case where it is determined that the hair is wet, wetting calculation unit 86 may cause table generation unit 82 to set the component amount based on the hair characteristics classified by hair characteristic recognition unit 81 up to the previous time.

According to such hair dryer 1, controller 80 can acquire the hair characteristics of the user from the hair measurement value when the hair is in a normal state, and thus can set a more optimal amount of the component to be applied.

Further, in hair dryer 1, controller 80 includes drying estimation calculation unit 87 that estimates the degree of dryness of the hair based on the hair measurement value. Application amount calculation unit 83 may further adjust the component amount based on the degree of dryness estimated by drying estimation calculation unit 87.

According to such hair dryer 1, controller 80 adjusts the component amount with reference to the degree of dryness of the hair during the drying operation, so that the component adjusted to a more optimal component amount can be applied to the hair.

Further, in hair dryer 1, measurement unit 50 includes wetting detection sensor 60*a* having at least an absorption wavelength of water as a hair measurement value. Wetting calculation unit 86 calculates the absorbance from the hair measurement value detected by wetting detection sensor 60*a*. Drying estimation calculation unit 87 may estimate the degree of dryness based on the change in the absorbance calculated by wetting calculation unit 86.

According to such hair dryer 1, controller 80 can estimate the degree of dryness with a simpler configuration or with a simpler control.

Further, in hair dryer 1, measurement unit 50 includes illumination unit 72 that emits light having at least an absorption wavelength of water. Wetting detection sensor 60*a* is a photodiode. Drying estimation calculation unit 87 may estimate the degree of dryness by equalizing the degree of reflection of light from illumination unit 72 in accordance with the bent shape of the user's head.

According to such hair dryer 1, the degree of dryness can be estimated in accordance with the shape of the user's head, thus making it easier to lead to a finish of hair desired by the user.

Further, in hair dryer 1, when drying estimation calculation unit 87 determines that the degree of dryness is at the atmosphere level, controller 80 causes at least one of the following operations to be performed. In other words, controller 80 may perform at least one of operations of causing heat application unit 30 not to apply heat, causing component generation unit 40 to stop applying the component, and causing component generation unit 40 not to count the application time even when component generation unit 40 applies the component.

According to such hair dryer 1, unnecessary operations in heat application unit 30 or component generation unit 40 that are not effective for the user's hair can be decreased as much as possible.

Further, in hair dryer 1, when drying estimation calculation unit 87 determines that the degree of dryness is at the skin level of the user, controller 80 causes at least one of the following operations to be performed. In other words, controller 80 may perform at least one operation of causing heat application unit 30 not to apply heat and causing component generation unit 40 to apply an effective component to the user's skin.

According to such hair dryer 1, it is possible to increase the number of operations effective particularly for the user's skin.

Further, hair dryer 1 also includes transmitting and receiving unit 74 that performs transmission and reception with terminal communication unit 103 provided in portable terminal device 100 as an external communication device. Here, assume that at least a divided image divided into at least two of a front-back direction, a left-right direction, or an up-down direction of hair are displayed on terminal display unit 101 provided in portable terminal device 100. At this time, transmitting and receiving unit 74 may receive information related to the divided portion selected by the user in the divided image of terminal display unit 101 from terminal communication unit 103. Further, controller 80 may change the component amount to a user's desired amount based on the information related to the divided portion received by transmitting and receiving unit 74 from terminal communication unit 103.

With such hair dryer 1, the user can adjust the settings in hair dryer 1 from portable terminal device 100, so that convenience for the user can be improved.

Second Exemplary Embodiment

Hair dryer 1 according to the first exemplary embodiment described above adopts wetting detection sensor 60*a* (a photodiode) as an example of wetting detection unit 60. On the other hand, in hair dryer 1 according to the second exemplary embodiment, as an example of wetting detection unit 60, any one of the following two photographing units is adopted instead of wetting detection sensor 60*a*.

Figure 41:
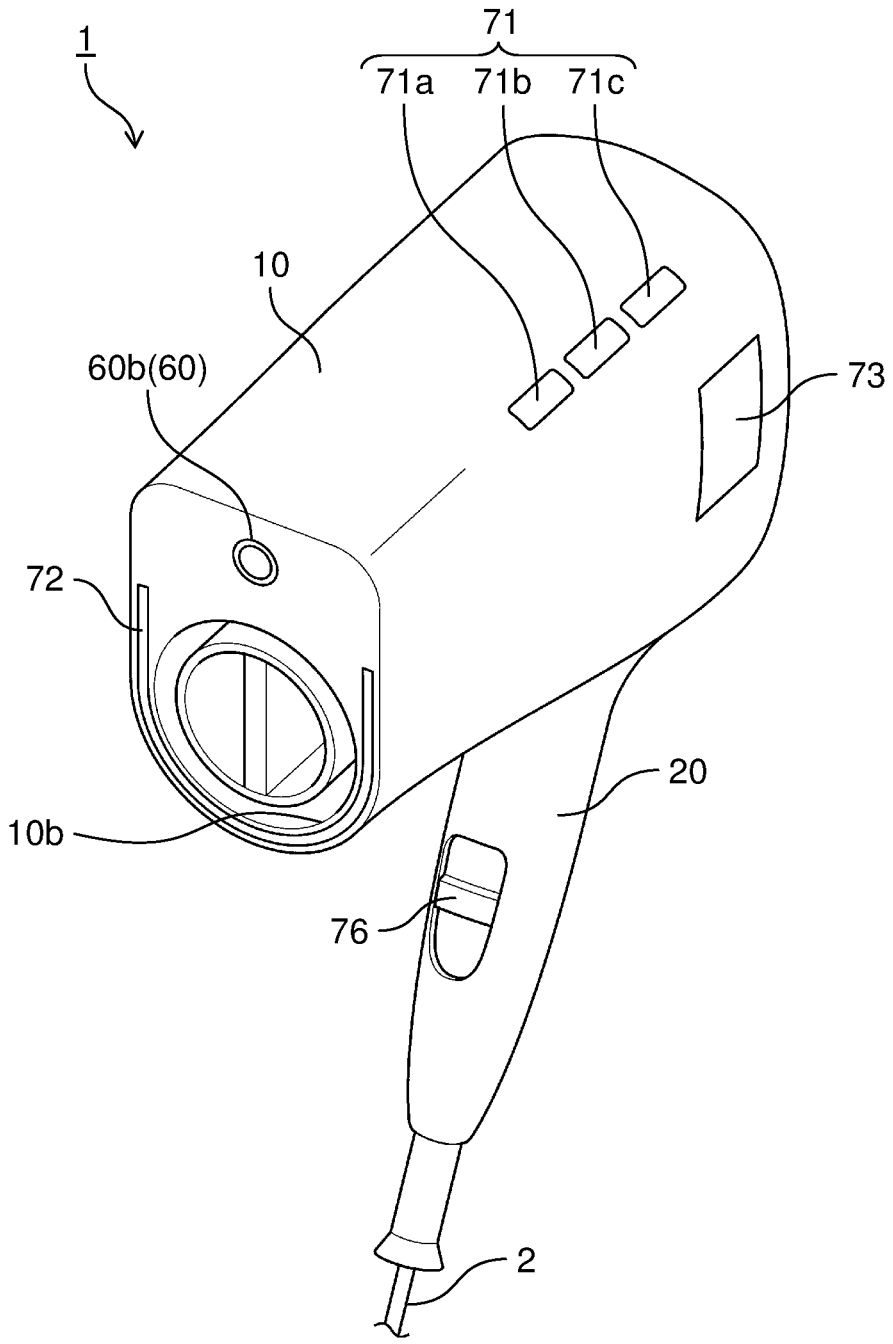
FIG. 41 is a schematic perspective view illustrating a configuration of a first example of a hair dryer according to a second exemplary embodiment.

FIG. 41 is a schematic perspective view illustrating a configuration of a first example of hair dryer 1 as a hair care device according to the second exemplary embodiment. Hair dryer 1 according to the first example of the present exemplary embodiment includes photographing unit 60*b* installed instead of wetting detection sensor 60*a* in the first exemplary embodiment, and illumination unit 72 installed so as to surround a part of discharge port 10*b*. Note that, in hair dryer 1 described herein, since the configuration other than photographing unit 60*b* and illumination unit 72 is the same as the configuration in the first exemplary embodiment (excluding the configuration related to control of, for example, controller 80 and signal processing unit 90), the same reference numerals are given, and a detailed description thereof is omitted.

Figure 42:
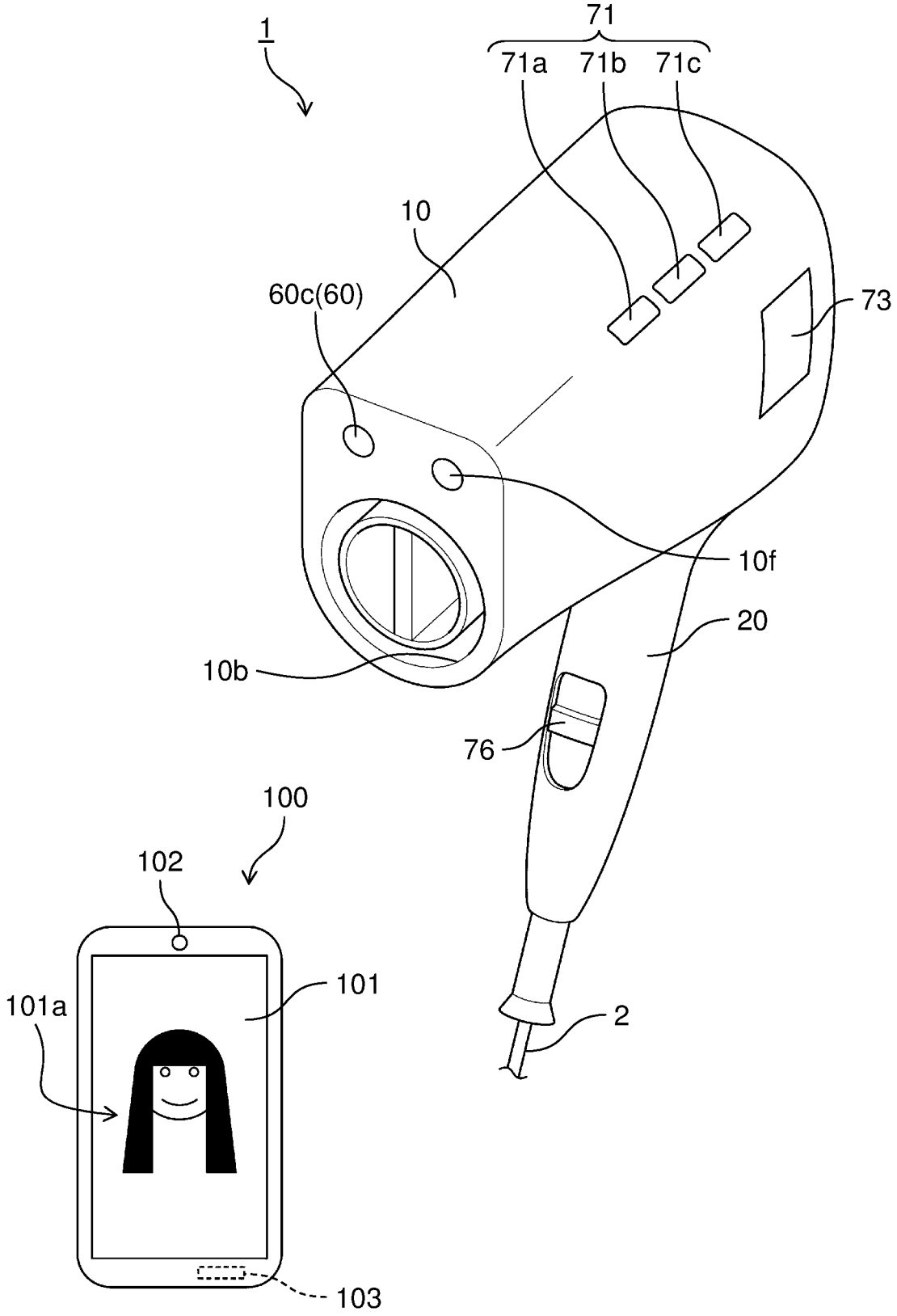
FIG. 42 is a schematic perspective view illustrating a configuration of a second example of the hair dryer according to the second exemplary embodiment.

FIG. 42 is a schematic perspective view illustrating a configuration of a second example of hair dryer 1 as a hair care device according to the second exemplary embodiment. Hair dryer 1 according to the second example of the present exemplary embodiment includes transmitting and receiving unit 74, and performs transmission and reception with portable terminal device 100 (terminal communication unit 103) that is an external communication device. Hair dryer 1 described herein uses terminal photographing unit 102 provided in portable terminal device 100 as a photographing unit as wetting detection unit 60. Further, hair dryer 1 according to the second example of the present exemplary embodiment may include temperature sensor 60*c* (an infrared sensor) installed instead of wetting detection sensor 60*a* in the first exemplary embodiment. In this case, illumination unit 72 is unnecessary. Note that, in a case where temperature sensor 60*c* is used as wetting detection unit 60, as described above with reference to FIGS. 28 and 29, drying estimation calculation unit 87 can estimate the degree of dryness based on the temperature change of the hair relative to the drying time. Further, since hair dryer 1 described herein has the same configuration as the configuration in the first exemplary embodiment (excluding the configuration related to control of, for example, controller 80 and signal processing unit 90) except for the configuration described above, the same reference numerals are given, and a detailed description thereof is omitted.

To start with, in a case where photographing unit 60*b* or terminal photographing unit 102 is used as wetting detection unit 60, as already described with reference to FIGS. 28 and 29, drying estimation calculation unit 87 can estimate the degree of dryness by machine learning based on a hair image. In this case, a point expressed as a "hair measurement value" in the description of hair dryer 1 according to the first exemplary embodiment can be replaced with a "hair image" in the present exemplary embodiment. Hereinafter, machine learning will be described more specifically with reference to FIGS. 43 to 45.

In the present exemplary embodiment, drying estimation calculation unit 87 estimates the degree of dryness for each drying time by machine learning based on teacher data of a two-dimensional image (a hair image) photographed by photographing unit 60*b* or the like for each drying time.

Figure 43A:
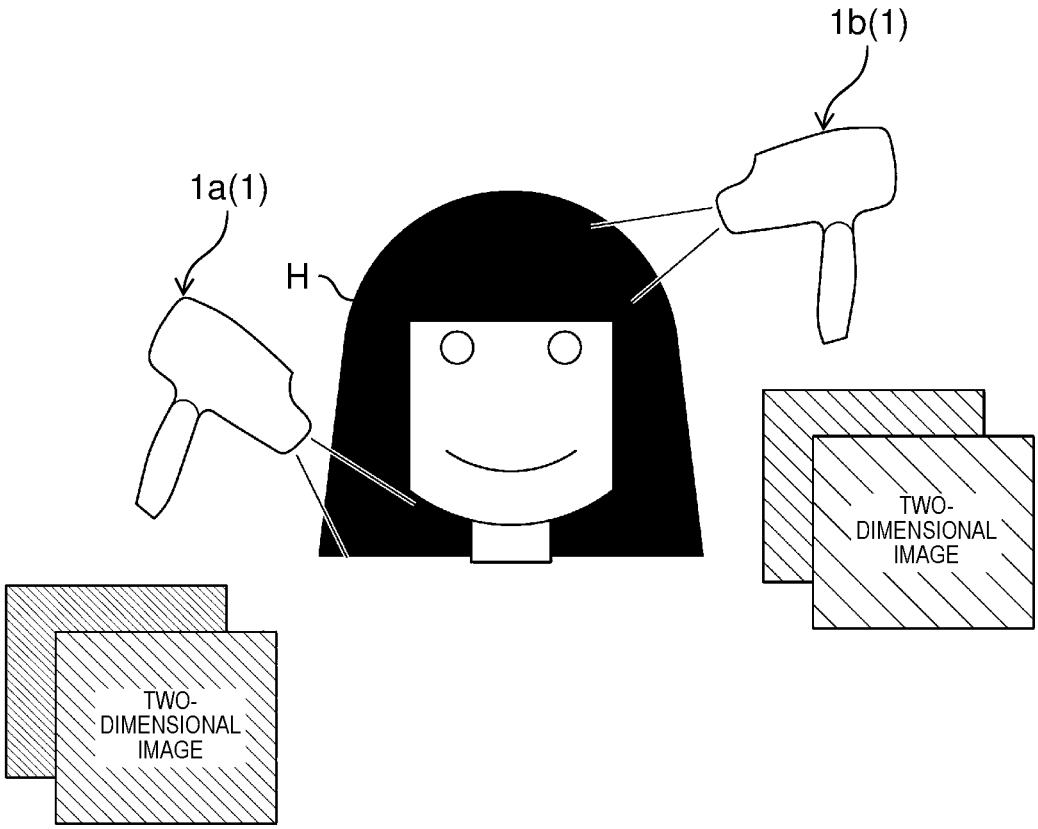
FIG. 43A is a schematic view illustrating a state in which a two-dimensional image is acquired for each drying time.
Figure 43B:
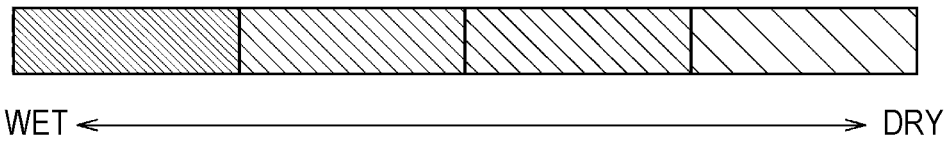
FIG. 43B is a schematic view illustrating a state of the two-dimensional image that changes as hair is dried.

FIGS. 43A and 43B are schematic views illustrating examples of two-dimensional images acquired for each drying time in a case where wetting detection unit 60 is photographing unit 60*b*. FIG. 43A is a schematic view illustrating a state in which a two-dimensional image is acquired for each drying time. FIG. 43B is a schematic view illustrating a state of the two-dimensional image that changes as the hair His dried. As shown in FIGS. 43A and 43B, when the user changes the position of hair dryer 1 to the position shown in first hair dryer 1*a* or the position shown in second hair dryer 1*b* during the drying, photographing unit 60*b* acquires a two-dimensional image for each drying time. The acquired two-dimensional image is accumulated in storage 75.

Figure 44A:
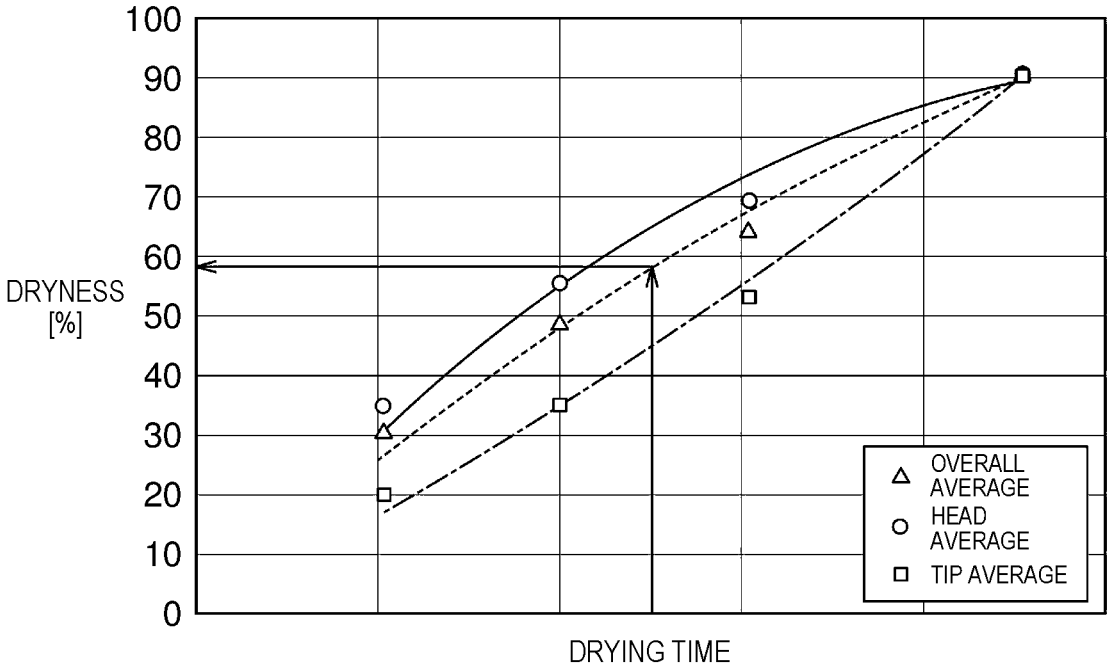
FIG. 44A is a graph illustrating a transition of the degree of dryness relative to the drying time.
Figure 44B:
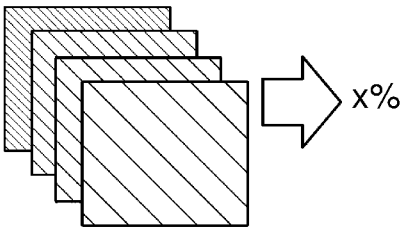
FIG. 44B is a schematic view illustrating a state in which the degree of dryness of the whole hair is estimated from the two-dimensional image.
Figure 44C:
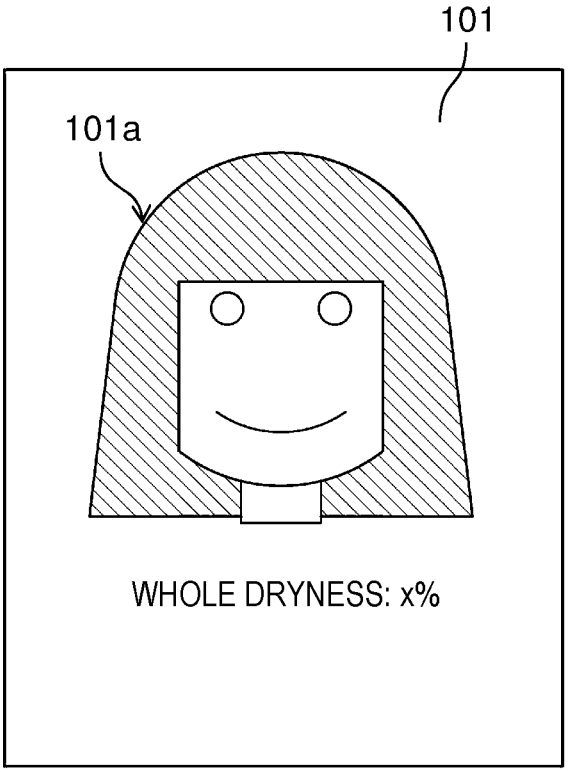
FIG. 44C is a schematic view illustrating a display example of the degree of dryness of the whole hair estimated from the two-dimensional image.

FIGS. 44A to 44C are drawings illustrating up to displaying the result of the dryness of the whole hair estimated from the two-dimensional image. FIG. 44A is a graph illustrating a transition of the degree of dryness (%) relative to an accumulated drying time. A correlation as illustrated in FIG. 44A can be obtained from the degree of dryness in the acquired two-dimensional image. Then, as shown in FIG. 44B, the degree of dryness in a certain drying time can be estimated from an approximate curve of an overall average in FIG. 44A with reference to all the acquired two-dimensional images. FIG. 44C is a schematic view illustrating an example in which the overall degree of dryness is displayed on terminal display unit 101 of portable terminal device 100. The user can recognize the degree of dryness of the hair at the present time by such a display.

Figure 45A:
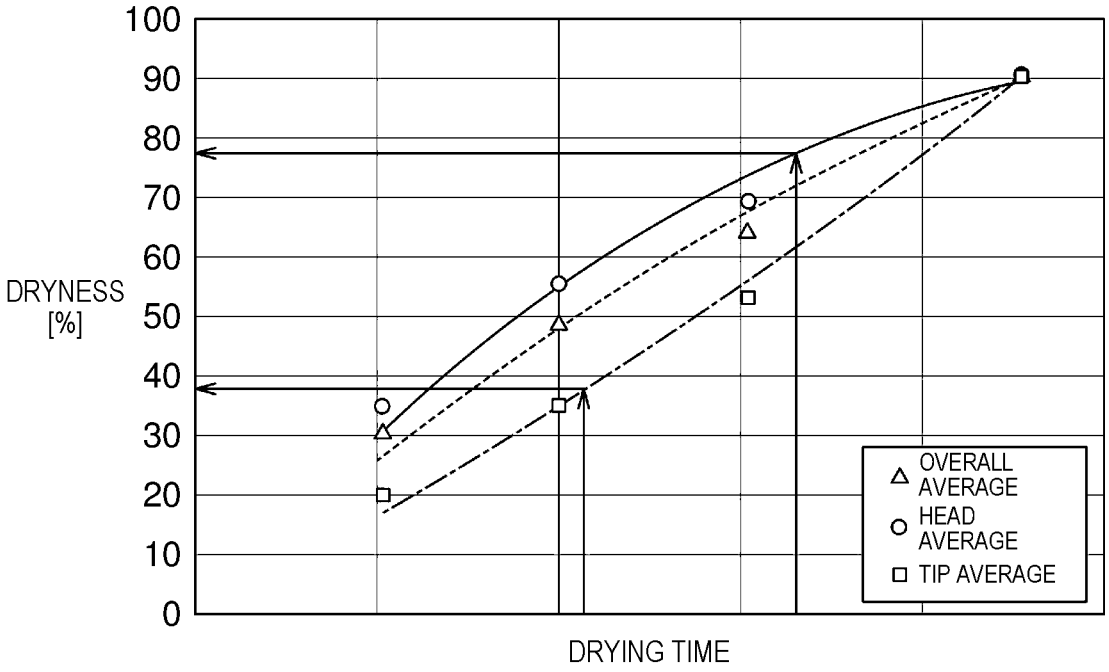
FIG. 45A is a graph illustrating a transition of the degree of dryness relative to an accumulated drying time.
Figure 45B:
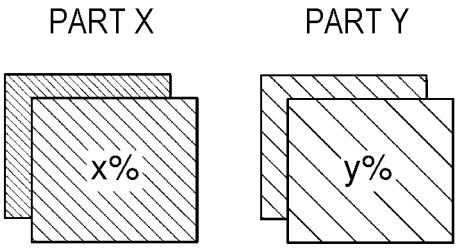
FIG. 45B is a schematic view illustrating a state in which the degree of dryness is estimated for each part classified according to a wetting level from the two-dimensional image.
Figure 45C:
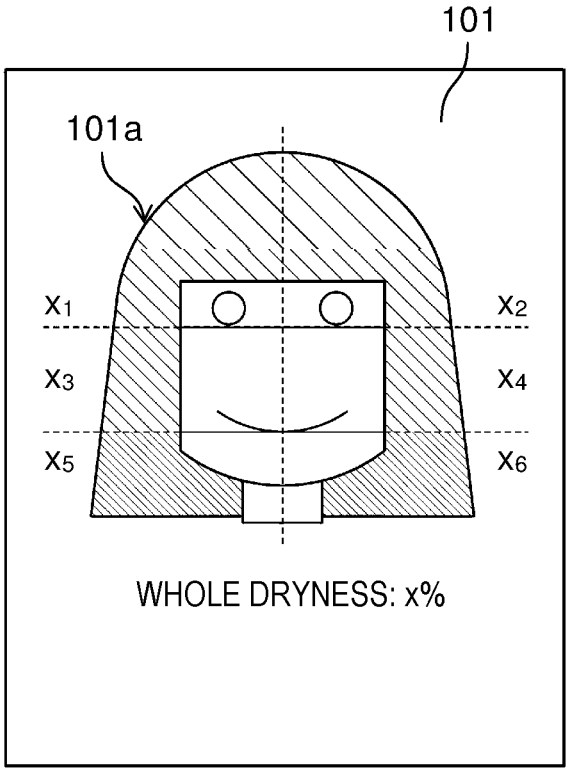
FIG. 45C is a schematic view illustrating a display example of the degree of dryness for each part estimated from the two-dimensional image.

FIGS. 45A to 45C are drawings illustrating a process up to displaying the results of the degree of dryness of a head average and a hair tip average estimated from the two-dimensional image. FIG. 45A is a graph illustrating the transition of the degree of dryness (%) relative to the accumulated drying time, similarly to FIG. 44A. In this case, as shown in FIG. 45B, the acquired two-dimensional image can be classified for each part such as a relatively wet part X or a relatively dry part Y. Then, the degree of dryness for each part in a certain drying time can be estimated from the approximate curve of the head average and the approximate curve of the hair tip average in FIG. 45A. FIG. 45C is a schematic view illustrating an example in which the degree of dryness for each part is displayed on terminal display unit 101 of portable terminal device 100. With such a display, the user can recognize the degree of dryness for each part of the hair at the present time.

As described above, in hair dryer 1 according to the second exemplary embodiment, for example, measurement unit 50 includes photographing unit 60*b* that uses a two-dimensional image as a hair image. Drying estimation calculation unit 87 may estimate the degree of dryness for each drying time by machine learning based on teacher data of a two-dimensional image photographed by photographing unit 60*b* for each drying time. Further, in hair dryer 1 according to the second exemplary embodiment, drying estimation calculation unit 87 may estimate the degree of dryness for each part of the hair.

Hair dryer 1 according to the second exemplary embodiment has the same advantageous effects as hair dryer 1 according to the first exemplary embodiment.

Third Exemplary Embodiment

Furthermore, wetting detection unit 60 may be a moisture content sensor that directly measures the moisture content of the hair by coming into contact with the user's hair.

Figure 46:
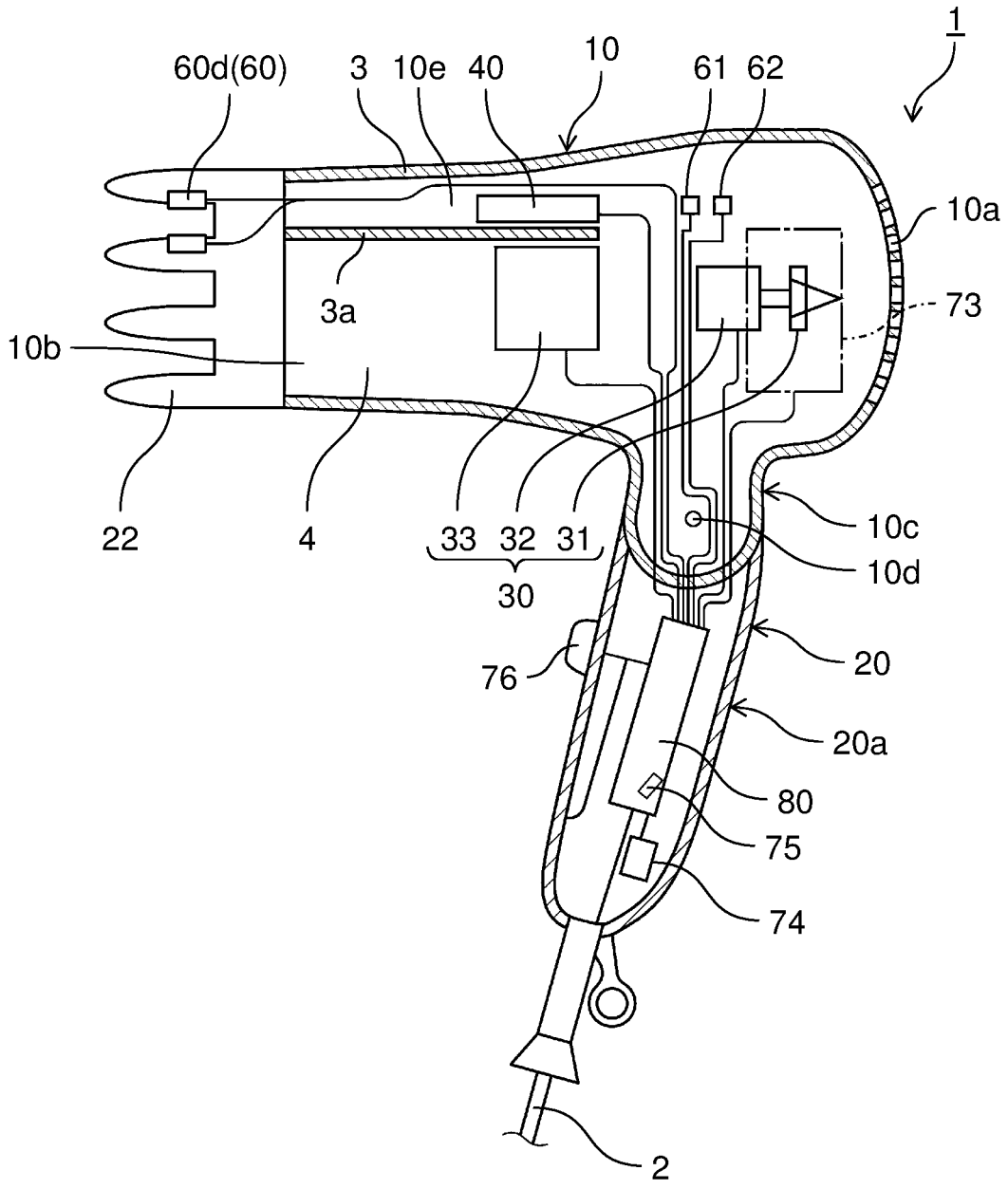
FIG. 46 is a schematic sectional view illustrating a configuration of a hair dryer according to a third exemplary embodiment.

FIG. 46 is a schematic sectional view illustrating a configuration of hair dryer 1 as a hair care device according to the third exemplary embodiment. Hair dryer 1 according to the present exemplary embodiment does not include wetting detection sensor 60*a* and illumination unit 72 included in hair dryer 1 according to the first exemplary embodiment. On the other hand, hair dryer 1 according to the present exemplary embodiment includes brush part 22 attached to discharge port 10*b*, and moisture content sensor 60*d* installed on brush part 22. Here, since the other configurations of hair dryer 1 are the same as those in the first exemplary embodiment (excluding those related to control of controller 80, signal processing unit 90, and the like), the same reference numerals are given, and a detailed description thereof is omitted.

In this case, the hair measurement value is the moisture content of the hair. Moisture content sensor 60*d* can measure the moisture content of the hair while the user dries the hair while applying the brush part 22 to the hair. Then, drying estimation calculation unit 87 can estimate the degree of dryness based on the acquired moisture content.

Fourth Exemplary Embodiment

In each of the above exemplary embodiments, hair dryer 1 is illustrated as the hair care device according to the present disclosure. The hair care device according to the present disclosure is not limited to the hair dryer as described above, and may be, for example, a hair iron.

Figure 47:
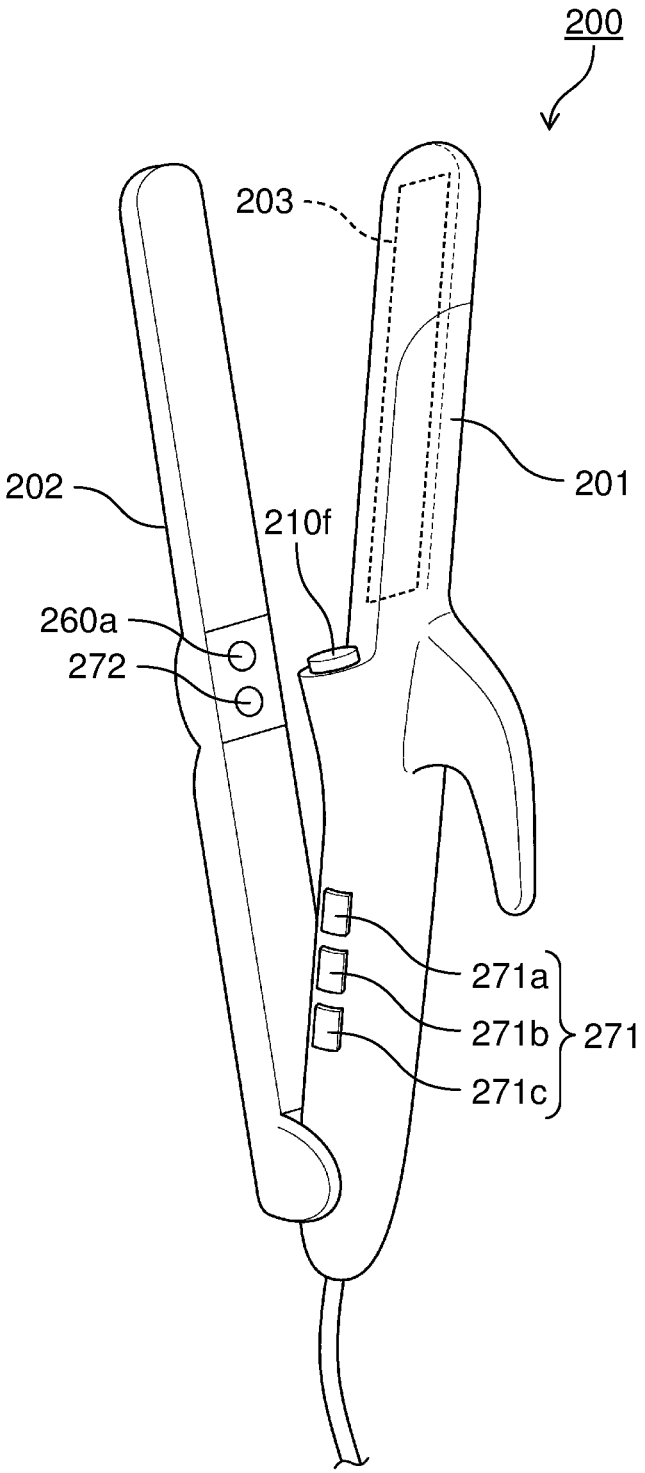
FIG. 47 is a schematic perspective view illustrating a configuration of a hair iron according to a fourth exemplary embodiment.

FIG. 47 is a schematic perspective view illustrating a configuration of hair iron 200 as a hair care device according to the fourth exemplary embodiment. Hair iron 200 includes first main body 201 and second main body 202 that face each other and sandwich the user's hair. On at least one of the opposite surfaces of first main body 201 and second main body 202, heater plate 203 is disposed as a heat application unit that replaces heat application unit 30 in hair dryer 1. In this case, the point expressed as "drying" in the description of hair dryer 1 according to the first exemplary embodiment can be replaced with "adjusting the hairstyle (or forming a hairstyle)" in the present exemplary embodiment.

For example, first main body 201 may internally include, for example, component generation unit 40 and controller 80 as described in each of the above exemplary embodiments. In first main body 201, component discharge port 10*f* corresponding to component discharge port 210*f* in hair dryer 1 may be disposed near heater plate 203. Furthermore, first main body 201 may include input unit 271 corresponding to input unit 71 in hair dryer 1. In this case, input unit 271 includes three input buttons of hair quality input unit 271*a*, hair length input unit 271*b*, and hair volume input unit 271*c*.

On the other hand, for example, second main body 202 may include wetting detection sensor 260*a* corresponding to wetting detection sensor 60*a* in hair dryer 1, and illumination unit 272 corresponding to illumination unit 72 in hair dryer 1. Wetting detection sensor 260*a* and illumination unit 272 may be disposed near a position facing heater plate 203, respectively.

Such hair iron 200 has the same effect as hair dryer 1 illustrated above.

Fifth Exemplary Embodiment

The hair care device according to the present disclosure is not limited to the hair dryer or hair iron as described above, and may be, for example, a hair brush.

Figure 48:
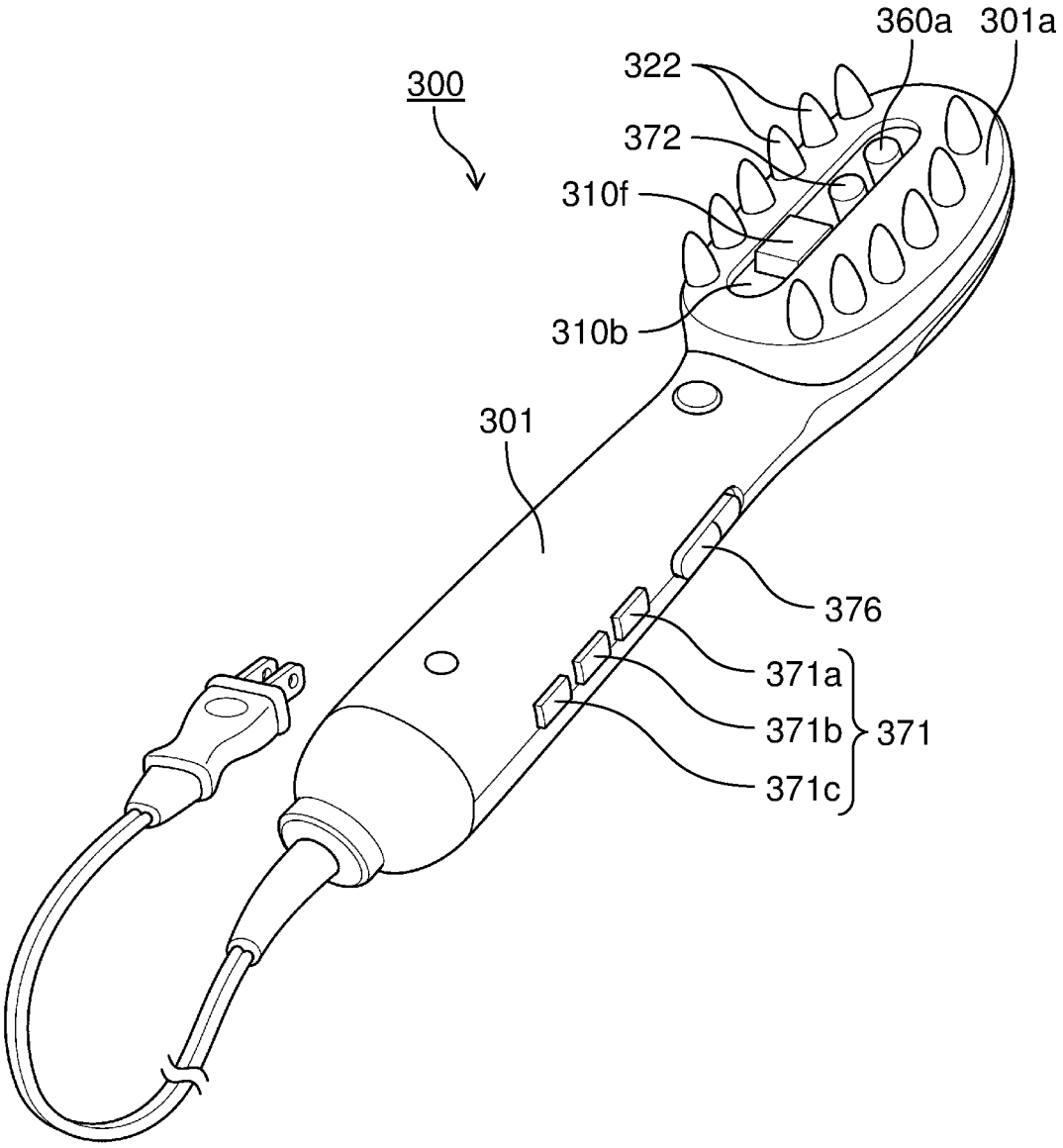
FIG. 48 is a schematic perspective view illustrating a configuration of a hair brush according to a fifth exemplary embodiment.

FIG. 48 is a schematic perspective view showing a configuration of a hair brush 300 as a hair care device according to the fifth exemplary embodiment. Hair brush 300 includes main body 301 having one tip part as brush head 301*a*. Brush head 301*a* includes comb part 322 and discharge port 310*b* corresponding to discharge port 10*b* in hair dryer 1.

For example, main body 301 may include, for example, heat application unit 30, component generation unit 40, and controller 80 as described in each of the above exemplary embodiments. In brush head 301*a*, component discharge port 310*f* corresponding to component discharge port 10*f* in hair dryer 1 may be disposed near discharge port 310*b*. Similarly, in brush head 301*a*, wetting detection sensor 360*a* corresponding to wetting detection sensor 60*a* in hair dryer 1 and illumination unit 372 corresponding to illumination unit 72 in hair dryer 1 may be disposed near discharge port 310*b*. Furthermore, main body 301 may include input unit 371 corresponding to input unit 71 in hair dryer 1, and power supply switch 376 corresponding to power supply switch 76 in hair dryer 1. In this case, input unit 371 includes three input buttons of hair quality input unit 371*a*, hair length input unit 371*b*, and hair volume input unit 371*c*.

Such hair brush 300 has the same effect as hair dryer 1 illustrated above.

(Hair Care System)

When a hair care system is constructed with the hair care device according to each of the exemplary embodiments described above and portable terminal device 100 exemplified in, for example, FIG. 2, it is possible to optimize the component application amount be applied to the hair for each user based on various information managed outside.

Figure 49:
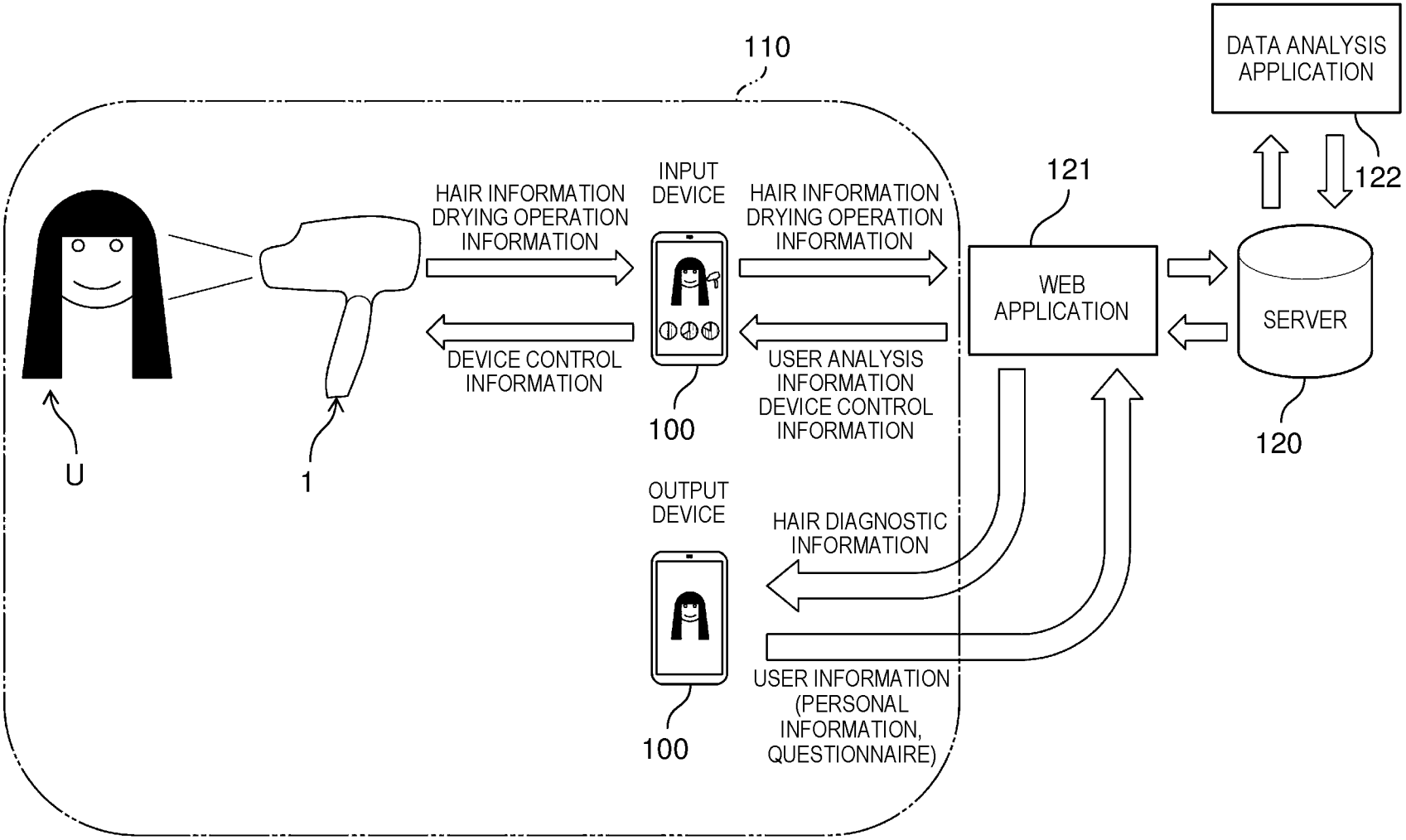
FIG. 49 is a system configuration diagram including a hair care system according to one exemplary embodiment.

FIG. 49 is a system configuration diagram including hair care system 110 according to the present exemplary embodiment. To start with, hair care system 110 includes a hair care device according to each of the exemplary embodiments described above and portable terminal device 100. In the example of FIG. 49, hair dryer 1 according to the first exemplary embodiment is adopted as the hair care device. Further, in FIG. 49, two portable terminal devices 100 are drawn as an input device and an output device, but these portable terminal devices 100 are identical to each other for convenience of indicating an input path and an output path for information. In other words, hair care system 110 includes hair dryer 1 as the hair care device according to each of the exemplary embodiments described above, and portable terminal device 100. Hair dryer 1 includes transmitting and receiving unit 74, and portable terminal device 100 includes terminal communication unit 103 that performs transmission and reception with transmitting and receiving unit 74.

Further, server 120 that manages various information is provided outside hair care system 110. Hair care system 110 can exchange information with server 120 via web application 121. Further, server 120 can exchange information with, for example, data analysis application 122 held by a data management supplier.

To start with, controller 80 in hair dryer 1 can transmit hair information and drying operation information of the user U to portable terminal device 100. Portable terminal device 100 transmits hair information and the like received from hair dryer 1 side to server 120 via web application 121. Server 120 manages these information. The information managed by server 120 is analyzed by data analysis application 122. Web application 121 acquires an analysis result from server 120, and transmits the analysis result to portable terminal device 100 as user analysis information or device control information. The user analysis information is displayed on terminal display unit 101 of portable terminal device 100, and the device control information is transmitted to hair dryer 1. On the other hand, the user can transmit user information such as personal information and a questionnaire from portable terminal device 100 to web application 121. Further, the user can acquire and view hair diagnosis information and the like from web application 121 via portable terminal device 100.

With such hair care system 110, it is possible to analyze information such as an optimum amount of a component for the user acquired by hair dryer 1 and to feed back the information to the user, so that convenience for the user can be further improved.

Other Exemplary Embodiments

A hair care device according to another exemplary embodiment of the present disclosure may include a hairstyle discrimination unit, a hairstyle recognition unit, an agent component amount determination unit, and an agent spraying unit. The hairstyle discrimination unit discriminates a hairstyle of the user. The hairstyle recognition unit classifies the hairstyle of the user from the hairstyle discrimination data discriminated by the hairstyle discrimination unit. The agent component amount determination unit determines the component amount of an agent acting on the hair according to a length of the hair, a volume of the hair, or a degree of curly of the hair for each hairstyle recognized by the hairstyle recognition unit. The agent spraying unit sprays the agent to the user's hair in the component amount of the agent determined by the agent component amount determination unit. Here, the hairstyle discrimination unit and the hairstyle recognition unit can be, for example, an alternative to hair characteristic recognition unit 81 in each of the exemplary embodiments described above. Further, the agent component amount determination unit can be, for example, an alternative to table generation unit 82 in each of the exemplary embodiments described above.

The hairstyle discrimination unit may include an imaging unit that photographs the hairstyle of the user. The imaging unit can be, for example, an alternative to photographing unit 60*b* in the second exemplary embodiment.

On the other hand, the hairstyle discrimination unit may include a living body sensing function unit that senses living body information. Here, the living body information is information on the user's living body, that is, the user's hair, skin, or the like, and refers to, for example, the moisture content and temperature of the hair and skin. The living body sensing function unit can be an alternative to at least one of the various sensors described in the above exemplary embodiments.

The agent spraying unit may include a heat application unit that adjusts the shape of the hair. The heat application unit herein may be, for example, an alternative to heat application unit 30 in the first exemplary embodiment or heater plate 203 in the fourth exemplary embodiment.

On the other hand, the agent spraying unit may include a brush-like portion that adjusts the shape of the hair. The brush-like portion may be, for example, an alternative to brush part 22 in the third exemplary embodiment.

Further, the hairstyle discrimination unit may include a hairstyle state display unit that displays a hair state. The hairstyle state display unit may be an alternative to display 73 in each of the exemplary embodiments described above.

The hairstyle state display unit may include a hair state division display unit capable of dividing and displaying the hair state. The hair state division display unit may be an alternative to display 73 that displays image 101*a* as the divided image as described with reference to FIG. 21A and the like in the first exemplary embodiment.

The agent component amount determination unit may include an agent component amount changing unit that changes the component amount of the agent to a desired amount for each divided display in the hair state division display unit. The agent component amount changing unit may be, for example, an alternative to at least one of application amount calculation unit 83, component amount control unit 84, and accumulative calculation unit 88 in each of the exemplary embodiments described above.

The living body sensing function unit of the hairstyle discrimination unit may include a hair wetting state detection unit that detects a wetting state of the user's hair. The hair wetting state detection unit may include, for example, wetting detection unit 60 in the first exemplary embodiment.

The hair wetting state detection unit may estimate the degree of dryness by machine learning. The hair wetting state detection unit may be, for example, an alternative to drying estimation calculation unit 87 in the second exemplary embodiment.

Further, the agent component amount determination unit may determine the component amount of the agent acting on the hair according to the wetting state of the user's hair detected by the hair wetting state detection unit.

Furthermore, the hairstyle discrimination unit may include a hair measurement timing determination unit that determines a measurement timing of the hair according to the wetting state of the user's hair detected by the hair wetting state detection unit.

Note that, since the exemplary embodiment described above are intended to illustrate the technique in the present disclosure, various changes, replacements, additions, omissions, and the like may be made within the scope of the claims or equivalents thereof.

INDUSTRIAL APPLICABILITY

The present disclosure is applicable to all hair care devices for home use or business use that dry a user's hair or adjust a hairstyle of a user.

REFERENCE MARKS IN THE DRAWINGS

1 hair dryer
1*a* first hair dryer
1*b* second hair dryer
1*c* third hair dryer
2 power supply cord
3 housing
3*a* partition plate
4 air blowing flow channel
10 main body
10*a* suction port
10*b* discharge port
10*c* connecting part
10*d* connecting shaft
10*e* branch channel
10*f* component discharge port
10*g* front surface portion
14 nozzle part
20 grip part
20*a* housing
22 brush part
30 heat application unit
31 fan
32 motor
33 heating unit
40 component generation unit
40*a* first electrostatic atomization device
40*b* second electrostatic atomization device
40*c* third electrostatic atomization device
41*a* mist atomizer
41*b* tank
41*c* pump
41*d* GND electrode
41*e* high voltage circuit
411 pump drive circuit
42*a* discharger
42*b* GND electrode
42*c* high voltage circuit
43*a* discharger
43*b* Peltier element

43*c* GND electrode
43*d* high voltage circuit
50 measurement unit
60 wetting detection unit
60*a* wetting detection sensor
60*b* photographing unit
60*c* temperature sensor
60*d* moisture content sensor
61 room temperature sensor
62 humidity sensor
63 hair detection unit
64 part detection unit
71 input unit
71*a* hair quality input unit
71*b* hair length input unit
71*c* hair volume input unit
72 illumination unit
73 display
74 transmitting and receiving unit
75 storage
76 power supply switch
80 controller
81 hair characteristic recognition unit
82 table generation unit
83 application amount calculation unit
84 component amount control unit
85 heat amount control unit
86 wetting calculation unit
87 drying estimation calculation unit
88 accumulative calculation unit
90 signal processing unit
91 part calculation unit
92 initial position determination unit
100 portable terminal device
101 terminal display unit
101*a* image
101*b* first tap area
101*c* second tap area
101*d* third tap area
101*e* first pie chart
101*f* second pie chart
102 terminal photographing unit
103 terminal communication unit
110 hair care system
120 server
121 Web application
122 data analysis application
200 hair iron
201 first main body
202 second main body
203 heater plate
210*f* component discharge port
260*a* wetting detection sensor
271 input unit
271*a* hair quality input unit
271*b* hair length input unit
271*c* hair volume input unit
272 illumination unit
300 hairbrush
301 main body
301*a* brush head
310*b* discharge port
310*f* component discharge port
322 comb part
360*a* wetting detection sensor
371 input unit
371*a* hair quality input unit
371*b* hair length input unit
371*c* hair volume input unit
372 illumination unit
376 power supply switch

The invention claimed is:

1. A hair care device comprising:

a heat application unit that applies heat to hair of a user;

a component generation unit that generates a component acting on the hair;

a measurement unit that measures or photographs the hair; and a controller that controls operations of the heat application unit and the component generation unit based on a hair measurement value or a hair image obtained from the measurement unit, wherein the controller includes a hair characteristic recognition unit that classifies hair characteristics of the user based on the hair measurement value or the hair image;

a table generation unit that sets a component amount of the component generated by the component generation unit for each of the hair characteristics classified by the hair characteristic recognition unit; and an application amount calculation unit that adjusts the component amount for each user based on the hair characteristics of whole hair classified by the hair characteristic recognition unit and the component amount set by the table generation unit, or calculates a component application amount given by the component generation unit or a heat application amount given by the heat application unit for each part based on the hair characteristics for each part of the hair classified by the hair characteristic recognition unit and the component amount set by the table generation unit.

2. The hair care device according to claim 1, wherein the hair characteristics are at least one of a hairstyle of the user, a length of the hair, a volume of the hair, and hair quality related to a thickness or gloss of the hair.

3. The hair care device according to claim 1, comprising a display that displays at least a divided image divided into at least two in a front-back direction, a left-right direction, or an up-down direction of the hair, wherein the controller changes the component amount to an amount desired by the user based on a divided portion selected by the user in the divided image on the display.

4. The hair care device according to claim 1, wherein the controller includes a wetting calculation unit that calculates wetting information on wetting of the hair based on the hair measurement value or the hair image, and in a case where the wetting calculation unit determines that the user has not washed hair or the hair is not wet, the controller causes the hair characteristic recognition unit to execute a classification of the hair characteristics, while in a case where the wetting calculation unit determines that the hair is wet, the controller causes the table generation unit to set the component amount based on the hair characteristics classified by the hair characteristic recognition unit up to a previous time.

5. The hair care device according to claim 1, wherein the controller includes a drying estimation calculation unit that estimates a degree of dryness of the hair based on the hair measurement value or the hair image, and the application amount calculation unit further adjusts the component amount based on the degree of dryness estimated by the drying estimation calculation unit.

6. The hair care device according to claim 5, wherein the measurement unit includes a wetting detection sensor having at least an absorption wavelength of water as the hair measurement value, the wetting calculation unit calculates absorbance from the hair measurement value detected by the wetting detection sensor, and the drying estimation calculation unit estimates the degree of dryness based on a change in the absorbance calculated by the wetting calculation unit.

7. The hair care device according to claim 6, wherein the measurement unit includes an illumination unit that emits light having at least the absorption wavelength of water, the wetting detection sensor is a photodiode, and the drying estimation calculation unit estimates the degree of dryness by equalizing a degree of reflection of the light from the illumination unit in accordance with a bent shape of a head of the user.

8. The hair care device according to claim 5, wherein in a case where the drying estimation calculation unit determines that the degree of dryness is at an atmosphere level, the controller performs at least one of operations of causing the heat application unit not to apply heat, causing the component generation unit to stop applying the component, and causing the component generation unit not to count application time even when the component generation unit applies the component.

9. The hair care device according to claim 5, wherein in a case where the drying estimation calculation unit determines that the degree of dryness is at a skin level of the user, the controller performs at least one of operations of causing the heat application unit not to apply heat, and causing the component generation unit to apply the component effective for the skin of the user.

10. The hair care device according to claim 5, wherein the measurement unit includes a photographing unit that uses a two-dimensional image as the hair image, and the drying estimation calculation unit estimates the degree of dryness for each drying time by machine learning based on teacher data of the two-dimensional image photographed by the photographing unit for each drying time.

11. The hair care device according to claim 10, wherein the drying estimation calculation unit estimates the degree of dryness for each part of the hair.

12. The hair care device according to claim 1, comprising a transmitting and receiving unit that perform transmission and reception with a terminal communication unit provided in a portable terminal device as an external communication device, wherein when at least a divided image divided into at least two in a front-back direction, a left-right direction, or an up-down direction of the hair is displayed on a terminal display unit provided in the portable terminal device, the transmitting and receiving unit receives, from the terminal communication unit, information on a divided portion selected by the user in the divided image on the terminal display unit, and the controller changes the component amount to an amount desired by the user based on the information on the divided portion received by the transmitting and receiving unit from the terminal communication unit.

13. A hair care system comprising:

the hair care device according to claim 1; and a portable terminal device, wherein the hair care device includes a transmitting and receiving unit, and the portable terminal device includes a terminal communication unit that performs transmission and reception with the transmitting and receiving unit.

14. A hair care device comprising:

a hairstyle discrimination unit that discriminates a hairstyle of a user;

a hairstyle recognition unit that classifies the hairstyle of the user from hairstyle discrimination data discriminated by the hairstyle discrimination unit;

an agent component amount determination unit that determines a component amount of an agent acting on hair of the user according to a length of the hair, a volume of the hair, or a degree of curly of the hair for each of the hairstyle recognized by the hairstyle recognition unit; and an agent spraying unit that sprays the agent to the hair of the user with the component amount of the agent determined by the agent component amount determination unit.

15. The hair care device according to claim 14, wherein the hairstyle discrimination unit includes an imaging unit that photographs the hairstyle of the user.

16. The hair care device according to claim 14, wherein the hairstyle discrimination unit includes a living body sensing function unit that senses living body information.

17. The hair care device according to claim 14, wherein the agent spraying unit includes a heat application unit that adjusts a shape of the hair.

18. The hair care device according to claim 14, wherein the agent spraying unit has a brush-like portion that adjusts a shape of the hair.

19. The hair care device according to claim 14, wherein the hairstyle discrimination unit includes a hairstyle state display unit that displays a state of the hair.

20. The hair care device according to claim 19, wherein the hairstyle state display unit includes a hair state division display unit capable of dividing and displaying a state of the hair.

21. The hair care device according to claim 20, wherein the agent component amount determination unit includes an agent component amount changing unit that changes the component amount of the agent to a desired amount for each divided display on the hair state division display unit.

22. The hair care device according to claim 16, wherein the living body sensing function unit of the hairstyle discrimination unit includes a hair wetting state detection unit that detects a wetting state of the hair of the user.

23. The hair care device according to claim 22, wherein the hair wetting state detection unit estimates a degree of dryness by machine learning.

24. The hair care device according to claim 22, wherein the agent component amount determination unit determines the component amount of the agent acting on the hair according to the wetting state of the hair of the user detected by the hair wetting state detection unit.

25. The hair care device according to claim 22, wherein the hairstyle discrimination unit includes a hair measurement timing determination unit that determines a measurement timing of the hair according to the wetting state of the hair of the user detected by the hair wetting state detection unit.

* * * * *